US011841657B2

(12) United States Patent
Shimura et al.

(10) Patent No.: US 11,841,657 B2
(45) Date of Patent: Dec. 12, 2023

(54) IMAGE HEATING APPARATUS AND HEATER FOR USE THEREIN

(71) Applicant: CANON KABUSHIKI KAISHA, Tokyo (JP)

(72) Inventors: Yasuhiro Shimura, Yokohama (JP); Koji Nihonyanagi, Susono (JP); Ryota Ogura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/830,234

(22) Filed: Jun. 1, 2022

(65) Prior Publication Data

US 2022/0299918 A1 Sep. 22, 2022

Related U.S. Application Data

(63) Continuation of application No. 16/547,287, filed on Aug. 21, 2019, now Pat. No. 11,378,902, which is a continuation of application No. 15/126,959, filed as application No. PCT/JP2015/001482 on Mar. 17, 2015, now Pat. No. 10,416,598.

(30) Foreign Application Priority Data

| | | |
|---|---|---|
| Mar. 19, 2014 | (JP) | 2014-057058 |
| Jan. 26, 2015 | (JP) | 2015-012816 |
| Jan. 27, 2015 | (JP) | 2015-013726 |
| Jan. 29, 2015 | (JP) | 2015-015750 |

(51) Int. Cl.

| | |
|---|---|
| ***G03G 15/20*** | (2006.01) |
| ***G03G 15/00*** | (2006.01) |
| ***H05B 3/03*** | (2006.01) |

(52) U.S. Cl.

CPC ..... *G03G 15/2053* (2013.01); *G03G 15/80* (2013.01); *H05B 3/03* (2013.01); *G03G 15/2014* (2013.01); *G03G 15/2064* (2013.01); *G03G 2215/2035* (2013.01); *H05B 2203/016* (2013.01)

(58) Field of Classification Search

None

See application file for complete search history.

(56) References Cited

U.S. PATENT DOCUMENTS 5,343,021 A * 8/1994 Sato ..... H05B 3/265 219/541

5,915,146 A * 6/1999 Kusaka ..... G03G 15/2042 399/68

(Continued)

*Primary Examiner* — Joseph M. Pelham

(74) *Attorney, Agent, or Firm* — Canon U.S.A., Inc. IP Division

(57) ABSTRACT

The present invention relates to an image heating apparatus that includes a heater including a plurality of independently controllable heating blocks in a longitudinal direction thereof, each including a first conductor, a second conductor, and a heating element. At least one of electrodes corresponding to the respective heating blocks is disposed in an area where the heating element is located in the longitudinal direction on a second surface of the heater that is opposite to a first surface that comes into contact with an endless belt. An electrical contact is arranged so as to face the second surface of the heater. An overheating occurring in a no-media passage portion when an image formed on a recording material having a small size is heated is suppressed or reduced.

6 Claims, 37 Drawing Sheets

(56) References Cited

U.S. PATENT DOCUMENTS 6,084,208 A * 7/2000 Okuda ..... G03G 15/2064 399/329
6,456,819 B1 * 9/2002 Abe ..... G03G 15/2064 399/329
7,228,082 B1 * 6/2007 Davidson ..... G03G 15/2064 399/329
8,126,383 B2 * 2/2012 Kagawa ..... G03G 15/2042 399/329
8,150,304 B2 * 4/2012 Kagawa ..... G03G 15/2053 399/329
8,175,508 B2 * 5/2012 Kageyama ..... G03G 15/2053 399/334
8,295,753 B2 * 10/2012 Kagawa ..... G03G 15/2035 399/329
8,471,178 B2 * 6/2013 Taniguchi ..... G03G 15/2042 399/329
8,592,726 B2 * 11/2013 Tsuruya ..... G03G 15/2042 219/505
8,630,572 B2 * 1/2014 Fujimoto ..... G03G 15/2042 399/334
9,098,033 B2 * 8/2015 Shimura ..... G03G 15/2042
9,235,166 B2 * 1/2016 Shimura ..... G03G 15/2003
11,340,545 B1 * 5/2022 Miyashita ..... G03G 15/2053
2003/0185605 A1 * 10/2003 Okabayashi ..... G03G 15/2064 399/329
2009/0230114 A1 * 9/2009 Taniguchi ..... G03G 15/2042 219/216
2010/0142986 A1 * 6/2010 Davidson ..... G03G 15/2042 399/334
2010/0247131 A1 * 9/2010 Sato ..... G03G 15/2039 399/70
2011/0164906 A1 * 7/2011 Ishida ..... G03G 15/2064 399/329
2012/0230719 A1 * 9/2012 Matsumoto ..... G03G 15/2042 399/334
2013/0343790 A1 * 12/2013 Shimura ..... G03G 15/2053 399/329
2013/0343791 A1 * 12/2013 Shimura ..... H05B 3/03 399/329
2014/0076878 A1 * 3/2014 Shimura ..... H05B 3/03 399/329
2014/0169845 A1 * 6/2014 Nakahara ..... H05B 3/26 399/338
2016/0011546 A1 * 1/2016 Koyanagi ..... G03G 15/2039 399/329
2017/0075266 A1 * 3/2017 Mochizuki ..... G03G 15/2053
2017/0075268 A1 * 3/2017 Ogura ..... G03G 15/2042
2017/0102650 A1 * 4/2017 Shimura ..... H05B 3/03
2018/0004134 A1 * 1/2018 Nomura ..... G03G 15/2042
2018/0253041 A1 * 9/2018 Uchiyama ..... G03G 15/2039
2018/0253043 A1 * 9/2018 Shimura ..... G03G 21/1652
2019/0317434 A1 * 10/2019 Ogura ..... G03G 15/2053
2019/0354045 A1 * 11/2019 Momiyama ..... G03G 15/5004
2019/0391514 A1 * 12/2019 Kawaguchi ..... G03G 15/2025
2020/0026227 A1 * 1/2020 Iwasaki ..... G03G 15/2042
2020/0050136 A1 * 2/2020 Saeki ..... G03G 15/2017
2020/0150566 A1 * 5/2020 Fujiwara ..... G03G 15/5004
2020/0249606 A1 * 8/2020 Takagi ..... G03G 15/2053
2020/0310308 A1 * 10/2020 Jinkoma ..... G03G 15/2021
2021/0247710 A1 * 8/2021 Sato ..... G03G 15/2042
2021/0255569 A1 * 8/2021 Uekawa ..... G03G 15/2039
2021/0255570 A1 * 8/2021 Tsuchihashi ..... G03G 15/2042

* cited by examiner

IMAGE HEATING APPARATUS AND HEATER FOR USE THEREIN

CROSS-REFERENCE TO RELATED APPLICATIONS

This application is a continuation of U.S. patent application Ser. No. 16/547,287, filed Aug. 21, 2019, which is a continuation of U.S. patent application Ser. No. 15/126,959, filed Sep. 16, 2016, and issued as U.S. Pat. No. 10,416,598 on Sep. 17, 2019, which is a National Stage application of International Patent Application No. PCT/JP2015/001482, filed Mar. 17, 2015, which claims the benefit of Japanese Patent Application No. 2014-057058, filed Mar. 19, 2014, Japanese Patent Application No. 2015-012816, filed Jan. 26, 2015, Japanese Patent Application No. 2015-013726, filed Jan. 27, 2015, and Japanese Patent Application No. 2015-015750, filed Jan. 29, 2015, which are hereby incorporated by reference herein in their entirety.

TECHNICAL FIELD

The present invention relates to image heating apparatuses and heaters for use therein. More specifically, the present invention relates to an image heating apparatus, such as a fixing apparatus incorporated in an image forming apparatus of an electrophotographic recording type such as a copying machine or a printer, or a gloss applying apparatus for further heating a fixed toner image on a recording material to improve the glossiness of the toner image, and to a heater for use in the image heating apparatus.

BACKGROUND ART

One of the image heating apparatuses described above is an apparatus that includes an endless belt (also referred to as an endless film), a heater that comes into contact with an inner surface of the endless belt, and a roller cooperative with the heater to form a nip portion therebetween with the endless belt interposed therebetween. Continuous printing on small-size sheets using an image forming apparatus including such an image heating apparatus causes a phenomenon in which a gradual temperature rise occurs in an area of the nip portion through which the sheets do not pass in the longitudinal direction of the nip portion. This phenomenon is referred to as overheating in a no-media passage portion. Too high a temperature of the no-media passage portion may damage components in the apparatus, or may cause toner to be offset to the endless belt in an area of the large-size sheet which corresponds to the no-media passage portion.

One of the techniques to suppress the overheating in the no-media passage portion is as follows. A heating resistor (hereinafter referred to as a "heating element") on a substrate of a heater is formed of a material having a positive temperature coefficient of resistance. Two conductors are disposed at opposite ends of the substrate in a transverse direction of the heater (a direction in which a recording sheet is conveyed) so that current flows through the heating element in the transverse direction (hereinafter referred to as the path of current in the conveyance direction) (see PTL 1). In the concept disclosed in PTL 1, as the temperature of the no-media passage portion increases, the resistance of the heating element in the no-media passage portion increases, suppressing current flowing through the heating element in the no-media passage portion and thus preventing the overheating in the no-media passage portion. The positive temperature coefficient of resistance is a characteristic in which the resistance increases as the temperature increases, and is hereinafter referred to as the PTC.

However, also in the heater described above, a certain amount of current flows through the heating element in the no-media passage portion.

CITATION LIST

Patent Literature

[PTL 1]
Japanese Patent Laid-Open No. 2011-151003

SUMMARY OF INVENTION

The present invention provides a heater and an image heating apparatus configured to suppress or at least reduce the overheating in a no-media passage portion of the heater without an increase in the size of the heater.

To this end, an aspect of the present invention provides an image heating apparatus which includes an endless belt; a heater configured to be in contact with an inner surface of the endless belt, the heater including a substrate, a first conductor disposed at a first position on the substrate so as to extend in a longitudinal direction of the substrate, a second conductor disposed at a second position on the substrate so as to extend in the longitudinal direction, the second position being different from the first position in a transverse direction of the substrate that is transverse to the longitudinal direction, and a heating element disposed between the first conductor and the second conductor and configured to generate heat by power supplied thereto via the first conductor and the second conductor; and electrical contacts configured to be in contact with electrodes of the heater to supply power to the heating element. The heater has a plurality of independently controllable heating blocks in the longitudinal direction, each of the plurality of independently controllable heating blocks including the first conductor, the second conductor, and the heating element. At least one of electrodes each corresponding to one of the plurality of heating blocks is disposed in an area where the heating element is located in the longitudinal direction on a second surface opposite to a first surface of the heater that comes into contact with the endless belt. The electrical contacts are arranged so as to face the second surface of the heater.

Another aspect of the present invention provides a heater which includes a substrate; a first conductor disposed at a first position on the substrate so as to extend in a longitudinal direction of the substrate; a second conductor disposed at a second position on the substrate so as to extend in the longitudinal direction, the second position being different from the first position in a transverse direction of the substrate that is transverse to the longitudinal direction; and a heating element disposed between the first conductor and the second conductor and configured to generate heat by power supplied thereto via the first conductor and the second conductor. The heater has a plurality of independently controllable heating blocks in the longitudinal direction, each of the plurality of independently controllable heating blocks including the first conductor, the second conductor, and the heating element. At least one of electrodes each corresponding to one of the plurality of heating blocks is disposed in an area where the heating element is located in the longitudinal direction.

Still another aspect of the present invention provides an image heating apparatus which includes an endless belt; and a heater configured to be in contact with an inner surface of the endless belt, the heater including a substrate, a first conductor disposed at a first position on the substrate so as to extend in a longitudinal direction of the substrate, a second conductor disposed at a second position on the substrate so as to extend in the longitudinal direction, the second position being different from the first position in a transverse direction of the substrate that is transverse to the longitudinal direction, and a heating element disposed between the first conductor and the second conductor and configured to generate heat by power supplied thereto via the first conductor and the second conductor. The heater has a plurality of independently controllable heating blocks in the longitudinal direction, each of the plurality of independently controllable heating blocks including the first conductor, the second conductor, and the heating element. Each of the plurality of heating blocks has a plurality of heating elements in the transverse direction of the substrate. The plurality of heating elements in each of the plurality of heating blocks are also independently controllable.

Still another aspect of the present invention provides a heater which includes a substrate; a first conductor disposed at a first position on the substrate so as to extend in a longitudinal direction of the substrate; a second conductor disposed at a second position on the substrate so as to extend in the longitudinal direction, the second position being different from the first position in a transverse direction of the substrate that is transverse to the longitudinal direction; and a heating element disposed between the first conductor and the second conductor and configured to generate heat by power supplied thereto via the first conductor and the second conductor. The heater has a plurality of independently controllable heating blocks in the longitudinal direction, each of the plurality of independently controllable heating blocks including the first conductor, the second conductor, and the heating element. Each of the plurality of heating blocks has a plurality of heating elements in the transverse direction of the substrate. The plurality of heating elements in each of the plurality of heating blocks are also independently controllable.

Still another aspect of the present invention provides an image heating apparatus which includes an endless belt; and a heater configured to be in contact with an inner surface of the endless belt, the heater including a substrate, a first heating block disposed on the substrate, and a second heating block disposed on the substrate at a position different from the position of the first heating block in a longitudinal direction of the substrate. The image heating apparatus has a first wire for the second heating block, the first wire being connected to a conductor for supplying power to the second heating block, and a second wire having a first end connected to the conductor to which the first wire for the second heating block is connected at a different position from a position at which the first wire for the second heating block is connected to the conductor, and having a second end connected to a conductor for the first heating block for supplying power to the first heating block. Power is supplied to the first heating block via the conductor to which the first wire for the second heating block is connected and via the second wire.

Advantageous Effects of Invention

According to some aspects of the present invention, a heater and an image heating apparatus may suppress or reduce the overheating in a no-media passage portion without an increase in the size of the heater.

Further features of the present invention will become apparent from the following description of exemplary embodiments with reference to the attached drawings.

DESCRIPTION OF EMBODIMENTS

First Exemplary Embodiment

Figure 1:
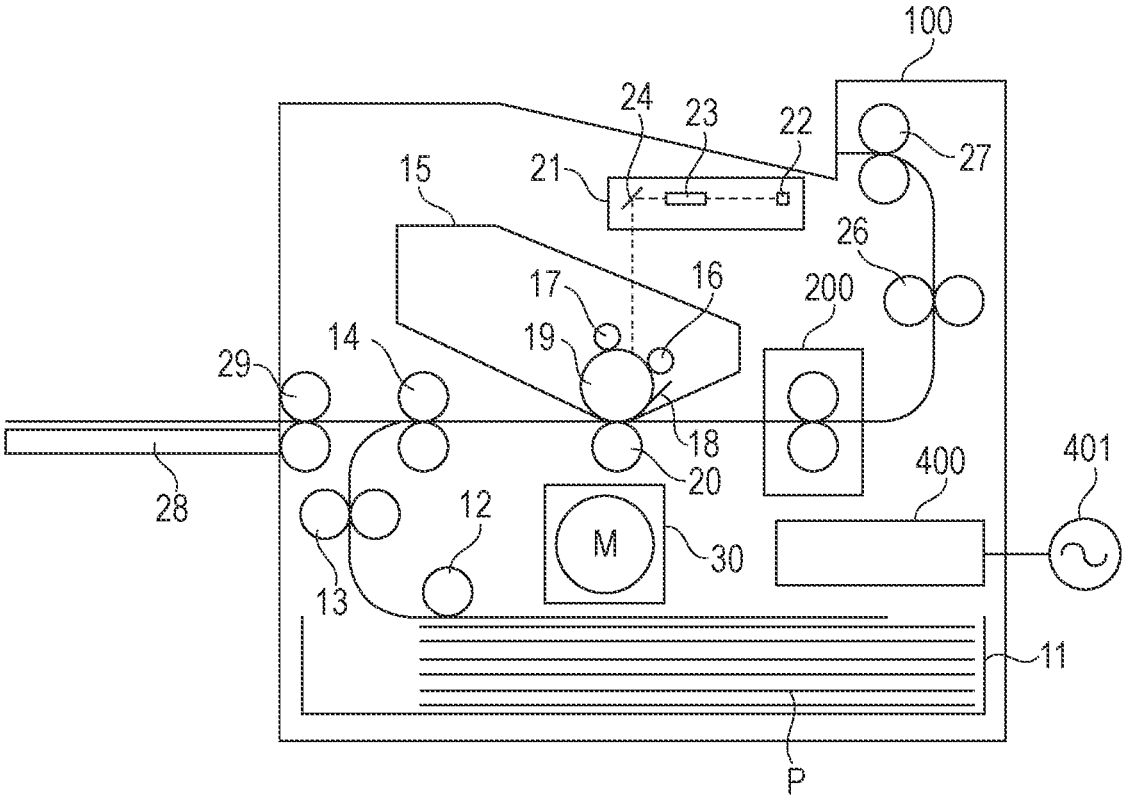
FIG. 1 is a cross-sectional view of an image forming apparatus.

FIG. 1 is a cross-sectional view of a laser printer (an image forming apparatus) 100 that uses electrophotographic recording technology. In response to the generation of a print signal, laser light modulated in accordance with image information is emitted from a scanner unit 21, and a photosensitive member 19 which is charged to a predetermined polarity by a charging roller 16 is scanned with the laser light. The laser light (dotted line) emitted from a laser diode 22 within the scanner unit 21 is caused to scan in a main scanning direction via a rotating polygon mirror 23 and a reflecting mirror 24, and in a sub scanning direction by rotation of the photosensitive member 19. Accordingly, an electrostatic latent image is formed on the photosensitive member 19. Toner is supplied to the electrostatic latent image from a developing device 17, and a toner image corresponding to the image information is formed on the photosensitive member 19. Recording materials (recording sheets) P in a sheet feed cassette 11 are fed one-by-one by a pickup roller 12, and a recording material P is conveyed toward a pair of registration rollers 14 by a pair of rollers 13. The recording material P is further conveyed from the pair of registration rollers 14 to a transfer position at the timing of the toner image on the photosensitive member 19 arriving at the transfer position. The transfer position is located between the photosensitive member 19 and a transfer roller 20. While the recording material P travels through the transfer position, the toner image on the photosensitive member 19 is transferred onto the recording material P. The recording material P is then heated by an image heating apparatus 200 so that the toner image is fixed to the recording material P by heat. The recording material P that carries the fixed toner image is fed by pairs of rollers 26 and 27 and is discharged into an upper tray of the laser printer 100. A cleaner 18 cleans the photosensitive member 19. A feed tray (manual feed tray) 28 has a pair of recording material regulating plates whose width is adjustable in accordance with the size of a recording material P. The feed tray 28 is provided to support recording materials P having non-standard sizes as well as standard sizes. A pair of pickup rollers 29 feeds a recording material P from the feed tray 28. A motor 30 drives the image heating apparatus 200 and so on. A control circuit 400 is connected to a commercial alternating current (AC) power supply 401, and power is supplied from the control circuit 400 to the image heating apparatus 200. The photosensitive member 19, the charging roller 16, the scanner unit 21, the developing device 17, and the transfer roller 20 form an image forming unit that forms an unfixed image on a recording material P. A process cartridge 15 integrally includes the charging roller 16, the developing device 17, the cleaner 18, and the photosensitive member 19.

The laser printer 100 according to this exemplary embodiment supports a plurality of recording material sizes. The sheet feed cassette 11 is configured to hold sheets of letter size (approximately 216 mm×279 mm), legal size (approximately 216 mm×356 mm), A4 size (210 mm×297 mm), and executive size (approximately 184 mm×267 mm). The sheet feed cassette 11 is also configured to hold sheets of JIS (Japanese Industrial Standard) B5 size (182 mm×257 mm) and A5 size (148 mm×210 mm).

In addition, media in non-standard sizes including DL envelopes (110 mm×220 mm) and Commercial number 10 (COM-10) envelopes (approximately 105 mm×241 mm)

may also be fed from the feed tray 28 and are printable. The printer 100 according to this exemplary embodiment is a basically vertical-feed laser printer (designed to convey a sheet in such a manner that the longer sides of the sheet are parallel to the conveyance direction of the sheet). A letter size sheet and a legal size sheet are recording materials having the largest width (or a large width) among the widths of recording materials in the standard sizes (nominal recording material widths) that the image forming apparatus 100 supports, and have a width of approximately 216 mm. In this exemplary embodiment, a recording material P having a smaller width than the maximum size that the image forming apparatus 100 supports is defined as a small-size sheet.

Figure 2:
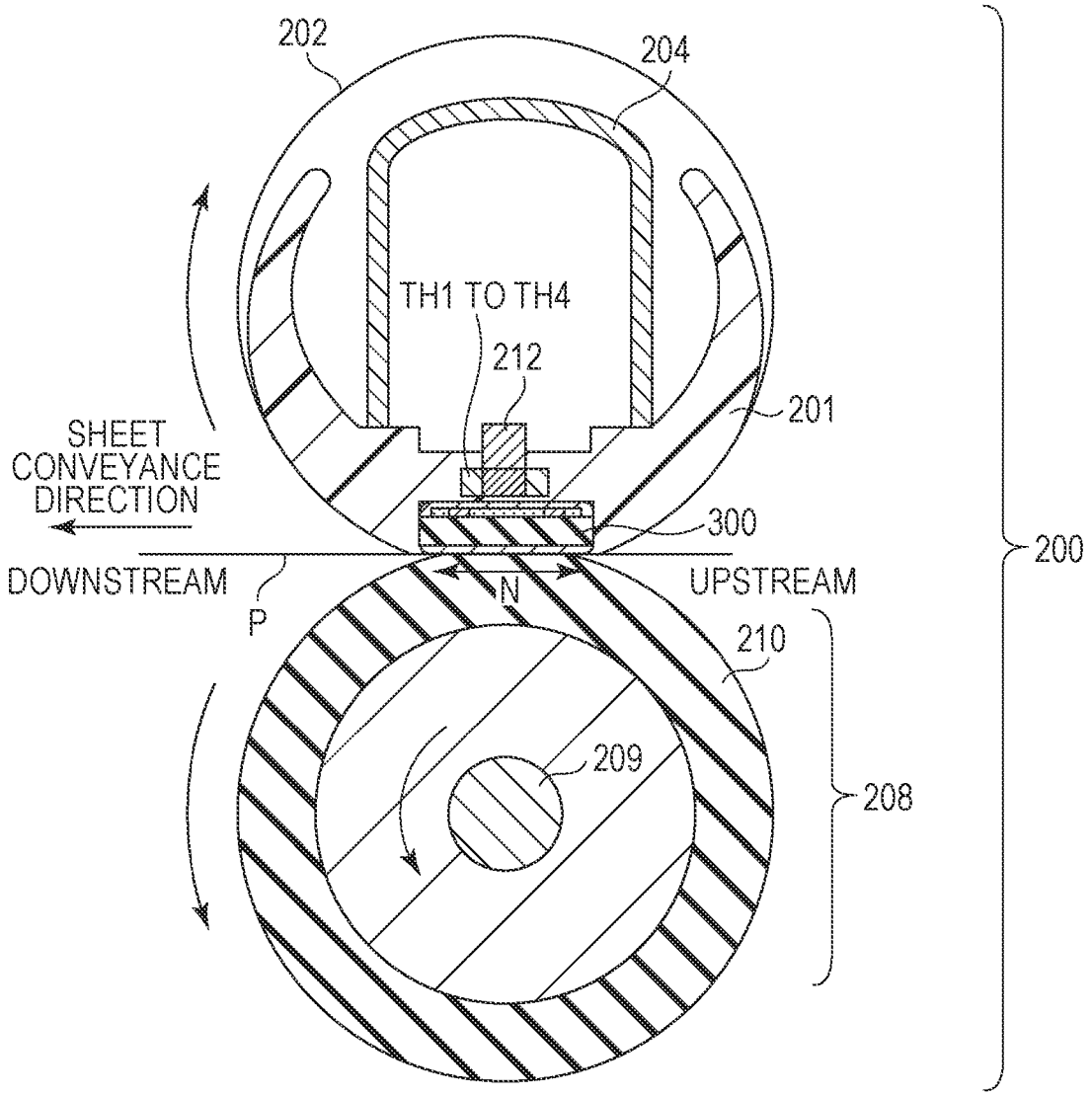
FIG. 2 is a cross-sectional view of an image heating apparatus according to a first exemplary embodiment.

FIG. 2 is a cross-sectional view of the image heating apparatus 200. The image heating apparatus 200 includes a cylindrical film (endless belt) 202, a heater 300 that comes into contact with an inner surface of the film 202, and a pressure roller (a nip portion forming member) 208 cooperative with the heater 300 to form a fixing nip portion N therebetween with the film 202 interposed therebetween. The film 202 has a base layer composed of heat-resistant resin such as polyimide or metal such as stainless steel. The film 202 also has a top layer which may be formed of an elastic layer of heat-resistant rubber or the like. The pressure roller 208 has a core metal 209 formed of a material such as iron or aluminum, and an elastic layer 210 formed of a material such as silicone rubber. The heater 300 is held in a holding member 201 made of heat-resistant resin. The holding member 201 has a guide function to guide the rotation of the film 202. The pressure roller 208 is driven by the motor 30 to rotate in a direction indicated by an arrow. As the pressure roller 208 rotates, the film 202 rotates in association with the rotation of the pressure roller 208. A recording material P that carries an unfixed toner image is conveyed while being held in the fixing nip portion N, and is heated to undergo fixing.

Figure 3A:
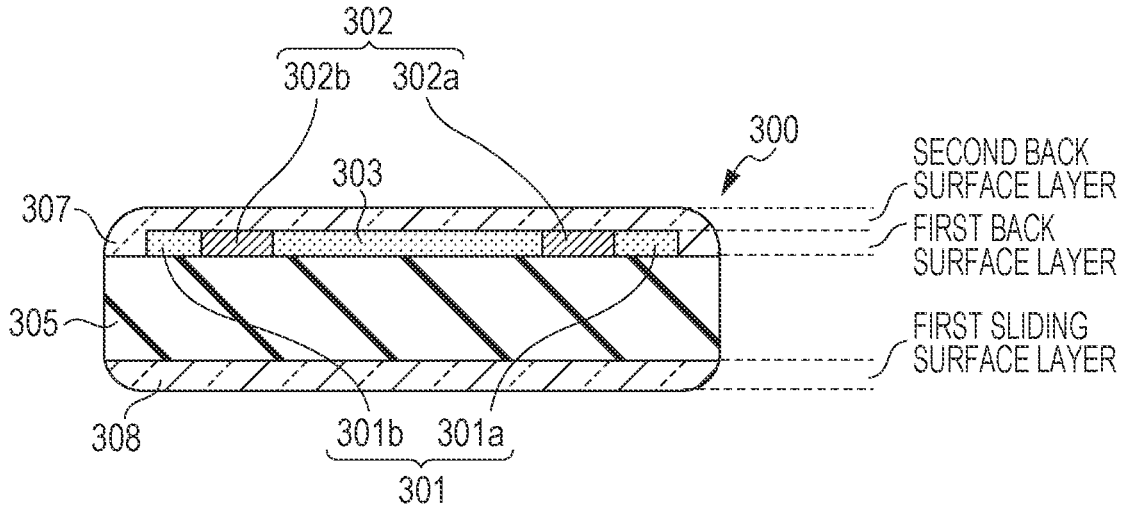
FIG. 3A is a configuration diagram of a heater according to the first exemplary embodiment.

As illustrated in FIG. 3A, the heater 300 includes a ceramic substrate 305 on which a heating element for use in heating is disposed. Thermistors TH1, TH2, TH3, and TH4 serving as temperature sensing elements are disposed on a back surface of the substrate 305 in contact with a sheet (or media) passage area in the laser printer 100. A safety element 212 activated in response to an abnormal temperature rise in the heater 300 to shut off the power supply to the heater 300, such as a thermo-switch and a thermal fuse, is also disposed on the back surface of the substrate 305. A metal stay 204 is disposed to apply the pressure exerted by a spring (not illustrated) to the holding member 201.

Figure 3B:
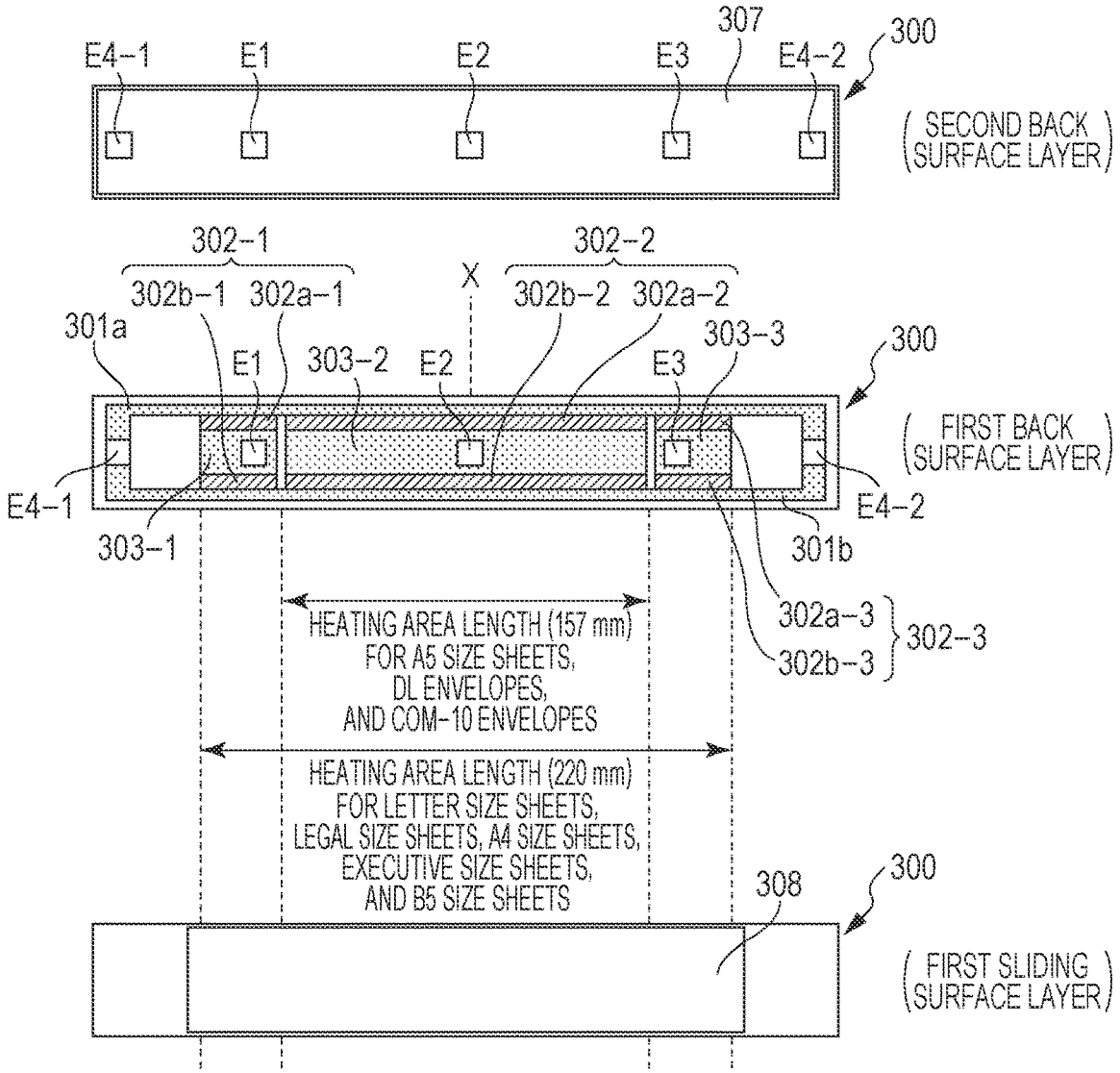
FIG. 3B is a configuration diagram of the heater according to the first exemplary embodiment.
Figure 3C:
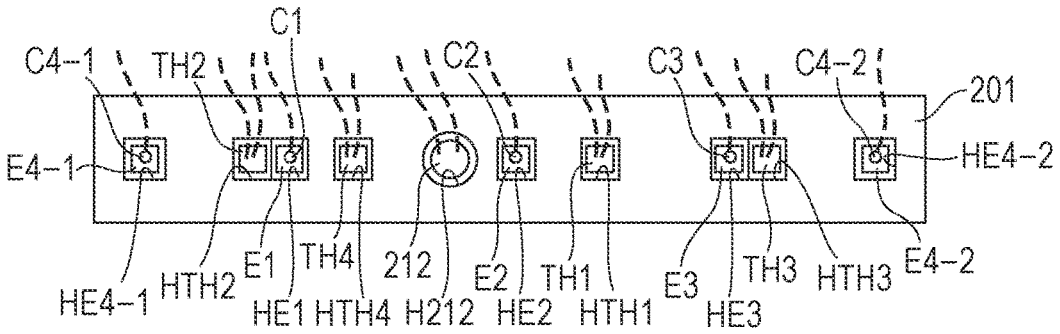
FIG. 3C is a configuration diagram of the heater according to the first exemplary embodiment.

FIGS. 3A to 3C are configuration diagrams of the heater 300 according to the first exemplary embodiment. The configuration of the heater 300 and the effect of reducing the overheating in a no-media passage portion will be described with reference to FIGS. 3A to 3C and FIGS. 6A and 6B.

FIG. 3A is a diagram of a cross section of the heater 300 in its transverse direction. The heater 300 includes a first conductor 301 disposed on a first layer of a back surface thereof (i.e., the surface opposite to the surface that comes into contact with the endless belt 202) (hereinafter also referred to as the "first back surface layer") so as to extend in the longitudinal direction of the heater 300 on the substrate 305. The heater 300 further includes a second conductor 303 disposed on the substrate 305 at a position different from the position of the first conductor 301 in the transverse direction of the heater 300 so as to extend in the longitudinal direction of the heater 300. The first conductor 301 is separated into a conductor 301*a* located upstream and a conductor 301*b* located downstream in the conveyance direction of the recording material P.

The heater 300 further includes a heating element 302 disposed between the first conductor 301 and the second conductor 303 for generating heat by power supplied via the first conductor 301 and the second conductor 303. The heating element 302 is separated into a heating element 302*a* located upstream and a heating element 302*b* located downstream in the conveyance direction of the recording material P.

An asymmetric heat generation distribution in the transverse direction of the heater 300 (i.e., the conveyance direction of the recording material P) causes an increase in the stress generated in the substrate 305 while the heater 300 generates heat. The increased stress generated in the substrate 305 may crack the substrate 305. To avoid cracking of the substrate 305, the heating element 302 is separated into the heating element 302*a* located upstream and the heating element 302*b* located downstream in the conveyance direction to make the heat generation distribution symmetrical in the transverse direction of the heater 300.

The heater 300 also includes an insulating (in this exemplary embodiment, glass) surface protective layer 307 disposed on a second layer of the back surface thereof (hereinafter also referred to as the "second back surface layer") so as to cover the heating element 302, the first conductor 301, and the second conductor 303. The heater 300 further includes a glass-coated or polyimide-coated slidable surface protective layer 308 disposed on a first layer of a sliding surface thereof (i.e., the surface that comes into contact with the endless belt 202) (hereinafter also referred to as the "first sliding surface layer").

FIG. 3B is a plan view of individual layers of the heater 300. The heater 300 has a plurality of heating blocks on the first layer of the back surface thereof that are arranged in the longitudinal direction of the heater 300, each heating block including the first conductor 301, the second conductor 303, and the heating element 302. Byway of example, the heater 300 according to this exemplary embodiment has a total of three heating blocks disposed in the center portion and opposite end portions thereof in the longitudinal direction of the heater 300. A first heating block 302-1 includes heating elements 302*a*-1 and 302*b*-1 that are symmetrical to each other in the transverse direction of the heater 300. Also, a second heating block 302-2 includes heating elements 302*a*-2 and 302*b*-2, and a third heating block 302-3 includes heating elements 302*a*-3 and 302*b*-3.

The first conductor 301 extends in the longitudinal direction of the heater 300. The first conductor 301 is composed of the conductor 301*a*, which is connected to the individual heating elements (302*a*-1, 302*a*-2, and 302*a*-3), and the conductor 301*b*, which is connected to the individual heating elements (302*b*-1, 302*b*-2, and 302*b*-3).

The second conductor 303 extends in the longitudinal direction of the heater 300, and is separated into three conductors 303-1, 303-2, and 303-3.

Electrodes E1, E2, E3, E4-1, and E4-2 are each connected to an electrical contact for supplying power from the control circuit 400 for the heater 300, described below. The electrode E1 is an electrode for feeding electric power to the heating block 302-1 via the conductor 303-1. The electrode E2 is an electrode used to feed electric power to the heating block 302-2 via the conductor 303-2. The electrode E3 is an electrode for feeding electric power to the heating block 302-3 via the conductor 303-3. The electrodes E4-1 and E4-2 are electrodes connected to a common electrical contact to feed electric power to the three heating blocks 302-1 to 302-3 via the conductor 301*a* and the conductor 301*b*.

Since the resistance of the individual conductors is not zero, the conductors affect the heat generation distribution in the longitudinal direction of the heater 300. Accordingly, the electrodes E4-1 and E4-2 are disposed at opposite ends of the heater 300 in the longitudinal direction of the heater 300 so that a heat generation distribution that is symmetrical in the longitudinal direction of the heater 300 can be obtained even when affected by the electrical resistance of the conductors 303-1, 303-2, 303-3, 301*a*, and 301*b*.

Further, the surface protective layer 307 on the second layer of the back surface of the heater 300 is formed to have openings at positions corresponding to the electrodes E1, E2, E3, E4-1, and E4-2, so that each of the electrodes E1, E2, E3, E4-1, and E4-2 can be connected to the corresponding one of the electrical contacts from the back surface side of the heater 300. In this exemplary embodiment, the electrodes E1, E2, E3, E4-1, and E4-2 are disposed on the back surface of the heater 300 to enable power supply from the back surface side of the heater 300. In addition, the ratio of the power to be supplied to at least one heating block among a plurality of heating blocks to the power to be supplied to the other heating blocks is made variable. Electrodes disposed on the back surface of the heater 300 do not require wiring of a conductive pattern on the substrate 305, resulting in a reduction in the width of the substrate 305 in its transverse direction. This advantageously reduces the cost of the material of the substrate 305, and reduces the warm-up time taken for the heater 300 increase its temperature due to the reduced heat capacity of the substrate 305. The electrodes E1, E2, and E3 are disposed in an area where heating elements are disposed in the longitudinal direction of the substrate 305. Further, the surface protective layer 308 on the first layer of the sliding surface of the heater 300 is disposed in an area that is slidably engaged with the film 202.

As illustrated in FIG. 3C, the holding member 201 of the heater 300 has holes HTH1 to HTH4, H212, HE1, HE2, HE3, HE4-1, and HE4-2 for the thermistors (temperature sensing elements) TH1 to TH4, the safety element 212, and the electrical contacts of the electrodes E1, E2, E3, E4-1, and E4-2, respectively.

The thermistors (temperature sensing elements) TH1 to TH4, the safety element 212, and the electrical contacts that come into contact with the electrodes E1, E2, E3, E4-1, and E4-2, described above, are disposed between the stay 204 and the holding member 201. The electrical contacts are represented by C1, C2, C3, C4-1, and C4-2. In FIG. 3C, broken lines connected to the electrical contacts C1 to C3, C4-1, and C4-2 and broken lines connected to the safety element 212 indicate power feed cables (AC lines). Further, broken lines connected to the temperature sensing elements TH1 to TH4 indicate signal lines (DC lines). The individual elements and electrical contacts are arranged so as to face the back surface of the heater 300. The electrical contacts C1, C2, C3, C4-1, and C4-2 that come into contact with the electrodes E1, E2, E3, E4-1, and E4-2 are electrically connected to electrode units of the heater 300 by being urged by a spring, welding, or any other suitable method. The electrical contacts C1, C2, C3, C4-1, and C4-2 are connected to the control circuit 400 for the heater 300, described below, via the cables (indicated by the broken lines described above) disposed between the stay 204 and the holding member 201 or via a conductive material such as a thin metal plate.

Power to the heater 300 is controlled in accordance with the output of the thermistor TH1 disposed near the center of a media passage portion (i.e., near a conveyance reference position X described below). The thermistor TH4 detects the temperature at an end of a heating area of the heating block 302-2 (i.e., the temperature at the end of the heating area in a state illustrated in FIG. 6B). The thermistor TH2 detects the temperature at an end of a heating area of the heating block 302-1 (i.e., the temperature at the end of the heating area in a state illustrated in FIG. 6A). The thermistor TH3 detects the temperature at an end of a heating area of the heating block 302-3 (i.e., the temperature at the end of the heating area in the state illustrated in FIG. 6A).

In the image heating apparatus 200 according to this exemplary embodiment, one or more thermistors are provided for each of the three heating blocks 302-1 to 302-3 to sense the state of power supply to only the single heating blocks due to failure or the like, in order to increase the safety of the image heating apparatus 200. To take into account only failure of a triac 416 and a triac 426, one or more thermistors may be provided for at least each of a plurality of independently controllable heating blocks (for example, in FIG. 3C, only the thermistors TH1 and TH2 may be used). In this exemplary embodiment, one or more thermistors are provided for each of the three heating blocks 302-1 to 302-3 to take into account, in addition to failure of the triac 416 and the triac 426, a defect of electrical contacts to individual electrodes. For example, if the connection of the electrical contact C1 to the electrode E1 is defective, no power is supplied to the heating block 302-1, whereas power may be supplied to the heating block 302-3. To suppress this inconvenience, the thermistors TH2 and TH3 are provided for the heating block 302-1 and the heating block 302-3, respectively.

The safety element 212 is disposed in contact with a portion corresponding to an available minimum size media passage area set in the laser printer 100 (i.e., a portion near the center of the heating block 302-2), which is less affected by the overheating in the no-media passage portion, in order to prevent a malfunction caused by the overheating in the no-media passage portion. Accordingly, the temperature of the safety element 212 is low during the normal operation, and thus the operating temperature of the safety element 212 can be set low, providing an increase in the safety of the image heating apparatus 200.

Figure 6A:
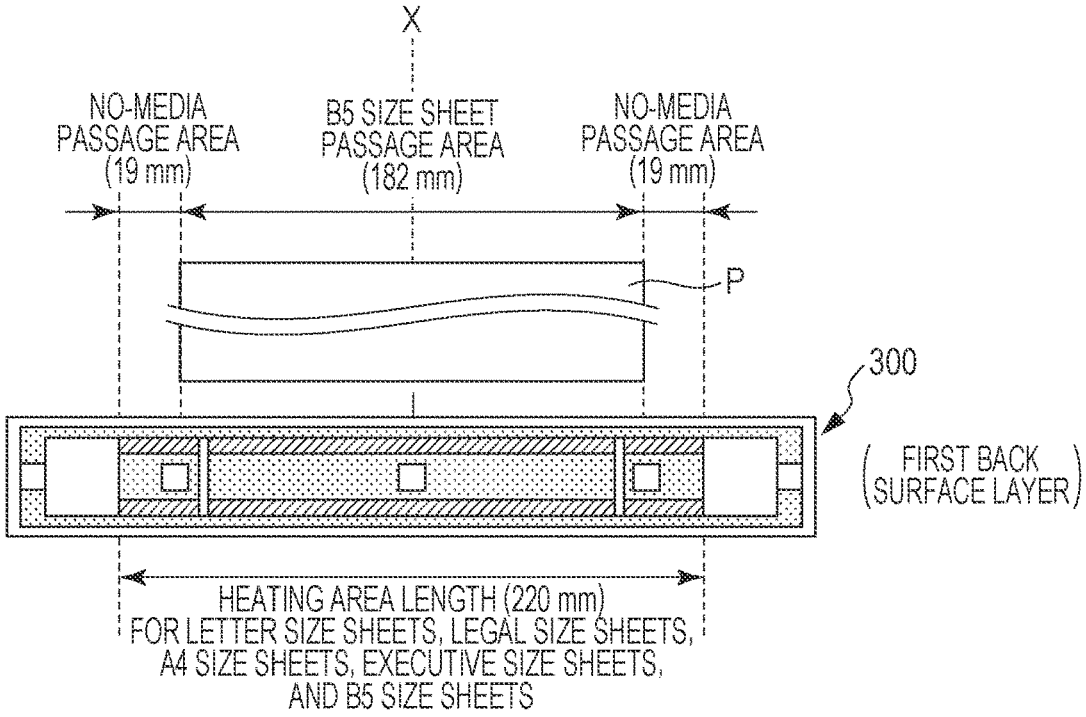
FIG. 6A is a diagram depicting the effect of reducing the overheating in a no-media passage portion of the heater according to the first exemplary embodiment.

Next, the effect of reducing the overheating in the no-media passage portion of the heater 300 will be described with reference to FIGS. 6A and 6B. FIG. 6A is a diagram depicting overheating in a no-media passage portion in a case where power is supplied to all the three heating blocks 302-1 to 302-3. In the illustration, by way of example, a B5 size sheet is conveyed vertically with respect to the center portion of the heating area. A reference position for conveying the recording material P is defined as a conveyance reference position X of the recording material P.

The sheet feed cassette 11 has a position regulating plate for regulating the position of the recording material P, and is set in a predetermined position in accordance with each size of the recording material P loaded in the sheet feed cassette 11, from which a recording material P is fed and conveyed so that the recording material P travels through a predetermined position in the image heating apparatus 200. The feed tray 28 also has a position regulating plate for regulating the position of the recording material P, from which a recording material P is conveyed so that the recording material P travels through the predetermined position in the image heating apparatus 200.

The heater 300 has a heating area length of 220 mm for a sheet width of approximately 216 mm in order to support the vertical conveyance of a letter size sheet. In a case where a B5 size sheet having a sheet width of 182 mm is vertically conveyed in the heater 300 that has a heating area length of 220 mm, 19-mm no-media passage areas are produced in opposite end portions of the heating area. While power supply to the heater 300 is controlled so that the sensing temperature of the thermistor TH1 located near the center of the media passage portion is maintained at a target temperature, the temperature of the no-media passage portions increases compared to the media passage portion since the heat is not absorbed by the sheet in the no-media passage portions. As illustrated in FIG. 6A, in the case of a B5 size sheet, the ends of the recording material P pass through portions of the heating block 302-1 and 302-3 located in the opposite end portions, resulting in no-media passage portions each having a length of 19 mm being produced in the opposite end portions. Since the heating element 302 is a PTC element, the resistance of the heating elements in the no-media passage portions becomes higher than that of the heating elements in the media passage portion, which impedes the flow of current. On the basis of this principle, overheating in the no-media passage portions may be suppressed or reduced.

Figure 6B:
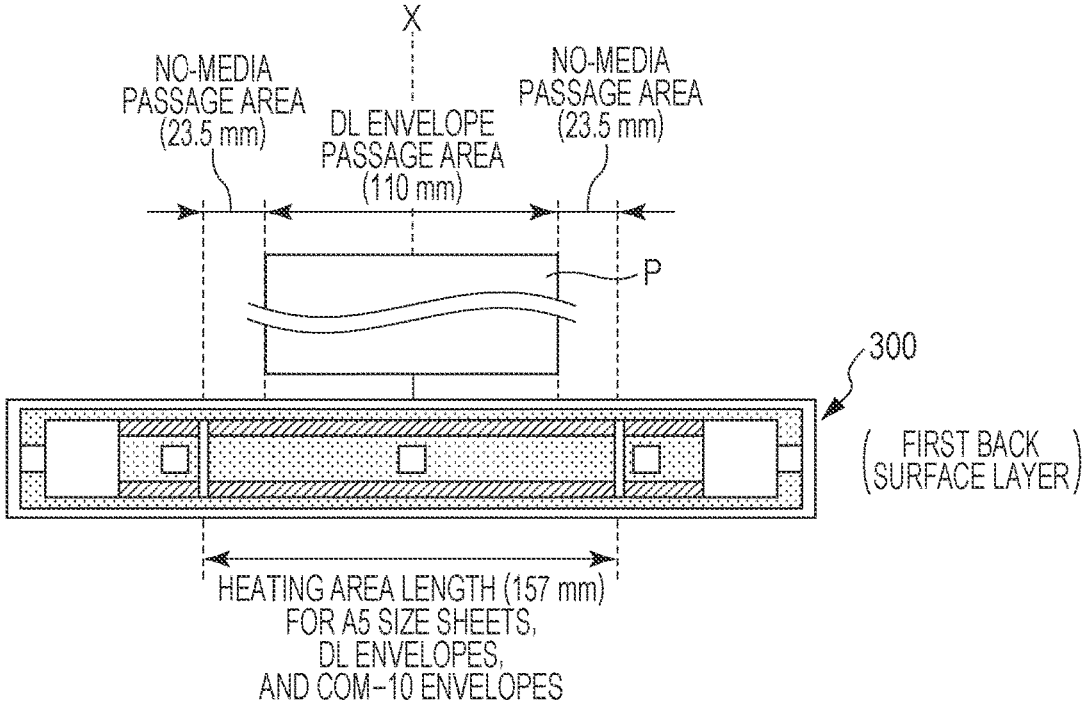
FIG. 6B is a diagram depicting the effect of reducing the overheating in a no-media passage portion of the heater according to the first exemplary embodiment.

FIG. 6B is a diagram depicting overheating in a no-media passage portion in a case where power is supplied to only the heating block 302-2 located in the center portion of the heater 300. In the illustration, byway of example, a DL size envelope having a width of 110 mm is conveyed vertically with respect to the center portion of the heating area. The heating block 302-2 of the heater 300 has a heating area length of 157 mm for sheets having a width of 148 mm in order to support the vertical conveyance of an A5 size sheet. In a case where a DL size envelope having a width of 110 mm is vertically conveyed in the heater 300 in which the heating block 302-2 located in the center has a length of 157 mm, 23.5-mm no-media passage areas are produced in opposite end portions of the center heating block 302-2. The heater 300 is controlled based on the output of the thermistor TH1 located near the center of the media passage portion, and the temperature of the no-media passage portions increases compared to the media passage portion since the heat is not absorbed by the sheet in the no-media passage portions. In the state illustrated in FIG. 6B, power is initially supplied to only the heating block 302-2 to reduce the influence of the no-media passage areas. In general, the longer the no-media passage area, the higher the overheating in the no-media passage portions. Thus, only the effect of feeding electric power to the heating element 302, which is a PTC element, in the conveyance direction would not sufficiently reduce the overheating in the no-media passage portion. Accordingly, as illustrated in FIG. 6B, it is effective to reduce the length of the no-media passage areas as much as possible. In addition, overheating in the 23.5-mm no-media passage areas in the opposite end portions of the center heating block 302-2 may be suppressed or reduced on the basis of the principle similar to that described with reference to FIG. 6A.

As illustrated in FIG. 6B, the effect of reducing the overheating in a no-media passage portion in a case where power is supplied to only the heating block 302-2 located in the center portion of the heater 300 can also be obtained in a case where the heating element 302 is not a PTC element. Accordingly, this exemplary embodiment is not limited to the case where a PTC element is used as the heating element 302. In addition, the configuration according to this exemplary embodiment is also applicable to the case where the heating element 302 has a zero temperature coefficient of resistance or has a negative temperature coefficient of resistance (NTC).

Figure 4:
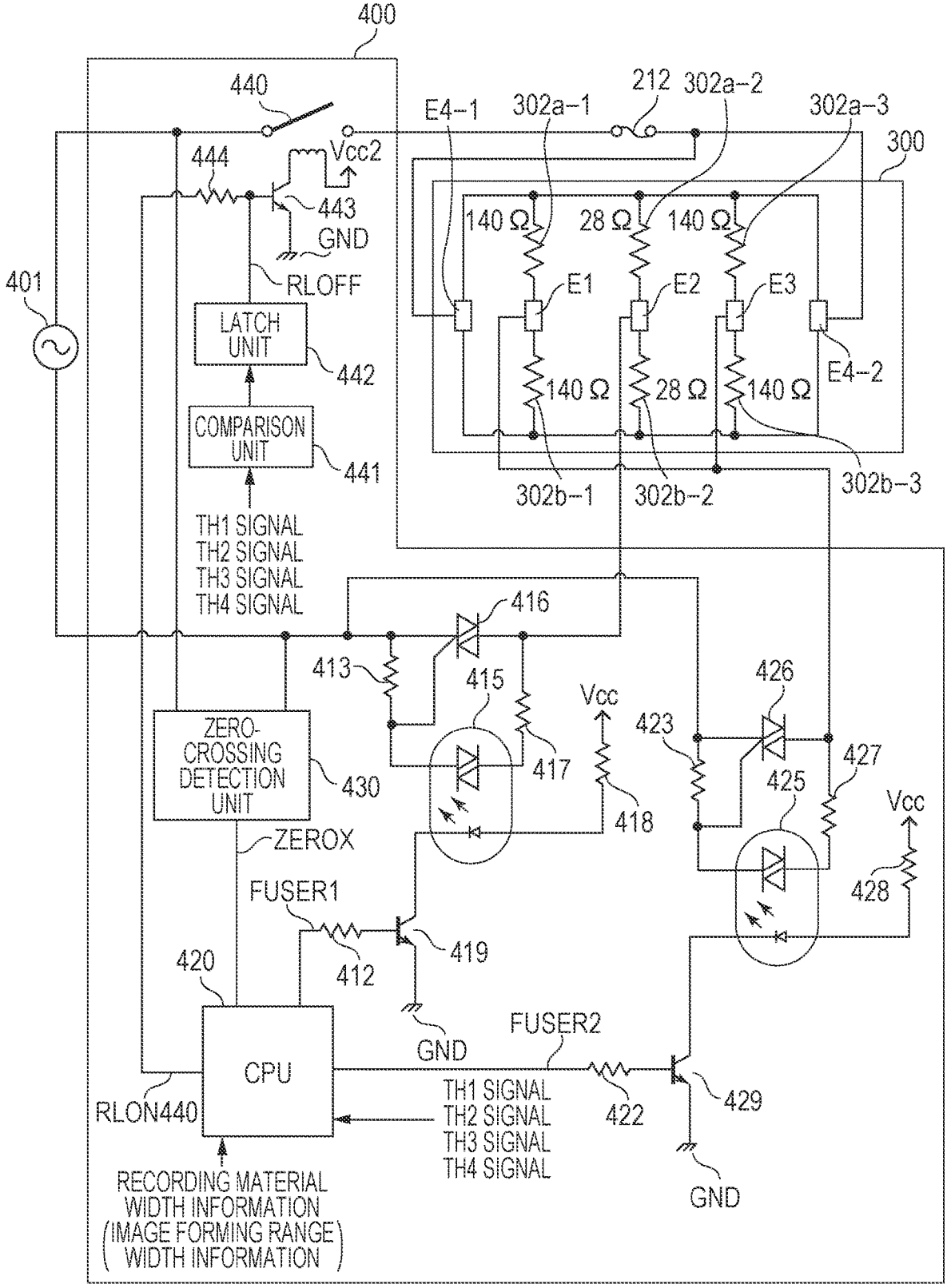
FIG. 4 is a circuit diagram of a control circuit for the heater according to the first exemplary embodiment.

FIG. 4 is a circuit diagram of the control circuit 400 for the heater 300 according to the first exemplary embodiment. The commercial AC power supply 401 is connected to the laser printer 100. Power to the heater 300 is controlled by conducting or non-conducting of the triac 416 and the triac 426. The triac 416 and the triac 426 are controlled to make the heating blocks 302-1 and 302-3 and the heating block 302-2 controllable independently from each other. Power is supplied to the heater 300 via the electrodes E1 to E3, E4-1, and E4-2. In this exemplary embodiment, by way of example, the heating elements 302*a*-1 and 302*b*-1 have a resistance of 140 ohms, the heating elements 302*a*-2 and 302*b*-2 have a resistance of 28 ohms, and the heating elements 302*a*-3 and 302*b*-3 have a resistance of 140 ohms.

A zero-crossing detection unit 430 is a circuit for detecting the zero crossing of the AC power supply 401, and outputs a ZEROX signal to a central processing unit (CPU) 420. The ZEROX signal is used to control the heater 300. A relay 440 is used as a power shutoff unit for interrupting the supply of power to the heater 300. The relay 440 is activated in accordance with the output from the thermistors TH1 to TH4 (to shut off power supply to the heater 300) in response to an excessive rise in the temperature of the heater 300 due to failure or the like.

When an RLON440 signal is high, a transistor 443 is turned on, causing the secondary coil of the relay 440 to conduct current from a power supply voltage Vcc2 to turn on the primary contact of the relay 440. When the RLON440 signal is Low, the transistor 443 is turned off, blocking the current flow to the secondary coil of the relay 440 from the power supply voltage Vcc2 to turn off the primary contact of the relay 440.

Next, the operation of a safety circuit that includes the relay 440 will be described. If one of the sensing temperatures obtained by the thermistors TH1 to TH4 exceeds a corresponding one of predetermined values that are individually set, a comparison unit 441 activates a latch unit 442, and the latch unit 442 latches an RLOFF signal at a low level. When the RLOFF signal is low, the transistor 443 is maintained in an off condition even if the CPU 420 sets the RLON440 signal high. Thus, the relay 440 is maintained in an off condition (or safe condition).

If none of the sensing temperatures obtained by the thermistors TH1 to TH4 exceeds the predetermined values that are individually set, the RLOFF signal of the latch unit 442 becomes open. Thus, the CPU 420 sets the RLON440 signal high, thereby turning on the relay 440 to enable power supply to the heater 300.

Next, the operation of the triac 416 will be described. Resistors 413 and 417 are bias resistors for the triac 416, and a phototriac coupler 415 is a device for ensuring a primary-secondary creepage distance. A light-emitting diode of the phototriac coupler 415 is caused to conduct current to turn on the triac 416. A resistor 418 is a resistor for limiting the current flow through the light-emitting diode of the phototriac coupler 415 from the power supply voltage Vcc, and the phototriac coupler 415 is turned on or off by a transistor 419. The transistor 419 operates in accordance with a FUSER1 signal from the CPU 420.

When the triac 416 is in its conducting state, power is supplied to the heating elements 302*a*-2 and 302*b*-2, and power is supplied to a resistor with a combined resistance of 14 ohms. Power control with the triac 416 and the triac 426 in a conduction ratio of 1:0 provides the state illustrated in FIG. 6B when only the heating elements 302*a*-2 and 302*b*-2 are supplied with power.

The circuit operation of the triac 426 is substantially the same as that of the triac 416, and is not described herein. The triac 426 operates in accordance with a FUSER2 signal from the CPU 420. When the triac 426 is in its conducting state, power is supplied to the heating elements 302*a*-1, 302*b*-1, 302*a*-3, and 302*b*-3. Since the four heating elements 302*a*-1, 302*b*-1, 302*a*-3, and 302*b*-3 are connected in parallel, power is supplied to a resistor with a combined resistance of 35 ohms.

In the state illustrated in FIG. 6A, power is supplied using the triac 416 and the triac 426. When the triac 416 and the triac 426 are in their conducting state, power is supplied to the heating elements 302*a*-1, 302*b*-1, 302*a*-2, 302*b*-2, 302*a*-3, and 302*b*-3. Since the six heating elements 302*a*-1, 302*b*-1, 302*a*-2, 302*b*-2, 302*a*-3, and 302*b*-3 are connected in parallel, power is supplied to a resistor with a combined resistance of 10 ohms. Power control with the triac 416 and the triac 426 in a conduction ratio of 1:1 provides the state illustrated in FIG. 6A.

The total resistance of the heater 300 is generally designed so as to support the power required for recording materials P having the maximum width available (in this exemplary embodiment, letter size sheets and legal size sheets). In the configuration according to this exemplary embodiment, a total resistance of 14 ohms is obtained in the state illustrated in FIG. 6B, which is higher than a total resistance of 10 ohms which is obtained in the state illustrated in FIG. 6A, and is more advantageous in terms of harmonic standards, flicker, and safety protection for the heater 300 (in general, the lower the resistance, the worse the problem). For example, it is assumed that the resistance of a heater including three heating blocks (302-1, 302-2, and 302-3) which are connected in series is adjusted to 10 ohms. In this configuration, if power is supplied to only the heating block 302-2 in the center portion of the heater, the total resistance of the heater decreases, which is disadvantageous in terms of harmonic standards, flicker, and safety protection for the heater 300. In the configuration according to this exemplary embodiment, a plurality of heating blocks (in this exemplary embodiment, three heating blocks) that are separate in the longitudinal direction of the heater 300 are connected in parallel, which is advantageous in reducing harmonics, flicker, and the like.

Next, a method for controlling the temperature of the heater 300 will be described. The temperature sensed by the thermistor TH1 is sensed as a divided voltage of a resistor (not illustrated), and is supplied to the CPU 420 as a TH1 signal (the temperatures sensed by the thermistors TH2 to TH4 are also sensed and supplied to the CPU 420 using a similar way). In the internal processing of the CPU (control unit) 420, the power to be supplied is calculated based on the sensing temperature of the thermistor TH1 and the set temperature of the heater 300 in accordance with, for example, proportion-integral (PI) control. The power to be supplied is further converted into a control level of a phase angle (phase control) or a wave number (wave-number control) corresponding to the power to be supplied, and the triac 416 and the triac 426 are controlled in accordance with this control condition. In this exemplary embodiment, the heater temperature sensed by the thermistor TH1 is used for temperature control of the heater 300. The temperature of the film 202 may also be sensed by a thermistor or a thermopile, and the sensed temperature may be used for temperature control of the heater 300.

Figure 5:
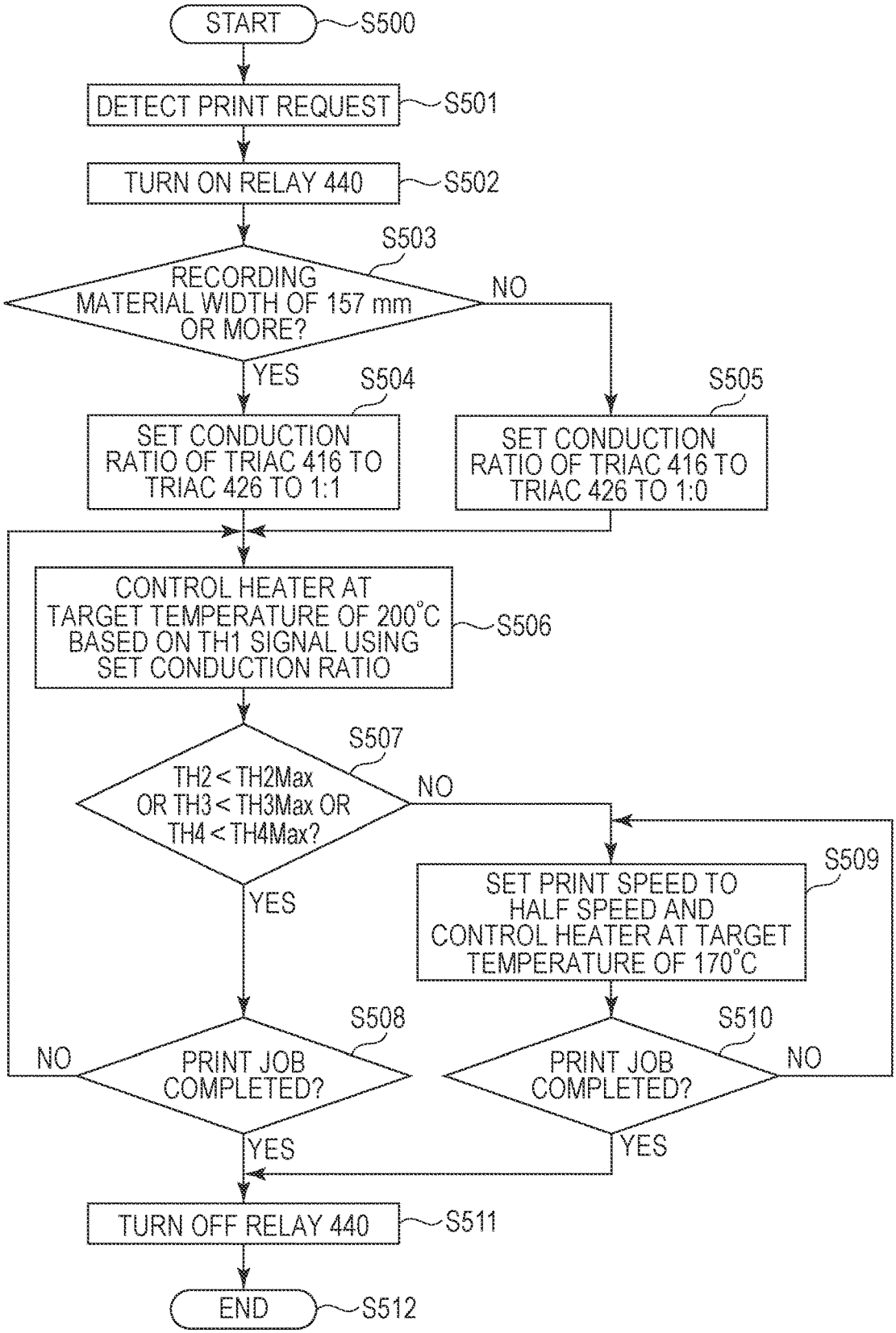
FIG. 5 is a flowchart of a heater control process according to the first exemplary embodiment.

FIG. 5 is a flowchart depicting the control sequence for the image heating apparatus 200, which is performed by the CPU 420. In response to the occurrence of a print request in S501, in S502, the relay 440 is turned on. Then, in S503, it is determined whether or not the recording material has a width greater than or equal to 157 mm. In the laser printer 100 according to this exemplary embodiment, the process proceeds to S504 if the recording material is a letter size sheet, a legal size sheet, an A4 size sheet, an executive size sheet, a B5 size sheet, or a non-standard size medium having a width greater than or equal to 157 mm which is fed from the feed tray 28. Then, the conduction ratio of the triac 416 to the triac 426 is set to 1:1 (the state illustrated in FIG. 6A.

If the recording material has a width less than 157 mm (in this exemplary embodiment, an A5 size sheet, a DL envelope, a COM-10 envelope, or a non-standard size medium having a width less than 157 mm), the process proceeds to S505. Then, the conduction ratio of the triac 416 to the triac 426 is set to 1:0 (the state illustrated in FIG. 6B).

The determination of the width of the recording material in S503 may be based on any method, for example, using sheet-width sensors provided for the sheet feed cassette 11 and the feed tray 28, or using a sensor such as a flag provided on the path along which the recording material P is conveyed. Other methods available are based on width information on the recording material P which is set by a user, image information for forming an image on the recording material P, or the like.

In S506, the process speed for forming an image is set to full speed by using the set conduction ratio, and a fixing process is performed at a target temperature of 200 degrees Celsius which is set for the thermistor TH1.

In S507, it is determined whether a maximum temperature TH2Max of the thermistor TH2, a maximum temperature TH3Max of the thermistor TH3, and a maximum temperature TH4Max of the thermistor TH4, which are set in the CPU 420, are not exceeded. If it is detected that the temperature at an end of the heating area exceeds the corresponding one of the predetermined upper limit values on the basis of the thermistor signals TH2 to TH4 due to the deterioration of the overheating in a no-media passage portion, the process proceeds to S509. In S509, the process speed for forming an image is set to half speed, and a fixing process is performed at a target temperature of 170 degrees Celsius which is set for the thermistor TH1. The processing of S509 is iterated to continue the fixing process until the completion of the print job is sensed in S510. Setting the process speed for forming an image to half speed achieves fixability at a lower temperature than that for full speed. Thus, the target temperature for fixing operation can be reduced, and the temperature at the no-media passage portions can be reduced. If it is determined in S507 that none of the temperatures of the respective thermistors exceeds the associated maximum temperature, the process proceeds to S508. Until the print job is completed in S508, the processing from S506 is iterated to continue the fixing process.

The process described above is repeatedly performed. If the completion of the print job is detected in S508 or S510, then, in S511, the relay 440 is turned off. In S512, the control sequence of image formation ends.

In the control according to this exemplary embodiment, the conduction ratio of the triac 416 to the triac 426 is set based on width information on the recording material P to control a heat generation distribution in the longitudinal direction of the heater 300. Other methods are also available, examples of which include controlling a heat generation distribution in the longitudinal direction of the heater 300 on the basis of the temperatures sensed by the individual thermistors associated with the respective heating blocks. In a specific example, power to the heating block 302-2 may be controlled based on the temperature sensed by the thermistor TH1, by using the triac 416 in accordance with PI control or the like. Alternatively, power to the heating block 302-1 and the heating block 302-3 may be controlled based on the temperature sensed by the thermistor TH2 or the thermistor TH3, by using the triac 426 in accordance with PI control or the like. An optimum control method may be used in accordance with the configuration of the image heating apparatus 200 (such as the number of heating blocks of the heater 300 and the positions of the thermistors) and the specification of the image forming apparatus 100 (such as a type of recording material that the image forming apparatus 100 supports).

As described above, the use of the heater 300 and the image heating apparatus 200 according to the first exemplary embodiment may suppress or reduce the overheating in a no-media passage portion in a case where a sheet having a smaller size than the maximum size that the image forming apparatus 100 supports is to be printed. In addition, the symmetry of the heat generation distribution in the transverse direction of the heater 300 may be improved to reduce the thermal stress of the substrate 305. In addition, the symmetry of the heat generation distribution in the longitudinal direction of the heater 300 may be improved to reduce the non-uniformity in the heat generation distribution in the longitudinal direction of the heater 300. In the heater 300 according to this exemplary embodiment, furthermore, electrodes disposed on the back surface of the heater 300 do not require wiring of a conductive pattern on the substrate 305. Accordingly, the number of heating blocks in the longitudinal direction of the heater 300, the number of electrodes, and the number of triacs for controlling the heat generation distribution in the longitudinal direction of the heater 300 may be increased without an increase in the width of the heater 300 in its transverse direction. In addition, the number of ways in which the heat generation distribution in the longitudinal direction of the heater is switchable may be increased to obtain a heat generation distribution in the longitudinal direction of the heater that is optimized for a larger number of widths of recording materials P. Thus, the heater 300 may reduce the width of the substrate 305 in its transverse direction, and, advantageously, reduce the cost of the material of the substrate 305 and reduce the warm-up time of the image heating apparatus 200 due to the reduction in the heat capacity of the substrate 305. Moreover, one or more thermistors provided for each of a plurality of heating blocks may increase safety while the image heating apparatus 200 is in a failure state.

Second Exemplary Embodiment

Figure 7A:
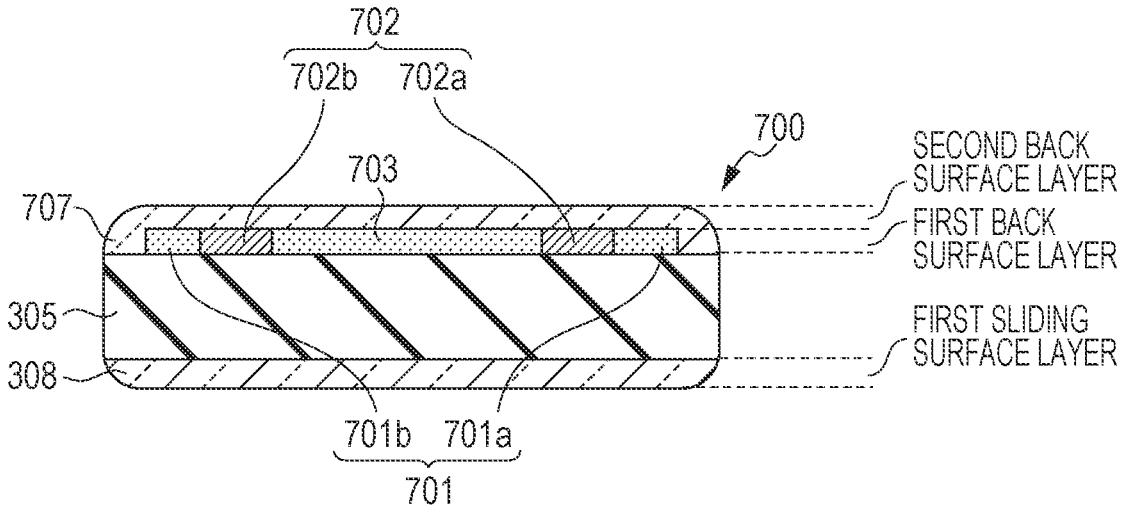
FIG. 7A is a configuration diagram of a heater according to a second exemplary embodiment.
Figure 7B:
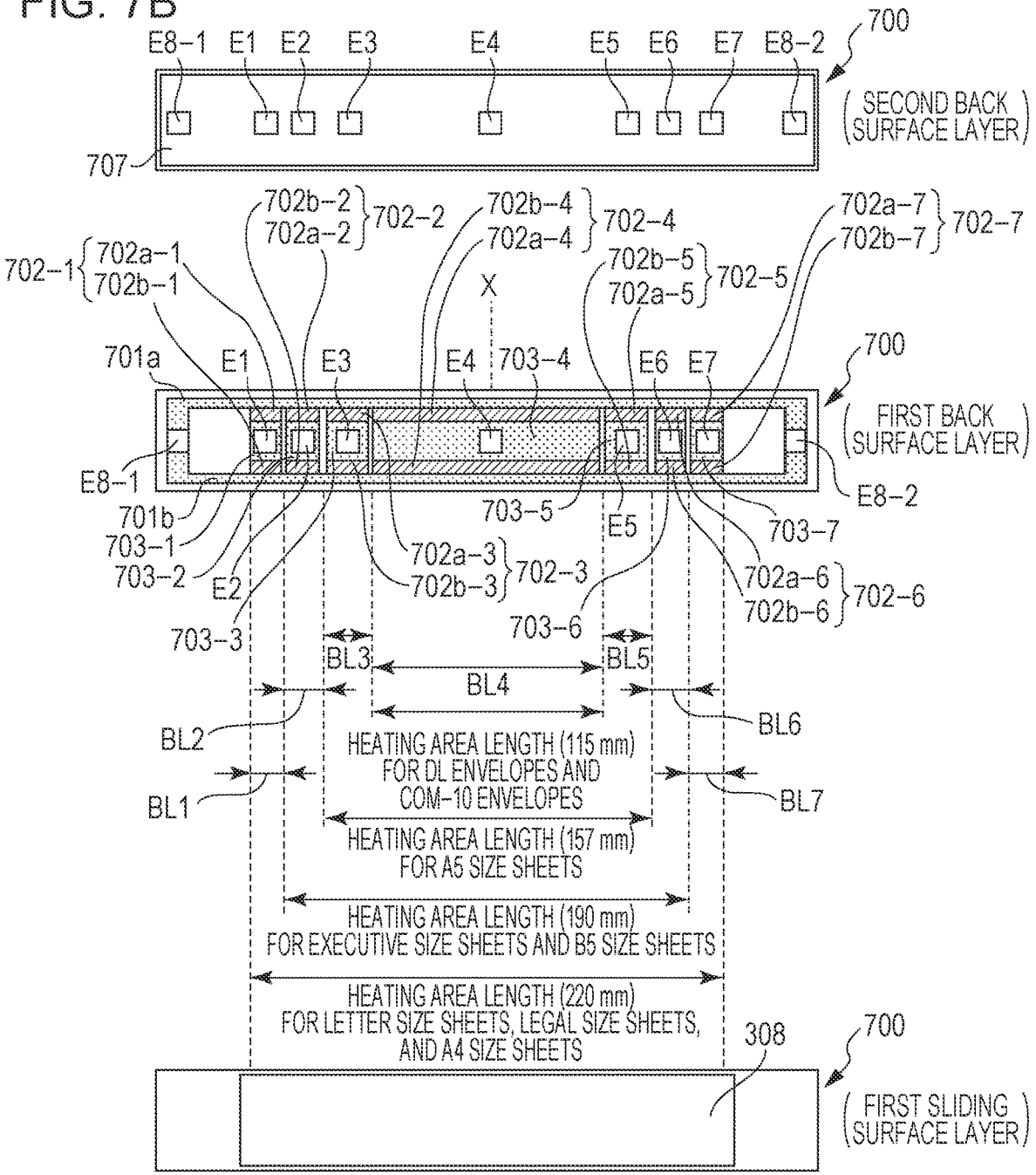
FIG. 7B is a configuration diagram of the heater according to the second exemplary embodiment.
Figure 7C:
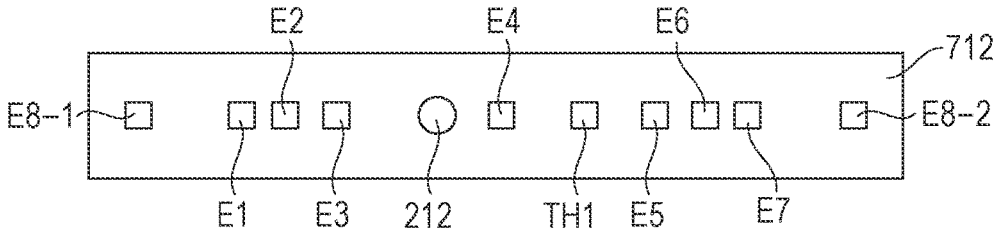
FIG. 7C is a configuration diagram of the heater according to the second exemplary embodiment.

Next, a second exemplary embodiment will be described. In the second exemplary embodiment, the heater 300 described in the first exemplary embodiment, which is incorporated in the image heating apparatus 200 of the laser printer 100, the holding member 201 of the heater 300, and the control circuit 400 for the heater 300 are modified. Components similar to those in the first exemplary embodiment are assigned the same numerals and are not described herein. A heater 700 according to the second exemplary embodiment is configured to switch the heat generation distribution in the longitudinal direction of the heater 700 in four ways. FIGS. 7A to 7C are configuration diagrams of the heater 700 according to the second exemplary embodiment. FIG. 7A is a diagram of a cross section of the heater 700 in its transverse direction.

The heater 700 includes a first conductor 701 disposed on the substrate 305 so as to extend in the longitudinal direction of the heater 700, and a second conductor 703 disposed on the substrate 305 at a different position from the position of the first conductor 701 in the transverse direction of the heater 700 so as to extend in the longitudinal direction of the heater 700. The first conductor 701 is separated into a conductor 701*a* located upstream and a conductor 701*b* located downstream in the conveyance direction of the recording material P.

The heater 700 further includes a heating element 702 disposed between the first conductor 701 and the second conductor 703 for generating heat by power supplied via the first conductor 701 and the second conductor 703. The heating element 702 is separated into a heating element 702*a* located upstream and a heating element 702*b* located downstream in the conveyance direction of the recording material P.

FIG. 7B is a plan view of individual layers of the heater 700. The heater 700 has a plurality of heating blocks on the first layer of the back surface thereof that are arranged in the longitudinal direction of the heater 700, each heating block including the first conductor 701, the second conductor 703, and the heating element 702. By way of example, the heater 700 according to this exemplary embodiment has a total of seven heating blocks 702-1 to 702-7 disposed in the center portion and opposite end portions thereof in the longitudinal direction of the heater 700.

The heating blocks 702-1 to 702-7 include heating elements 702*a*-1 to 702*a*-7 and heating elements 702*b*-1 to 702*b*-7 that are symmetrical in the transverse direction of the heater 700. The first conductor 701 is composed of the conductor 701*a*, which is connected to the individual heating elements (702*a*-1 to 702*a*-7), and the conductor 701*b*, which is connected to the individual heating elements (702*b*-1 to 702*b*-7). Similarly, the second conductor 703 is separated into seven conductors 703-1 to 703-7.

Electrodes E1 to E7, E8-1, and E8-2 are each used to connect to an electrical contact used to supply power from a control circuit 800 for the heater 700, described below. The electrodes E1 to E7 are electrodes for supplying power to the heating blocks 702-1 to 702-7 via the conductors 703-1 to 703-7, respectively. The electrodes E8-1 and E8-2 are electrodes used to connect to a common electrical contact to feed electric power to the seven heating blocks 702-1 to 702-7 via the conductor 701*a* and the conductor 701*b*, respectively.

The heater 700 further includes a surface protective layer 707 on the second layer of the back surface thereof. The surface protective layer 707 is formed to have openings at positions corresponding to the electrodes E1, E2, E3, E4, E5, E6, E7, E8-1, and E8-2, so that the electrodes E1, E2, E3, E4, E5, E6, E7, E8-1, and E8-2 can be connected to the electrical contacts from the back surface side of the heater 700.

In this exemplary embodiment, the electrodes E1, E2, E3, E4, E5, E6, E7, E8-1, and E8-2 are disposed on the back surface of the heater 700 to enable power supply from the back surface side of the heater 700. In addition, the ratio of the power to be supplied to at least one heating block among the heating blocks to the power to be supplied to the other heating blocks is made controllable.

As illustrated in FIG. 7C, a holding member 712 of the heater 700 has holes for a thermistor (temperature sensing element) TH1, and the safety element 212, and the electrical contacts of the electrodes E1, E2, E3, E4, E5, E6, E7, E8-1, and E8-2.

The thermistor (temperature sensing element) TH1, the safety element 212, and the electrical contacts of the electrodes E1, E2, E3, E4, E5, E6, E7, E8-1, and E8-2, described above, are disposed between the stay 204 and the holding member 712, and are disposed in contact with the back surface of the heater 700. The configuration of the electrical contacts that come into contact with the electrodes E1, E2, E3, E4, E5, E6, E7, E8-1, and E8-2 is substantially the same as that in the first exemplary embodiment, and is not described herein.

Figure 8:
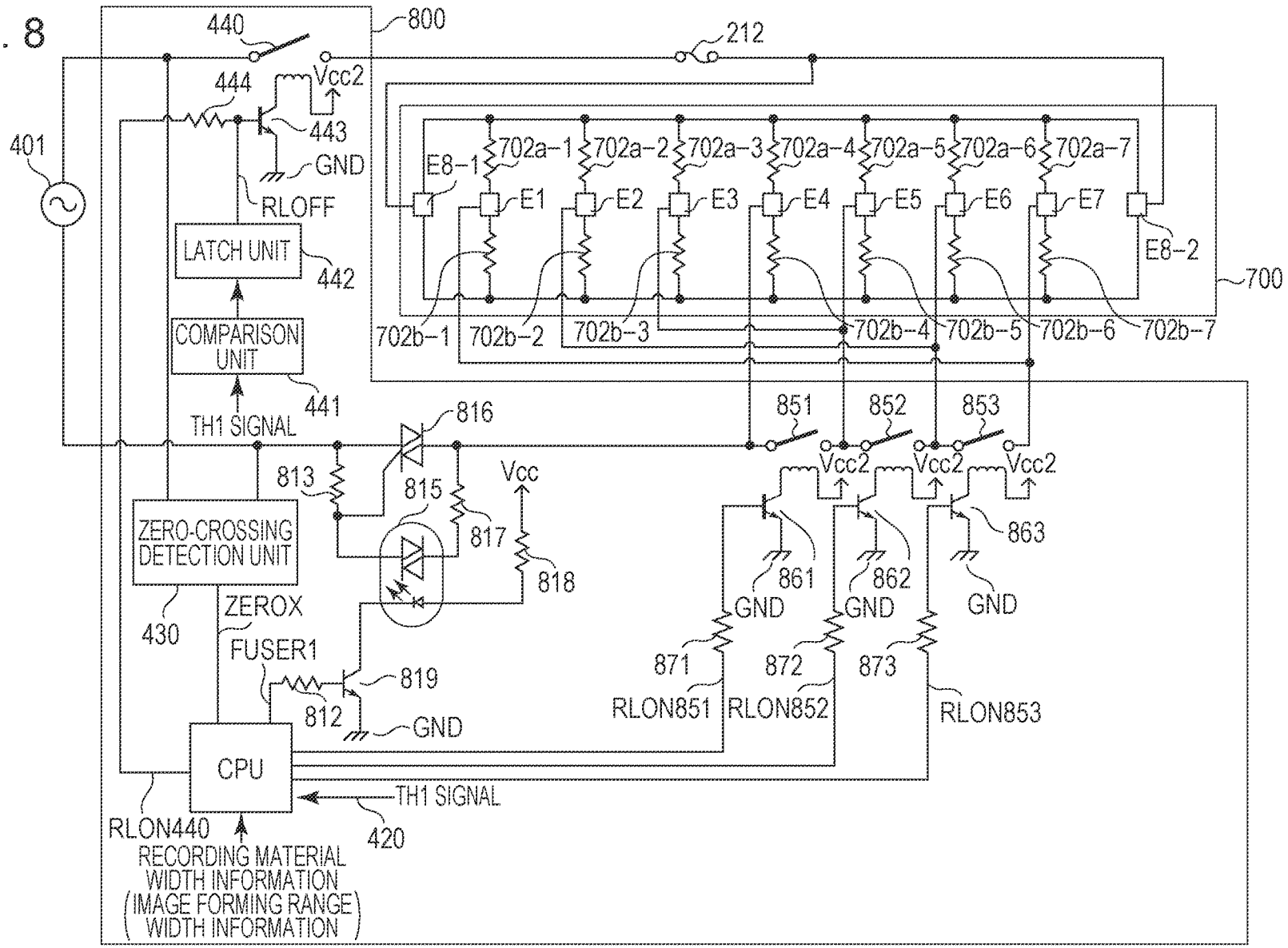
FIG. 8 is a circuit diagram of a control circuit for the heater according to the second exemplary embodiment.

FIG. 8 is a circuit diagram of the control circuit 800 for the heater 700 according to the second exemplary embodiment. In FIG. 4, which illustrates the first exemplary embodiment, two triacs are used to control power and control the heat generation distribution in the longitudinal direction of the heater 300. In the second exemplary embodiment, a single triac is used to control power, and three relays 851 to 853 are used to control the heat generation distribution in the longitudinal direction of the heater 700. In this exemplary embodiment, the relays 851 to 853 are controlled to select a heating block to which power is to be supplied from among a plurality of heating blocks. The plurality of heating blocks include a heating block to which power is to be supplied and a heating block to which no power is to be supplied, and are thus referred to as independently controllable heating blocks.

The relays 851 to 853 operate in accordance with an RLON851 signal, an RLON852 signal, and an RLON853 signal (hereinafter referred to as the "RLON851 to RLON853 signals") from the CPU 420, respectively. When the RLON851 to RLON853 signals are high, transistors 861 to 863 are turned on, causing the secondary coils of the relays 851 to 853 to conduct current from the power supply voltage Vcc2 to turn on the primary contacts of the relays 851 to 853. When the RLON851 to RLON853 signals are low, the transistors 861 to 863 are turned off, blocking the current flow to the secondary coils of the relays 851 to 853 from the power supply voltage Vcc2 to turn off the primary contacts of the relays 851 to 853.

Next, the relationship between the state of the relays 851 to 853 and the heat generation distribution in the longitudinal direction of the heater 700 will be described. When all of the relays 851 to 853 are in an off state, the heating block 702-4 is supplied with power. As illustrated in FIG. 7B, a portion of the heater 700 having a width of 115 mm generates heat, yielding a heat generation distribution for DL envelopes and COM-10 envelopes. When the relay 851 is in an on state and the relays 852 and 853 are in an off state, the heating blocks 702-3 to 702-5 are supplied with power. As illustrated in FIG. 7B, a portion of the heater 700 having a width of 157 mm generates heat, yielding a heat generation distribution for A5 size sheets. When the relays 851 and 852 are in an on state and the relay 853 is in an off state, the heating blocks 702-2 to 702-6 are supplied with power. As illustrated in FIG. 7B, a portion of the heater 700 having a width of 190 mm generates heat, yielding a heat generation distribution for executive size sheets and B5 size sheets. When all the relays 851 to 853 are in an on state, the heating blocks 702-1 to 702-7 are supplied with power. As illustrated in FIG. 7B, a portion of the heater 700 having a width of 220 mm generates heat, yielding a heat generation distribution for letter size sheets, legal size sheets, and A4 size sheets. In the way described above, using the three relays 851 to 853, the control circuit 800 according to this exemplary embodiment can control the heat generation distribution in the longitudinal direction of the heater 700 in four ways.

Power to the heater 700 is controlled by conducting or non-conducting of a triac 816. The circuit operation of the triac 816 is substantially the same as that of the triac 416 described in the first exemplary embodiment, and is not described herein. The triac 816 is provided on a common conducting path for the current flowing through all the heating blocks 702-1 to 702-7. Accordingly, in any of the above-described four ways of controlling the heat generation distribution of the heater 700, the power to be supplied to the heater 700 may be controlled by the conducting or non-conducting of the triac 816.

Next, a method for controlling the temperature of the heater 700 will be described. The temperature sensed by the thermistor TH1 is sensed as a divided voltage of a resistor (not illustrated), and is supplied to the CPU 420 as a TH1 signal. In the internal processing of the CPU (control unit) 420, the power to be supplied is calculated based on the sensing temperature of the thermistor TH1 and the set temperature of the heater 700 in accordance with, for example, PI control. The power to be supplied is further converted into a control level of a phase angle (phase control) or a wave number (wave-number control) corresponding to the power to be supplied, and the triac 816 is controlled in accordance with the control condition.

In addition, since a temperature sensing element is provided for the heating block 702-4 connected to a power supply without the intervention of the relays 851 to 853, the temperature of the heater 700 may be sensed regardless of the operating condition of the relays 851 to 853. Similarly to the first exemplary embodiment, control may be based on a film temperature rather than a heater temperature.

In the configuration described in the second exemplary embodiment, power supply to only the heating blocks 702-1 to 702-3 and 702-5 to 702-7 located in the opposite end portions of the heater 700 may be prevented regardless of the operating condition (assuming the short-circuit failure and open-circuit failure states) of the relays 851 to 853. When the heating blocks 702-1 to 702-3 and 702-5 to 702-7 located in the opposite end portions of the heater 700 may be supplied with power, the heating block 702-2 located in the center portion of the heater 700 is also supplied with power regardless of the operating condition of the relays 851 to 853. To this end, in this exemplary embodiment, the thermistor TH1 and the safety element 212 are disposed in contact with a position corresponding to the heating block 702-4, resulting in a safety circuit (a safety circuit of the relay 440 or the safety element 212) functioning regardless of the operating condition of the relays 851 to 853.

Figure 9:
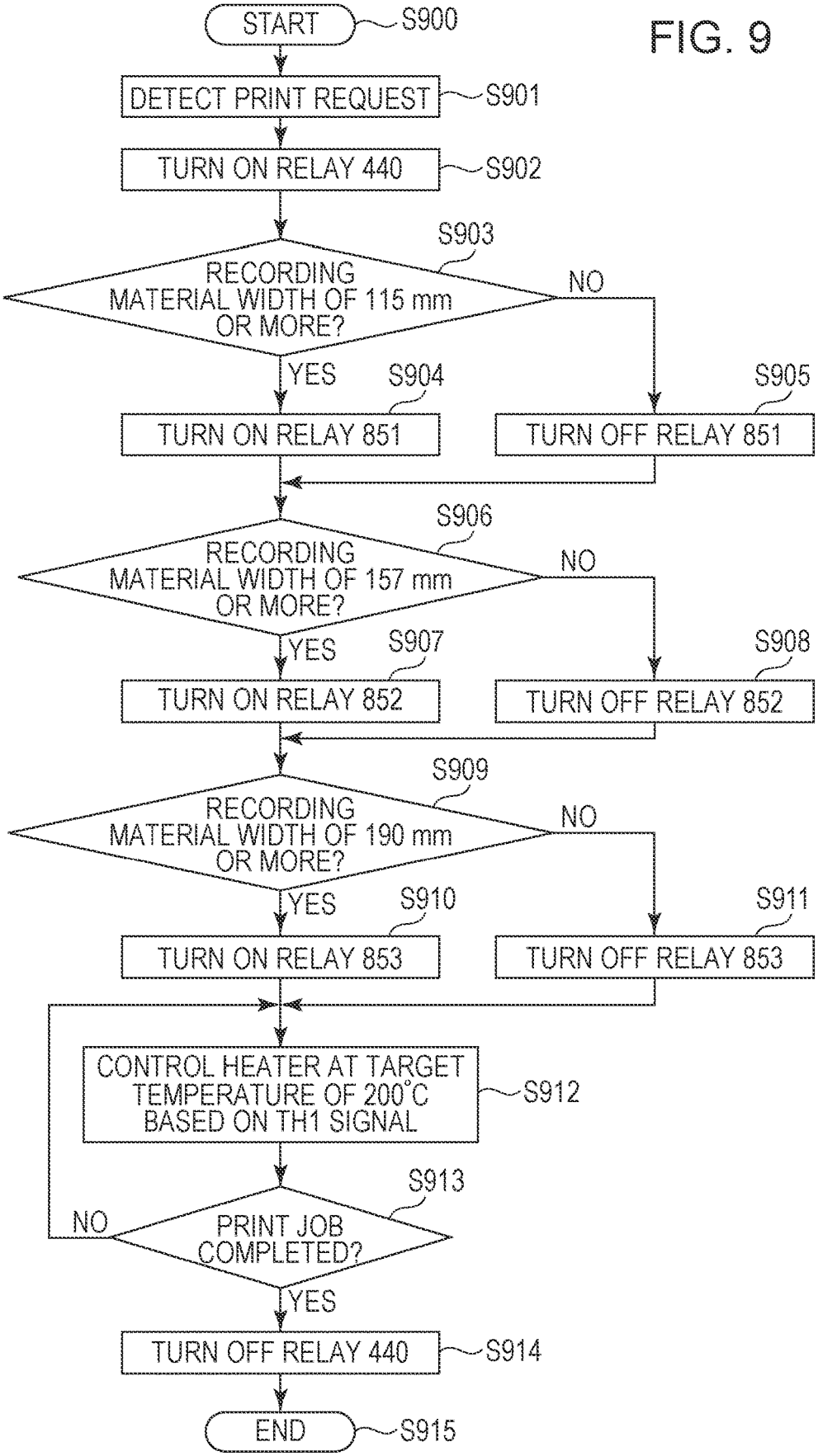
FIG. 9 is a flowchart of a heater control process according to the second exemplary embodiment.

FIG. 9 is a flowchart depicting the control sequence for the image heating apparatus 200, which is performed by the CPU 420. In response to the occurrence of a print request in S901, in S902, the relay 440 is turned on.

In S903, it is determined whether the recording material P has a width greater than or equal to 115 mm. If the recording material P has a width greater than or equal to 115 mm, the process proceeds to S904. In S904, the relay 851 is kept in an on state. If the recording material P has a width less than 115 mm, the process proceeds to S905. In S905, the relay 851 is kept in an off state. In S906, it is determined whether the recording material P has a width greater than or equal to 157 mm.

If the recording material P has a width greater than or equal to 157 mm, the process proceeds to S907. In S907, the relay 852 is kept in an on state. If the recording material P has a width less than 157 mm, the process proceeds to S908. In S908, the relay 852 is kept in an off state.

In S909, it is determined whether the recording material P has a width greater than or equal to 190 mm. If the recording material P has a width greater than or equal to 190 mm, the process proceeds to S910. In S910, the relay 853 is kept in an on state. If the recording material P has a width less than 190 mm, the process proceeds to S911. In S911, the relay 853 is kept in an off state.

In S912, the process speed for forming an image is set to full speed while the set states of the relays 851 to 853 is maintained, and an image forming operation is performed at a target temperature of 200 degrees Celsius which is set for the thermistor TH1. The processing of S912 is iterated to continue the fixing process until the print job is completed in S913. The process described above is repeatedly performed. If the completion of the print job is detected in S913, then, in S914, the relay 440 is turned off. In S915, the control sequence of image formation ends.

The heater 700 according to this exemplary embodiment may also increase the number of ways in which the heat generation distribution in the longitudinal direction of the heater 700 is switchable, without an increase in the width of the heater 700 in its transverse direction.

The control circuit 800 described in the second exemplary embodiment is applicable to the heater 300 by adjusting the number of relays that control the heat generation distribution for the heater 300 (i.e., by switching the heat generation distribution in the heater longitudinal direction in two ways by using one relay). Also, the control circuit 400 described in the first exemplary embodiment is applicable to the heater 700 by adjusting the number of triacs that control the heat generation distribution in the heater longitudinal direction for the heater 700 (i.e., by switching the heat generation distribution in the heater longitudinal direction in four ways by using four triacs). Either the control method performed by the control circuit 400 or the control method performed by the control circuit 800 may be used for heaters illustrated in FIGS. 10A and 10B, 11A and 11B, 12A and 12B, and FIGS. 13A to 13C, which will be described in the following exemplary embodiments.

Third Exemplary Embodiment

Figure 10A:
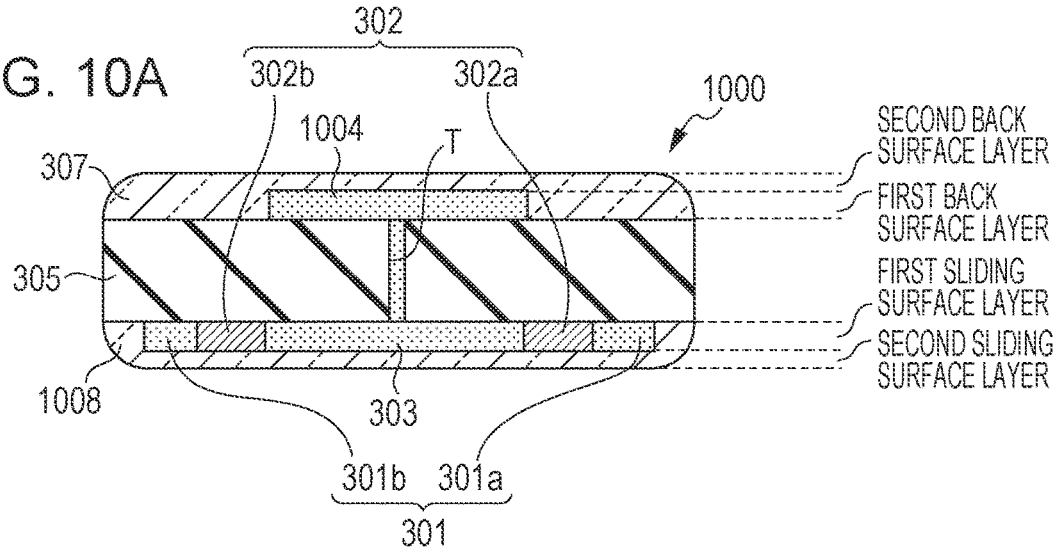
FIG. 10A is a configuration diagram of a heater according to a third exemplary embodiment.
Figure 10B:
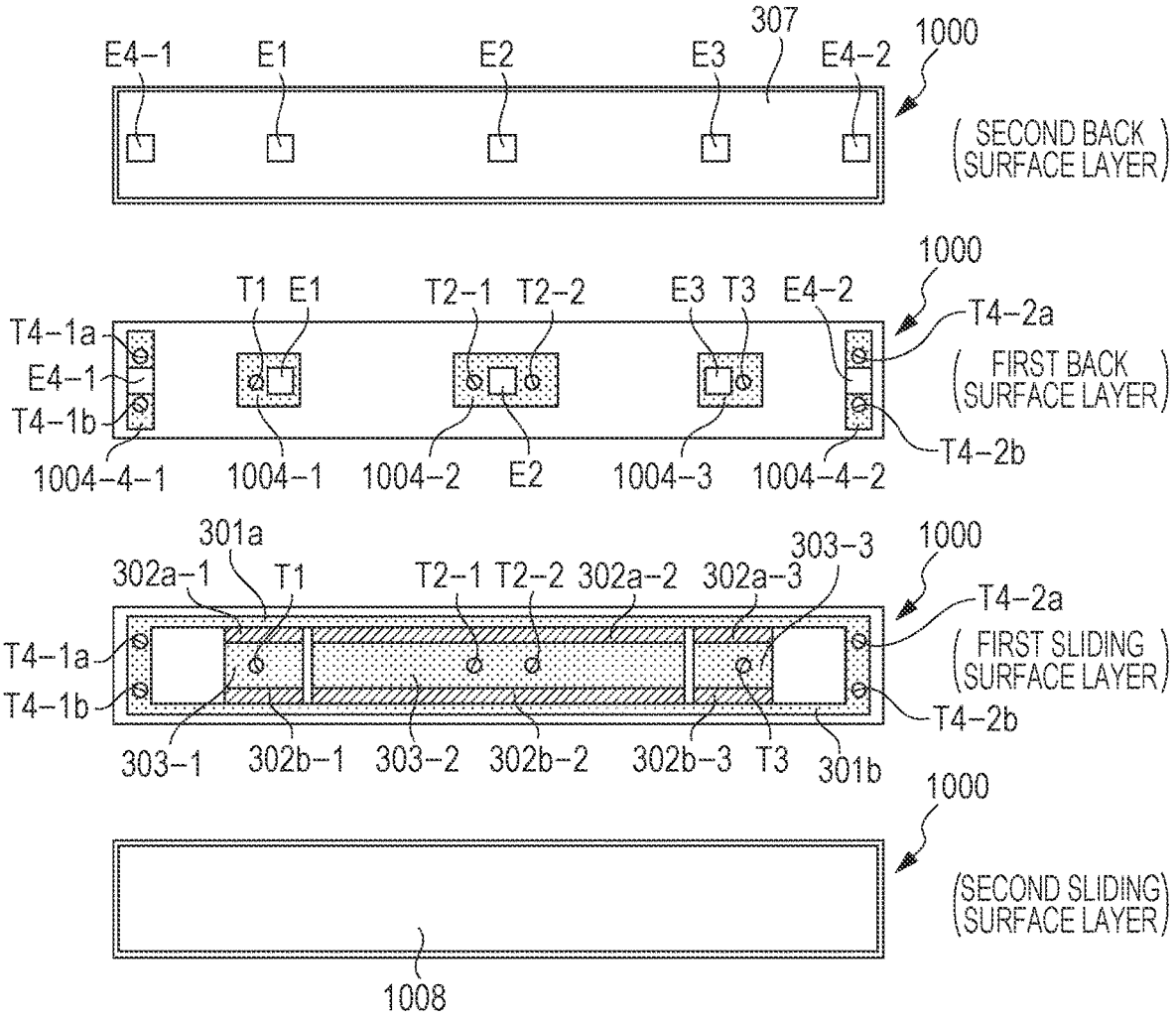
FIG. 10B is a configuration diagram of the heater according to the third exemplary embodiment.

FIGS. 10A and 10B are diagrams depicting the configuration of a heater 1000 applicable to a third exemplary embodiment. Components similar to those in the first exemplary embodiment are assigned the same numerals and are not described herein. The heater 1000 illustrated in FIGS. 10A and 10B has a feature to feed electric power to the heating element 302 disposed on the sliding surface of the substrate 305 from an electrode on the back surface of the heater 1000 via a through hole T.

FIG. 10A is a diagram of a cross section of the heater 1000 in its transverse direction. As illustrated in FIG. 10A, the heater 1000 includes a first conductor 301, a second conductor 303, and a heating element 302 that are disposed on a first layer of the sliding surface of the substrate 305.

FIG. 10B is a plan view of individual layers of the heater 1000. An electrode E1 formed on the back surface of the heater 1000 is connected to a conductor 303-1 via a conductor 1004-1 and a through hole T1. Likewise, an electrode E2 is connected to a conductor 303-2 via a conductor 1004-2 and through holes T2-1 and T2-2. An electrode E3 is connected to a conductor 303-3 via a conductor 1004-3 and a through hole T3. An electrode E4-1 is connected to conductors 301*a* and 301*b* via a conductor 1004-4-1 and through holes T4-1*a* and T4-1*b*. An electrode E4-2 is connected to the conductors 301*a* and 301*b* via a conductor 1004-4-2 and through holes T4-2*a* and T4-2*b*.

The heater 1000 further includes a surface protective layer 1008 on a second layer of the sliding surface thereof. The surface protective layer 1008 is an insulating glass layer for protecting the first conductor 301, the second conductor 303, and the heating element 302, and improving the capability of being slidably engaged with the film 202.

As in the heater 1000, the configuration of the heating element 302 disposed on the sliding surface of the substrate 305 provides the advantages disclosed herein.

Fourth Exemplary Embodiment

Figure 11A:
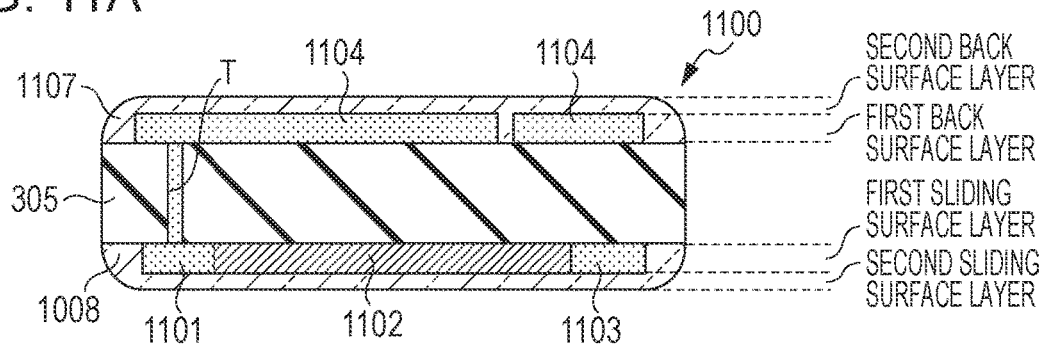
FIG. 11A is a configuration diagram of a heater according to a fourth exemplary embodiment.
Figure 11B:
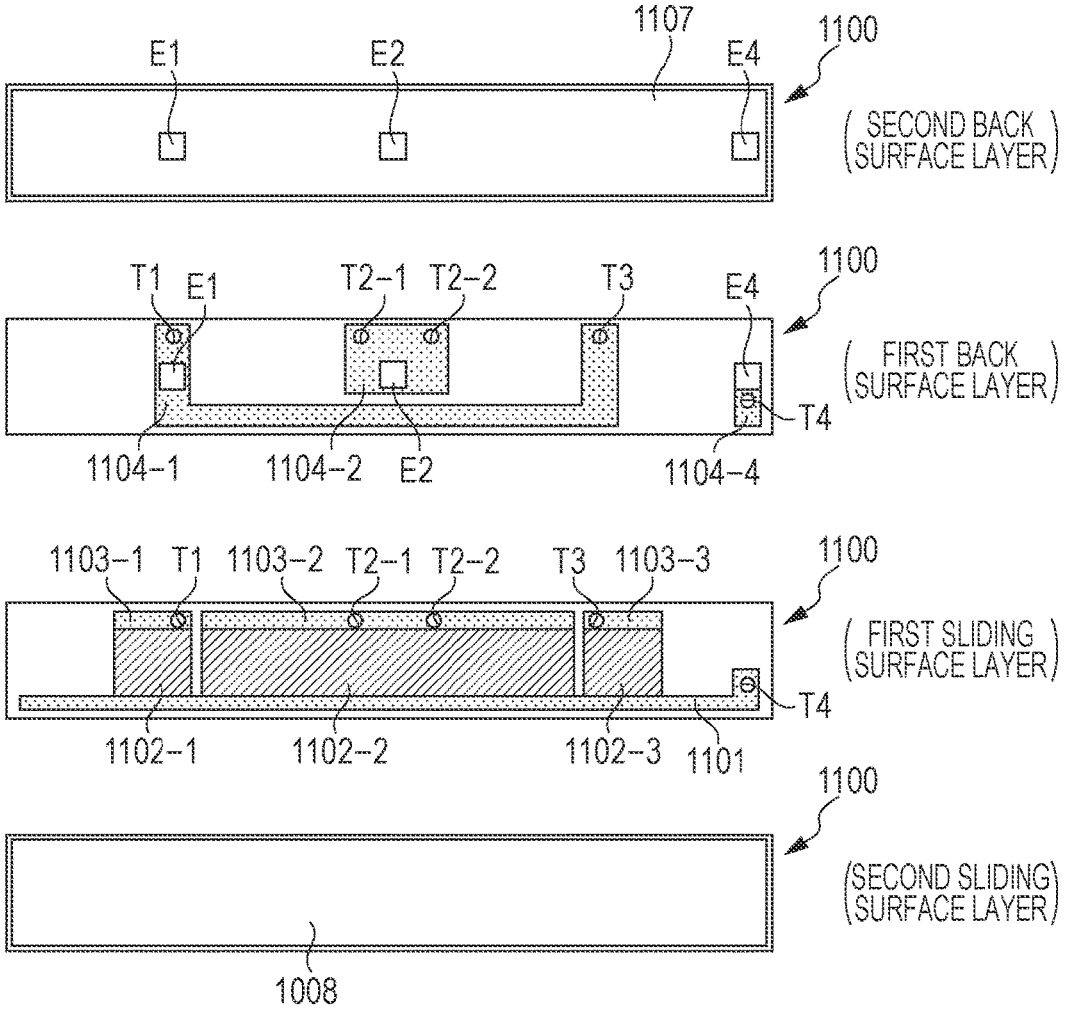
FIG. 11B is a configuration diagram of the heater according to the fourth exemplary embodiment.

FIGS. 11A and 11B are diagrams depicting the configuration of a heater 1100 applicable to a fourth exemplary embodiment. Components similar to those in the first and third exemplary embodiments are assigned the same numerals and are not described herein.

The heater 1100 illustrated in FIGS. 11A and 11B has a feature in which heating blocks 1102-1 to 1102-3 are not separated in the transverse direction of the heater 1100, and a first conductor 1101 is not also separated in the transverse direction of the heater 1100. The number of electrodes is smaller than that in the heater 300 and the heater 1000 since the electrode E1 and the electrode E3 are connected to each other on the substrate 305, and the electrode E4-1 and the electrode E4-2 are connected to each other on the substrate 305.

FIG. 11A is a diagram of a cross section of the heater 1100 in its transverse direction. FIG. 11B is a plan view of individual layers of the heater 1100.

The electrode E1 formed on the back surface of the heater 1100 is connected to a conductor 1103-1 via a conductor 1104-1 and a through hole T1. Also, the electrode E2 is connected to a conductor 1103-2 via a conductor 1104-2 and through holes T2-1 and T2-2. The electrode E4 is connected to a conductor 1101 via a conductor 1104-4 and a through hole T4. A conductor 1103-3 is connected to the electrode E1 via the conductor 1104-1 and a through hole T3. In the configuration described above with reference to the control circuit 400 illustrated in FIG. 4, the electrode E1 and the electrode E3 need to be connected to each other outside the heater 300. In the configuration described above, in contrast, the electrode E1 and the electrode E3 do not need to be connected to each other outside the heater 1100. In the configuration described above, furthermore, the electrode E4-1 and the electrode E4-2 do not also need to be connected to each other outside the heater 1100. Accordingly, a protective layer 1107 is formed on the second layer of the back surface of the heater 1100, except for the portions corresponding to the electrodes E1, E2, and E4.

In the heater 1100 according to this exemplary embodiment, second conductors connected to heating blocks that do not need to be controlled independently (i.e., the heating blocks 1102-1 and 1102-3) are connected to each other on the substrate 305, thereby removing the electrode E3. In addition, one of electrodes disposed in the right and left portions on the substrate 305 (i.e., E4-1 and E4-2 in FIG. 3B), which are connected to first conductors, is removed. Accordingly, the number of electrodes required may be reduced. As in the heater 1100, the configuration in which the heating element 1102 is not separated in the transverse direction of the heater 1100 provides the advantages disclosed herein.

Fifth Exemplary Embodiment

Figure 12A:
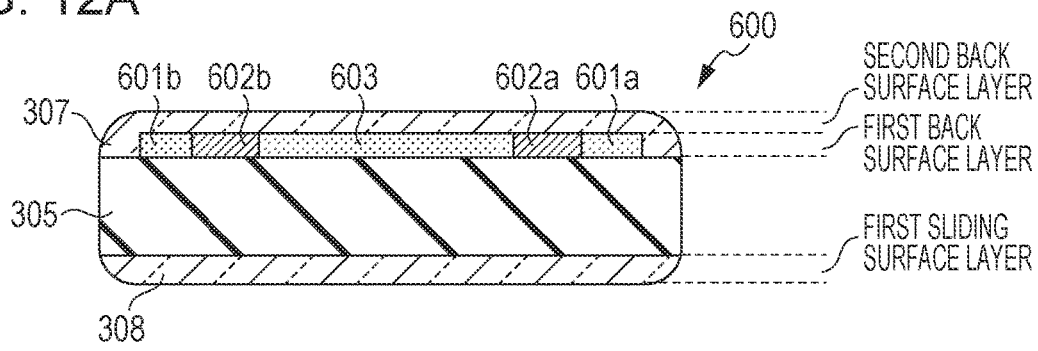
FIG. 12A is a configuration diagram of a heater according to a fifth exemplary embodiment.
Figure 12B:
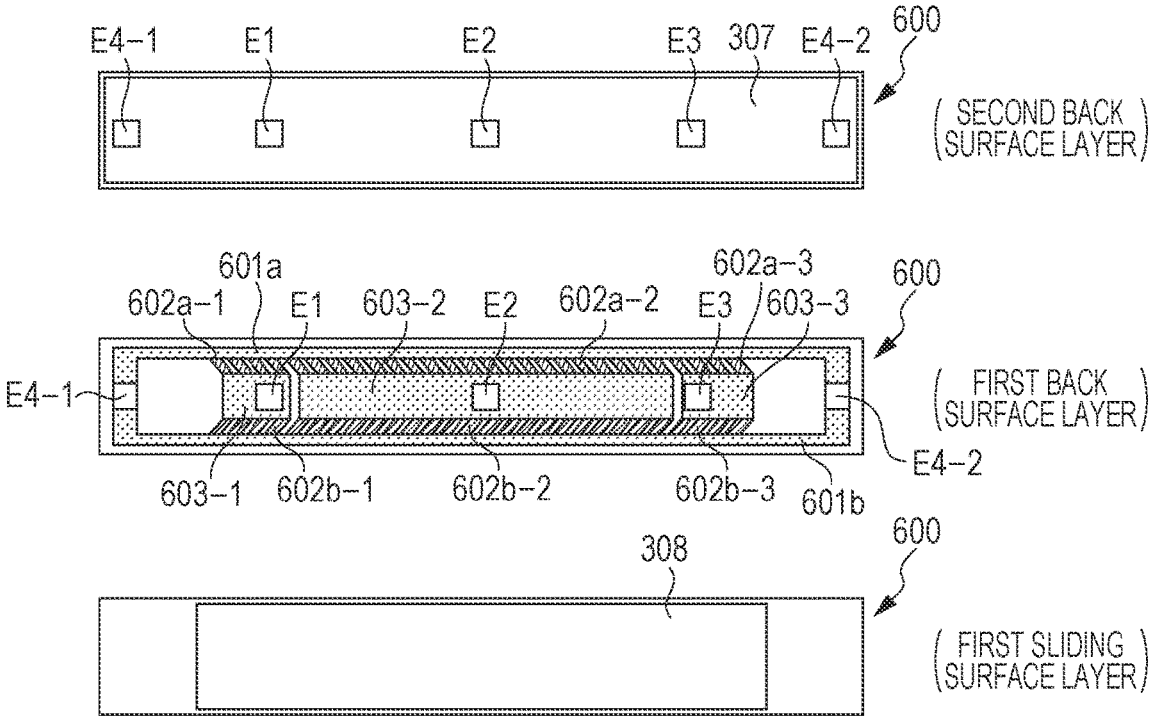
FIG. 12B is a configuration diagram of the heater according to the fifth exemplary embodiment.

FIGS. 12A and 12B are diagrams depicting the configuration of a heater 600 applicable to a fifth exemplary embodiment. Components similar to those in the first exemplary embodiment are assigned the same numerals and are not described herein.

The heater 600 illustrated in FIGS. 12A and 12B has a feature in which heating elements 602*a*-1, 602*b*-1, 602*a*-2, 602*b*-2, 602*a*-3, and 602*b*-3 are each further divided into a plurality of heating elements that are connected in parallel with each other.

FIG. 12A is a diagram of a cross section of the heater 600 in its transverse direction. FIG. 12B is a plan view of individual layers of the heater 600.

The heating element 602*a*-1 divided into a plurality of heating elements is connected between a conductor 603-1 and a conductor 601*a*, and is supplied with power. The heating element 602*b*-1, the heating element 602*a*-2, the heating element 602*b*-2, the heating element 602*a*-3, and the heating element 602*b*-3 have a similar configuration to that of the heating element 602*a*-1, and are not described herein.

The plurality of parallel connected heating elements of the heating element 602*a*-1 are arranged to be inclined with respect to the longitudinal and transverse directions of the heater 600. The plurality of parallel connected heating elements of the heating element 602*a*-1 further overlap each other in the longitudinal direction. This may reduce the influence of gaps between the plurality of heating elements, and improve the uniformity of the heat generation distribution in the longitudinal direction of the heater 600. In the heater 600 according to this exemplary embodiment, furthermore, the influence of gaps between heating blocks may also be reduced since endmost heating elements in adjacent heating blocks overlap each other in the longitudinal direction, and the heat generation distribution may be made more uniform. The endmost heating elements of adjacent heating blocks are a combination of the heating element at the right end of the heating element 602*a*-1 and the heating element at the left end of the heating element 602*a*-2, and a combination of the heating element at the right end of the heating element 602*a*-2 and the heating element at the left end of the heating element 602*a*-3.

In addition, the resistance values of the plurality of parallel connected heating elements of the heating elements 602*a*-1 to 602*a*-3 and 602*b*-1 to 602*b*-3 may be adjusted to make the temperature distribution in one heating block uniform. Also, the resistance values of the plurality of parallel connected heating elements of the heating elements 602*a*-1 to 602*a*-3 and 602*b*-1 to 602*b*-3 may be adjusted so that the heat generation distribution in the longitudinal direction of the heater 600 is uniform across a plurality of heating blocks (e.g., the heating blocks 602-1 to 602-3).

The resistance values of the plurality of parallel connected heating elements of the heating elements 602*a*-1 to 602*a*-3 and 602*b*-1 to 602*b*-3 may be adjusted by adjusting the widths, lengths, intervals, inclinations, and the like of the individual heating elements. The use of the heater 600 according to this exemplary embodiment may suppress or reduce temperature variations in gaps between a plurality of heating blocks.

Sixth Exemplary Embodiment

Figure 13A:
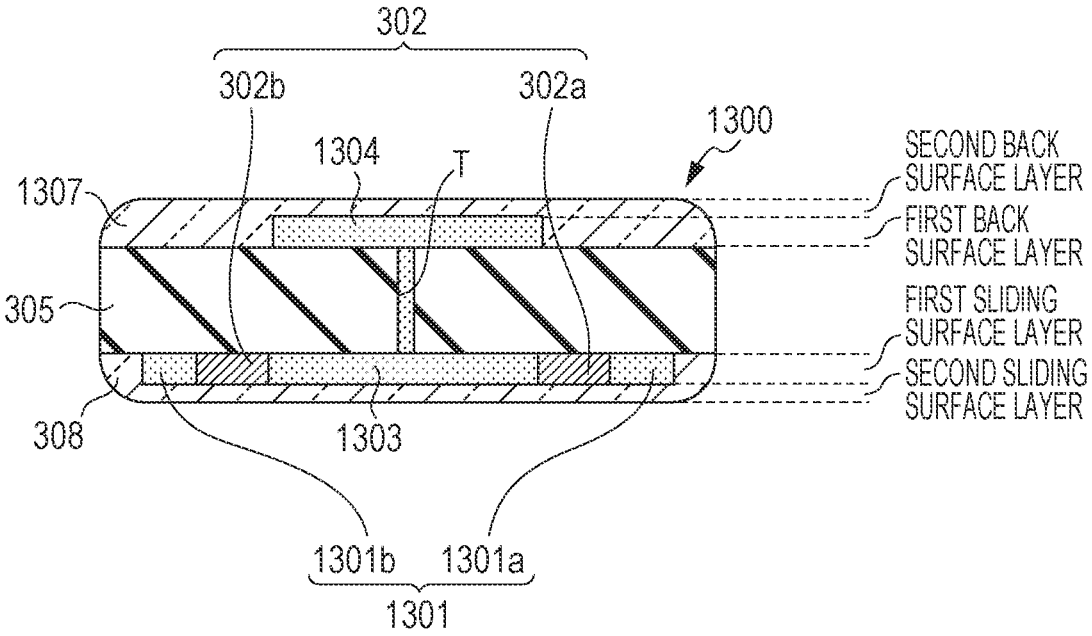
FIG. 13A is a configuration diagram of a heater according to a sixth exemplary embodiment.
Figure 13B:
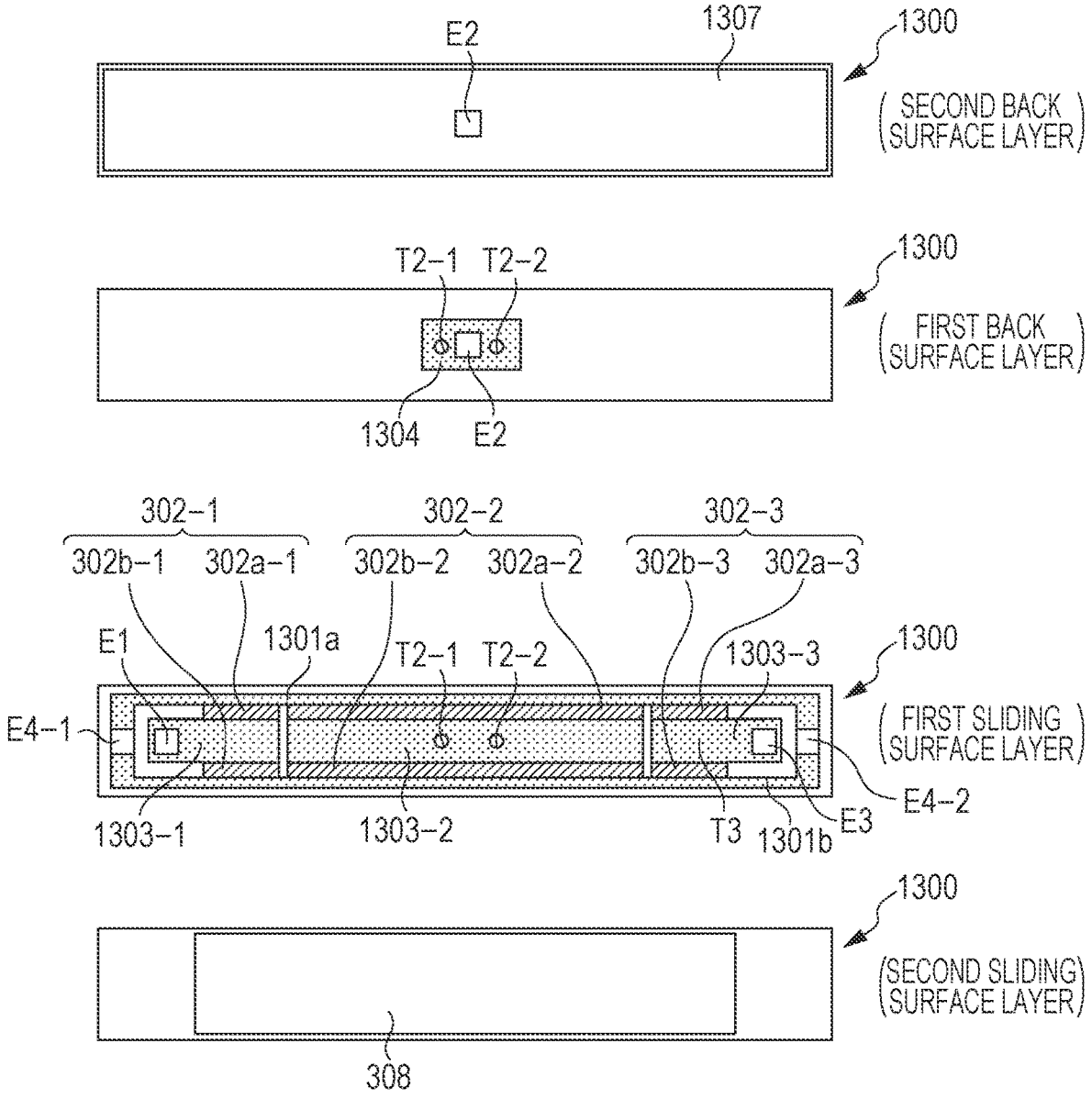
FIG. 13B is a configuration diagram of the heater according to the sixth exemplary embodiment.
Figure 13C:
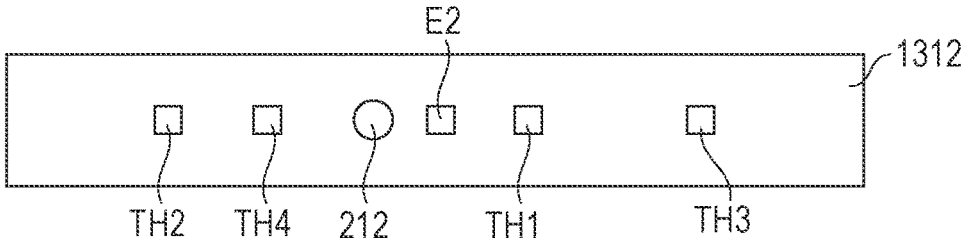
FIG. 13C is a configuration diagram of the heater according to the sixth exemplary embodiment.

FIGS. 13A to 13C are diagrams depicting the configuration of a heater 1300 applicable to a sixth exemplary embodiment. Components similar to those in the first and third exemplary embodiments are assigned the same numerals and are not described herein.

The heater 1300 illustrated in FIGS. 13A to 13C has a feature to feed electric power to only some heating blocks via an electrode on the back surface of the heater 1300.

FIG. 13A is a diagram of a cross section of the heater 1300 in its transverse direction. As illustrated in FIG. 13A, the heater 1300 includes a first conductor 1301, a second conductor 1303, and a heating element 302 that are disposed on a first layer of the sliding surface of the substrate 305.

FIG. 13B is a plan view of individual layers of the heater 1300. An electrode E2 formed on the first layer of the back surface of the substrate 305 is connected to a conductor 1303-2 formed on the first layer of the sliding surface via a conductor 1304 and through holes T2-1 and T2-2. An electrode E1 is connected to a conductor 1303-1, an electrode E3 is connected to a conductor 1303-3, and an electrode E4-1 and an electrode E4-2 are connected to conductors 1301*a* and 1301*b*, respectively. The electrode E1, the electrode E3, the electrode E4-1, and the electrode E4-2 are located outside the portions at the opposite ends of the heater 1300 in its longitudinal direction that are slidably engaged with the film 202. Thus, electrical contacts are disposed on the sliding surface at the opposite ends of the heater 1300 in its longitudinal direction so that the electrical contacts are connected to the electrode E1, the electrode E3, the electrode E4-1, and the electrode E4-2. Thus, a holding member 1312 in the heater 1300 has no holes for the electrode E1, the electrode E3, the electrode E4-1, and the electrode E4-2.

The heater 1300 is configured to feed electric power to only some heating blocks (e.g., the heating block 302-2) via the electrode on the back surface. In order to feed electric power to a heating block that is not in contact with the opposite end portions of the heater 1300 in its longitudinal direction from the opposite ends of the heater 1300 in its longitudinal direction, it is necessary to increase the width of the heater 1300 in its transverse direction and to dispose an additional conductor on the substrate 305. Examples of the heating block that is not in contact with the opposite end portions of the heater in its longitudinal direction include the heating block 302-2 in the heater 1300 according to this exemplary embodiment, and the heating blocks 702-2 to 702-6 in the heater 700 described in the second exemplary embodiment. Accordingly, it may be sufficient to provide a configuration that enables electric power feed to one or more heating blocks that are not in contact with at least the opposite end portions of the heater 1300 in its longitudinal direction from an electrode provided for a second conductor or from an electrode connected via the through hole T.

Seventh Exemplary Embodiment

Figure 15A:
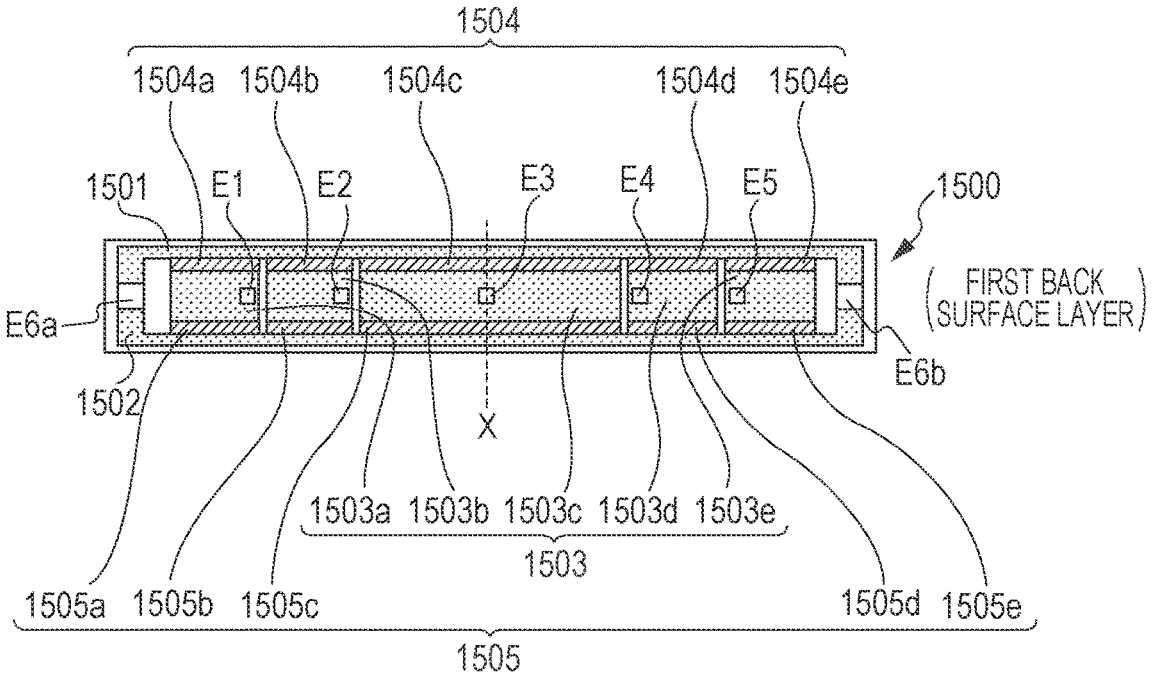
FIG. 15A is a configuration diagram of a heater according to the seventh exemplary embodiment.
Figure 15B:
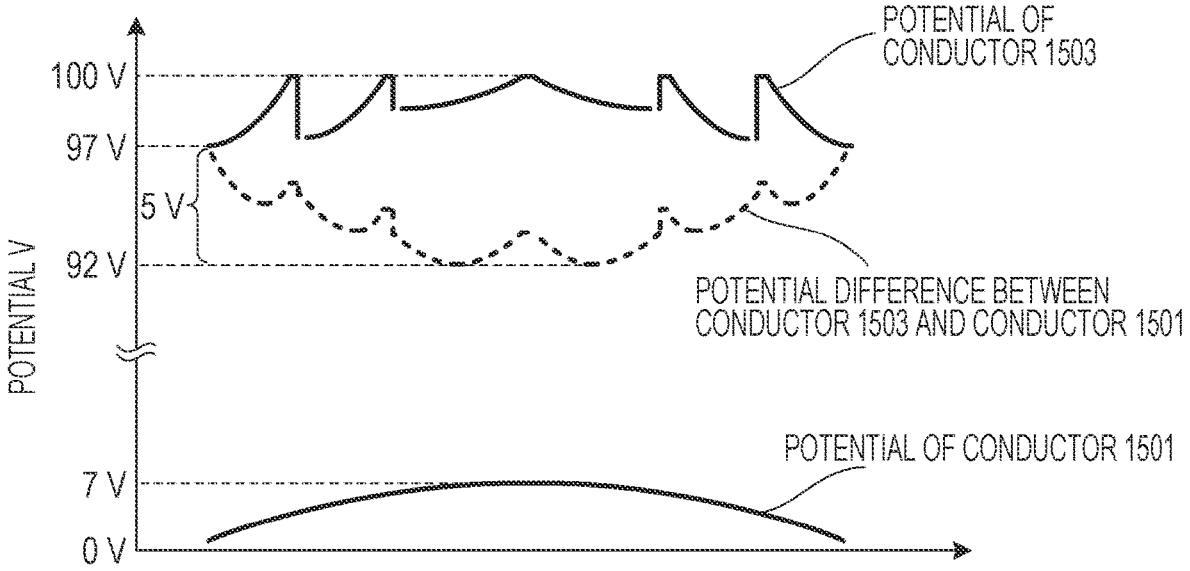
FIG. 15B is a configuration diagram of the heater according to the seventh exemplary embodiment.

FIGS. 15A and 15B are diagrams depicting the configuration of a heater 1500 applicable to a seventh exemplary embodiment. The heater 1500 illustrated in FIG. 15A is configured such that electrodes E1, E2, E4, and E5 are located at positions in the respective heating blocks that are nearer the center of the heater 1500 in its longitudinal direction (i.e., a location indicated by a broken line X in FIGS. 15A and 15B). The illustrated configuration may suppress or reduce the non-uniformity in heat generation of the heater 1500. The effect will be described hereinbelow.

Figure 14A:
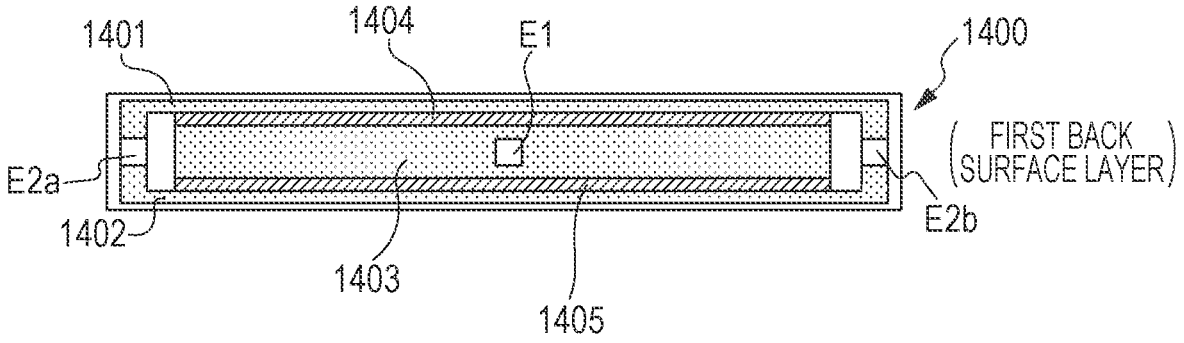
FIG. 14A is a diagram depicting an advantage of a seventh exemplary embodiment.

First, the non-uniformity in heat generation, which is caused in a heater in which current flows in parallel to the recording material conveyance direction will be described with reference to a heater 1400 illustrated in FIGS. 14A and 14B to illustrate the non-uniformity in heat generation. FIG.

14A is a plan view of a first layer of the back surface of the heater 1400. The cross-sectional configuration of the heater 1400, that is, the configuration of the back surface layers, the sliding surface layer, and the substrate, is similar to that in the first exemplary embodiment. For ease of understanding, in the heater 1400, a first conductor (1401 and 1402), a second conductor 1403, and a heating element (1404 and 1405) are not separated in the longitudinal direction of the heater 1400. Further, the first and second conductors and the heating element have a uniform resistance. Electrodes E1, E2*a*, and E2*b* are connected to electrical contacts for supplying power. The electrode E1 is located at the center in the longitudinal direction, and a voltage is applied between the electrodes E1 and E2*a* and between the electrodes E1 and E2*b* to cause the heating element (1404 and 1405) to generate heat.

Figure 14B:
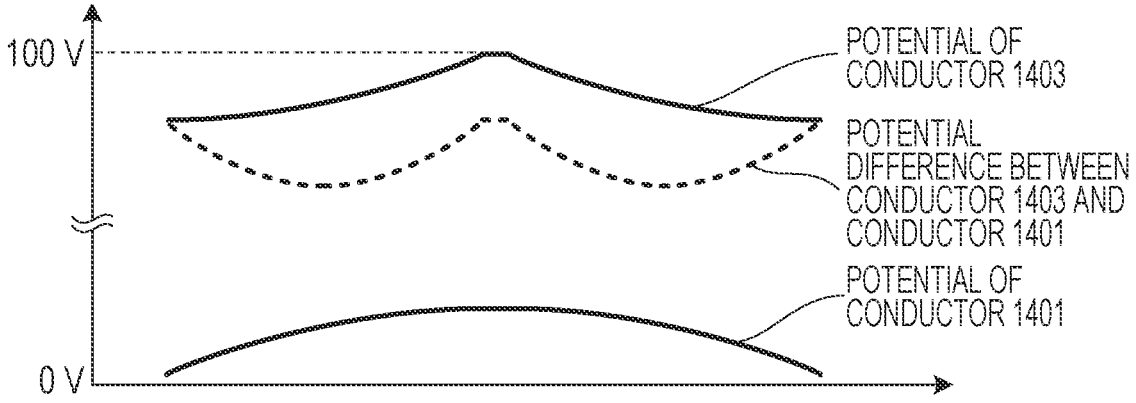
FIG. 14B is a diagram depicting an advantage of the seventh exemplary embodiment.

FIG. 14B illustrates a potential distribution of the conductors 1401 and 1403 in the longitudinal direction of the heater 1400 when a voltage of +100 V is applied to the electrode E1 and a voltage of 0 V is applied to the electrodes E2*a* and E2*b*. The conductor 1402 has the same potential distribution as the conductor 1401, and is not illustrated. The conductor 1403 has a potential that exhibits a maximum value in the center portion in the longitudinal direction and that decreases toward the opposite ends. The electrical resistance of the conductor 1403 causes a voltage drop. Further, the magnitude of the voltage drop varies depending on the ratio of the resistance of the conductor 1403 to the resistance of the heating element 1404. The potential distribution of the conductor 1401 also has a voltage drop from the center to the ends. The magnitude of the voltage drop also varies depending on the ratio of the resistance of the conductor 1401 to the resistance of the heating element 1405.

The conductors and the heating elements of the heater 1400 are formed on a ceramic substrate by screen printing, and have a thickness in the range of 4 to 10 micrometers. The conductors (1401, 1402, and 1403) are composed of Ag, and have a specific resistance of $2\times10^{-8}$ ohm-meters. The heating elements (1404 and 1405) are composed of $RuO_2$, and have a specific resistance of $3\times10^{-2}$ ohm-meters.

The voltage to be applied to the heating element 1404 is equal to the potential difference between the conductor 1403 and the conductor 1401. Thus, the distribution indicated by the broken line in FIG. 14B is obtained. That is, the voltage to be applied to the heating element 1404 is non-uniform in the longitudinal direction, resulting in the heat generation distribution of the heating element 1404 being also non-uniform. The heat generation distribution of the heating element 1405 is also non-uniform. Thus, non-uniformity in heat generation occurs in the heater 1400.

Next, the configuration of the heater 1500 according to the seventh exemplary embodiment will be described. FIG. 15A is a plan view of a first layer of the back surface of the heater 1500. The cross-sectional configuration of the heater 1500, that is, the configuration of the second layer of the back surface, the sliding surface layer, and the substrate, is similar to that is the first exemplary embodiment. The following eighth exemplary embodiment and other exemplary embodiments are also the same as the first exemplary embodiment, except for the first layer of the back surface and the configuration of the electrodes, and the layers other than the first layer of the back surface are not described herein.

A conductor 1503 and heating elements (1504 and 1505) are each separated in to five pieces in the longitudinal direction of the heater 1500, and individual blocks are supplied with power via electrodes E1, E2, E3, E4, and E5, respectively. The electrodes E1, E2, E4, and E5 are located at positions that are nearer the center of the heater 1500 (indicated by the broken line X), rather than the center of the respective blocks, in the longitudinal direction of the heater 1500.

FIG. 15B illustrates a potential distribution of conductors 1501 and 1503 when a voltage of +100 V is applied to the electrodes E1, E2, E3, E4, and E5 of the heater 1500 and a voltage of 0 V is applied to electrodes E6*a* and E6*b*. The potential distribution of a conductor 1502 is similar to that of the conductor 1501, and is not illustrated. The conductors 1501 and 1503 have a potential that decreases toward the ends of a block in the longitudinal direction from the respective electrode positions. This phenomenon is similar to that related to the voltage drop described with reference to the heater 1400 in FIGS. 14A and 14B. Further, a distribution of the potential difference between the conductor 1503 and the conductor 1501 is indicated by the broken line in FIG. 15B, and the potential difference has a maximum value of 97 V and a minimum value of 92 V. That is, the voltage to be applied to the heating elements (1504 and 1505) has a variation (range) of 5 V.

Figure 16A:
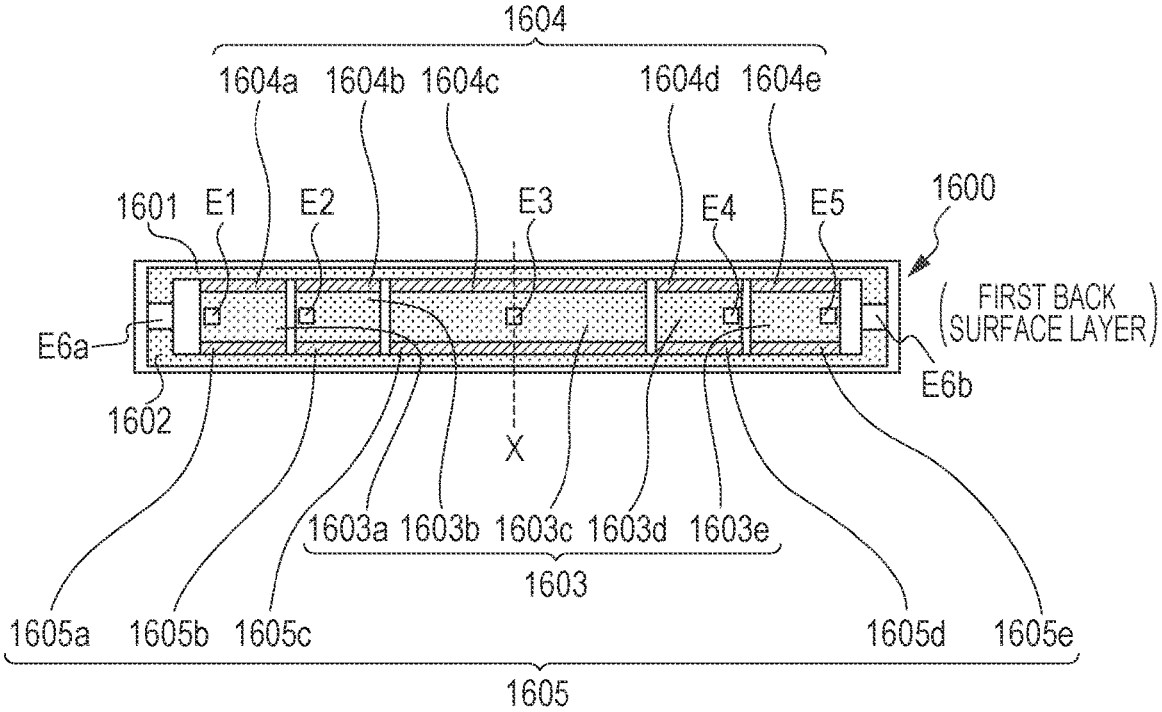
FIG. 16A is a configuration diagram of a heater according to a modification of the seventh exemplary embodiment.
Figure 16B:
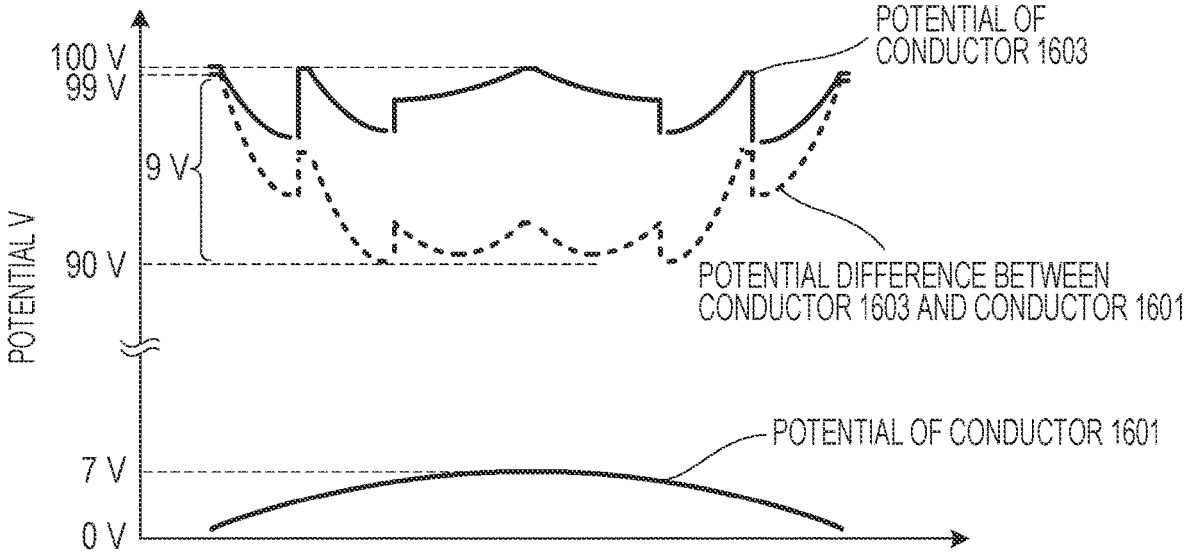
FIG. 16B is a configuration diagram of the heater according to the modification of the seventh exemplary embodiment.

FIGS. 16A and 16B illustrate an example of a heater different from the heater 1500 in the positions of electrodes. A heater 1600 has a structure in which the electrodes E1, E2, E4, and E5 are located at positions that are nearer the ends of the heater 1600, rather than the center of the respective blocks.

FIG. 16B illustrates a potential distribution of conductors 1601 and 1603 when a voltage of +100 V is applied to the electrodes E1, E2, E3, E4, and E5 of the heater 1600 and a voltage of 0 V is applied to electrodes E6*a* and E6*b*. The potential distribution of a conductor 1602 is similar to that of the conductor 1601, and is not illustrated. A distribution of the potential difference between the conductor 1603 and the conductor 1601 is indicated by the broken line in FIG. 16B, and the potential difference has a maximum value of 99 V and a minimum value of 90 V. That is, the voltage to be applied to heating elements (1604 and 1605) has a variation of 9 V.

Table 1 shows maximum values and minimum values of potential differences between conductors of the heater 1500 and the heater 1600, and ranges of the potential differences.

TABLE 1

| | Maximum value of potential difference | Minimum value of potential difference | Range (maximum value-minimum value) |
|---|---|---|---|
| Heater 1500 | 97 V | 92 V | 5 V |
| Heater 1600 | 99 V | 90 V | 9 V |

Accordingly, preferably, as in the heater 1500, the position of an electrode in each block is located nearer the center of the heater (indicated by the broken line X), rather than the center of the associated block, in the longitudinal direction of the heater in order to reduce the non-uniformity in heat generation of the heater in the longitudinal direction of the heater.

Eighth Exemplary Embodiment

Figure 17A:
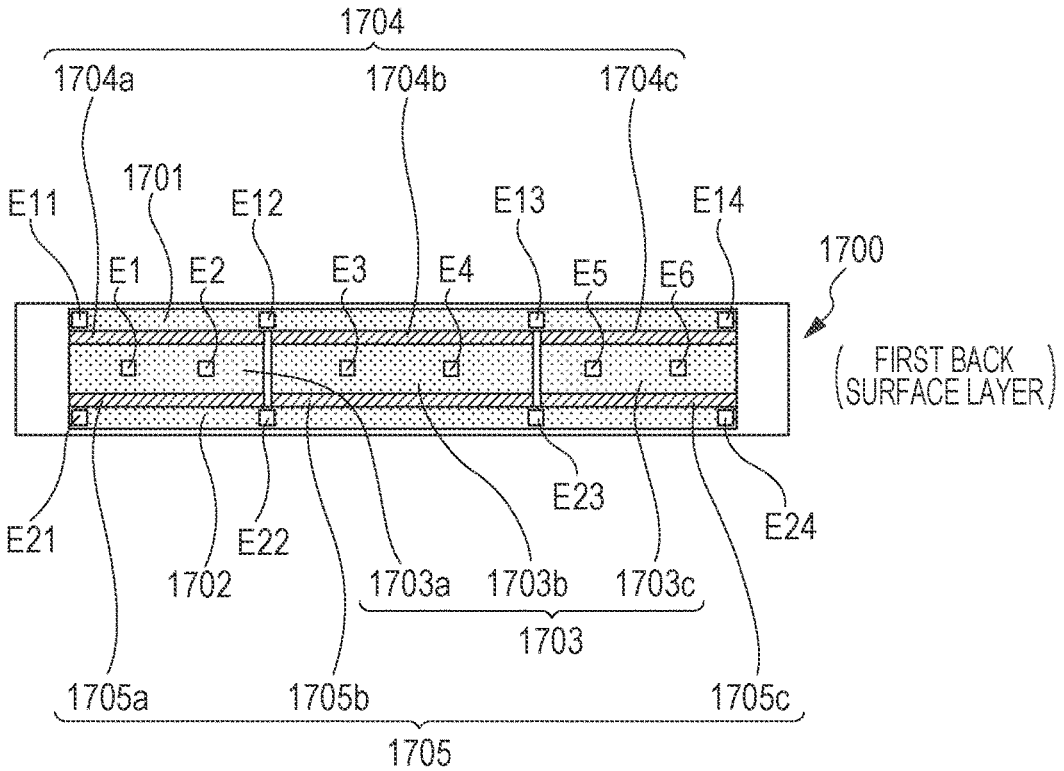
FIG. 17A is a configuration diagram of a heater according to an eighth exemplary embodiment.
Figure 17B:
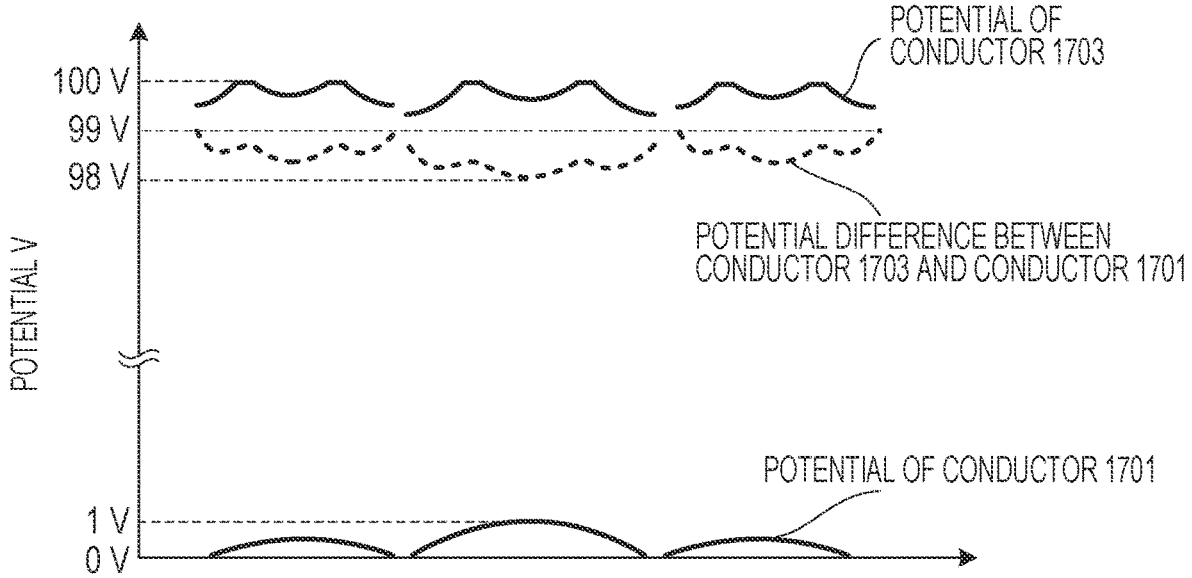
FIG. 17B is a configuration diagram of the heater according to the eighth exemplary embodiment.

FIGS. 17A and 17B are diagrams depicting the configuration of a heater 1700 applicable to an eighth exemplary embodiment. The heater 1700 is configured such that each heating block has a plurality of electrodes.

FIG. 17A is a plan view of the first layer of the back surface of the heater 1700. A conductor 1703 and heating elements (1704 and 1705) are each separated into three pieces in the longitudinal direction of the heater 1700. Heating elements 1704*a* and 1705*a* are supplied with power from electrodes E1 and E2, heating elements 1704*b* and 1705*b* are supplied with power from electrodes E3 and E4, and heating elements 1704*c* and 1705*c* are supplied with power from electrodes E5 and E6.

All the electrodes E1, E2, E3, E4, E5, and E6 have the same potential, and all electrodes E11, E12, E13, E14, E21, E22, E23, and E24 also have the same potential. FIG. 17B illustrates a potential distribution of conductors 1701 and 1703 when a voltage of +100 V is applied to the electrodes E1, E2, E3, E4, E5, and E6 and a voltage of 0 V is applied to the electrodes E11, E12, E13, E14, E21, E22, E23, and E24. The potential distribution of a conductor 1702 is similar to that of the conductor 1701, and is not illustrated. In the potential distribution of the conductor 1703, the potential exhibits a maximum value at the positions of the six electrodes E1 to E6, and decreases in periods between the electrodes. Note that the amount by which the potential decreases is smaller than that of the heater 1600 illustrated in FIG. 16A. The reason for this is that, for example, in the case of a path of the current flowing from the electrode E1 to the electrode E11, the two electrodes E1 and E2 in the block associated with a conductor 1703*a* reduces the distance between the electrodes E1 and E11. That is, the apparent resistance value of the conductor in the current paths for the electrodes E1 and E11 is small, resulting in a reduction in the amount of decrease in the potential of the conductor 1703*a*. Likewise, the conductor 1701 also has a plurality of electrodes (E11, E12, E13, and E14), resulting in a reduction in the variation of the potential of the conductor 1701.

Accordingly, the potential difference between the conductors 1703 and 1701 indicated by the broken line in FIG. 17B has a maximum value of 99 V and a minimum value of 98 V, and the range of the potential difference is small. In this manner, one heating block including a plurality of electrodes having the same potential may suppress or reduce the variation of the potential difference in the longitudinal direction of the heater. This makes the voltages to be applied to the heating elements 1704 and 1705 uniform in the longitudinal direction of the heater 1700, and suppresses or reduces the non-uniformity in heat generation of the heater 1700.

Ninth Exemplary Embodiment

Figure 18A:
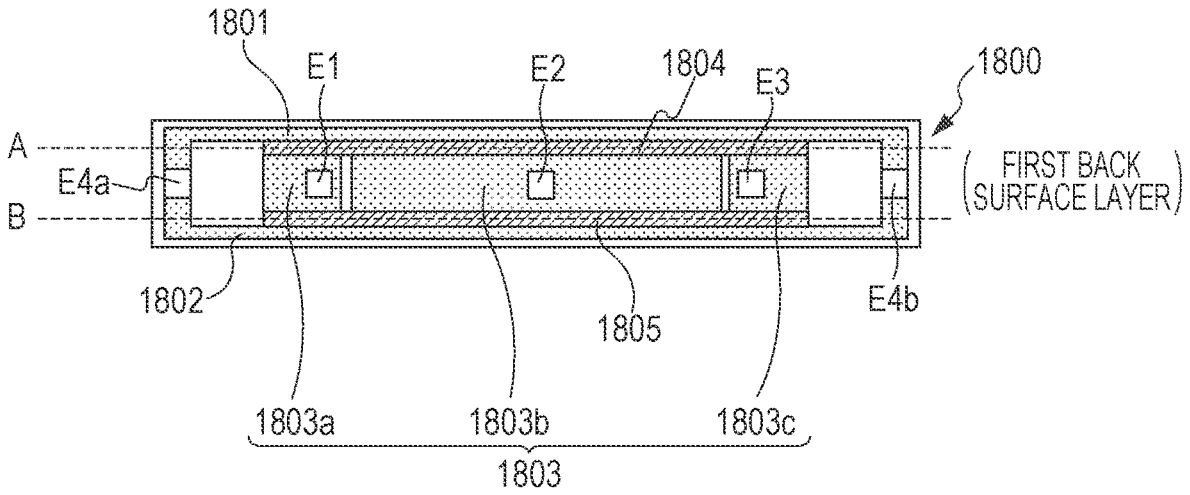
FIG. 18A is a configuration diagram of a heater according to a ninth exemplary embodiment.
Figure 18B:
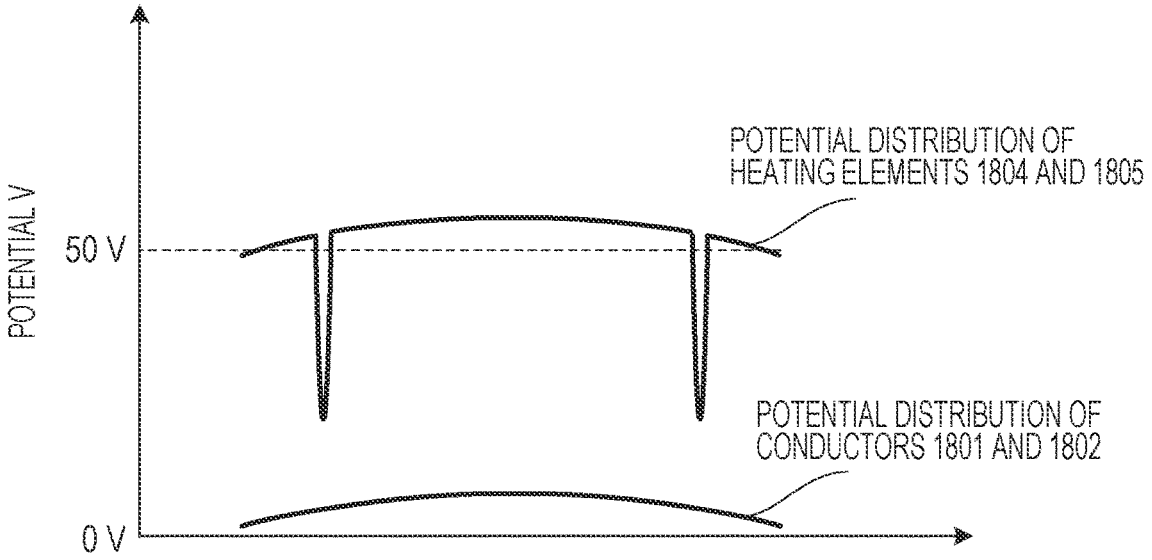
FIG. 18B is a configuration diagram of the heater according to the ninth exemplary embodiment.

FIGS. 18A and 18B are diagrams depicting the configuration of a heater 1800 applicable to a ninth exemplary embodiment. The heater 1800 includes heating elements 1804 and 1805 each of which is consecutive (i.e., is not separated) in the longitudinal direction of the heater 1800.

FIG. 18A is a plan view of the first layer of the back surface of the heater 1800. A conductor 1803 is separated into three conductors 1803*a*, 1803*b*, and 1803*c* in the longitudinal direction. The conductor 1803*a* is supplied with power from an electrode E1, the conductor 1803*b* is supplied with power from an electrode E2, and the conductor 1803*c* is supplied with power from an electrode E3.

FIG. 18B illustrates a potential distribution of the heating elements 1804 and 1805, and conductors 1801 and 1802 when a voltage of +100 V is applied to the electrodes E1, E2, and E3 of the heater 1800 and a voltage of 0 V is applied to electrodes E4*a* and E4*b*. The potential distributions of the heating elements 1804 and 1805 are obtained at positions indicated by broken lines A and B in FIG. 18A, respectively. In this exemplary embodiment, the heating elements 1804 and 1805 are not separated. Thus, the potentials of the heating elements 1804 and 1805 are not equal to 0 V at positions corresponding to the positions at which the conductor 1803 is separated. Accordingly, the heating elements 1804 and 1805 continuously generate heat in the longitudinal direction, and there is no area where the amount of heat generated is 0, making the heat generation distribution of the heater 1800 more uniform.

Tenth Exemplary Embodiment

Figure 19A:
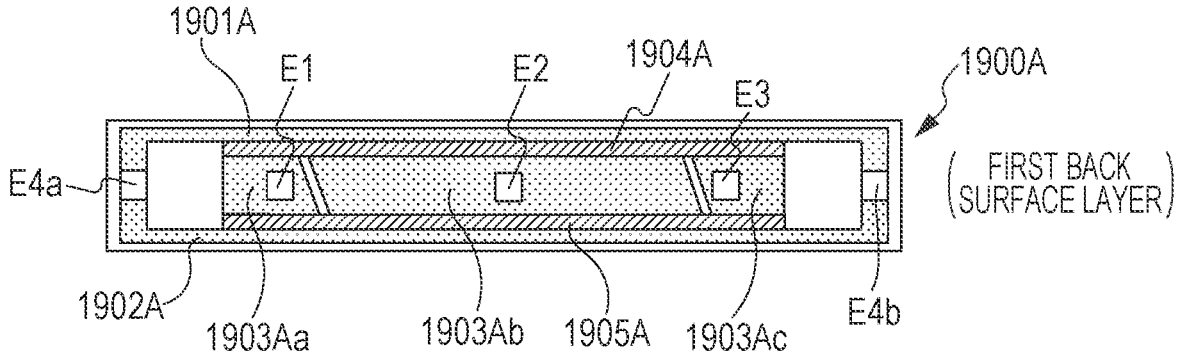
FIG. 19A is a configuration diagram of a heater according to a tenth exemplary embodiment.
Figure 19B:
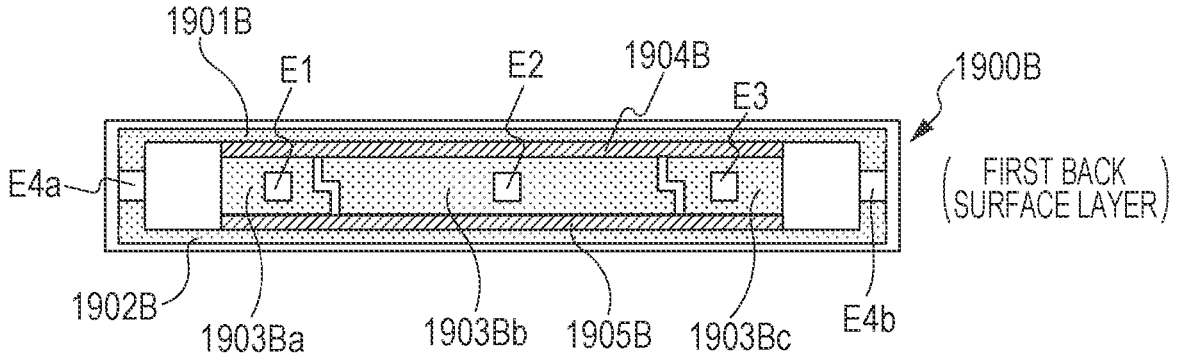
FIG. 19B is a configuration diagram of the heater according to the tenth exemplary embodiment.

FIGS. 19A and 19B are diagrams depicting the configuration of a heater 1900A and a heater 1900B applicable to a tenth exemplary embodiment. FIG. 19A illustrates a first layer of the back surface of the heater 1900A, and a conductor 1903A is separated into conductors 1903Aa, 1903Ab, and 1903Ac in the longitudinal direction of the heater 1900A. The boundary between the conductor 1903Aa and the conductor 1903Ab is inclined with respect to the longitudinal direction of the heater 1900A and the recording material conveyance direction. The boundary between the conductor 1903Ab and the conductor 1903Ac is also inclined with respect to the longitudinal direction of the heater 1900A and the recording material conveyance direction.

A heating element 1904A and a heating element 1905A are not separated in the longitudinal direction. As described in the ninth exemplary embodiment, the amount of heat generated is low in portions where the heating element 1904A is in contact with the gap areas between the pieces into which the conductor 1903A is separated. The portions where the amount of heat generated by the heating element 1904A is low and the portions where the amount of heat generated by the heating element 1905A is low are shifted in the longitudinal direction of the heater 1900A because the boundaries in the conductor 1903A are inclined.

Shifting the portions where the amount of heat generated by the heating element 1904A is low and the portions where the amount of heat generated by the heating element 1905A is low in the longitudinal direction makes the heat generation distribution of the overall heater more uniform.

As illustrated in FIG. 19B, a conductor 1903B may be separated by step-shaped boundaries. The configuration of a conductor 1903B illustrated in FIG. 19B other than the shape is similar to that in FIG. 19A, and is not described in detail herein.

Eleventh Exemplary Embodiment

Figure 20A:
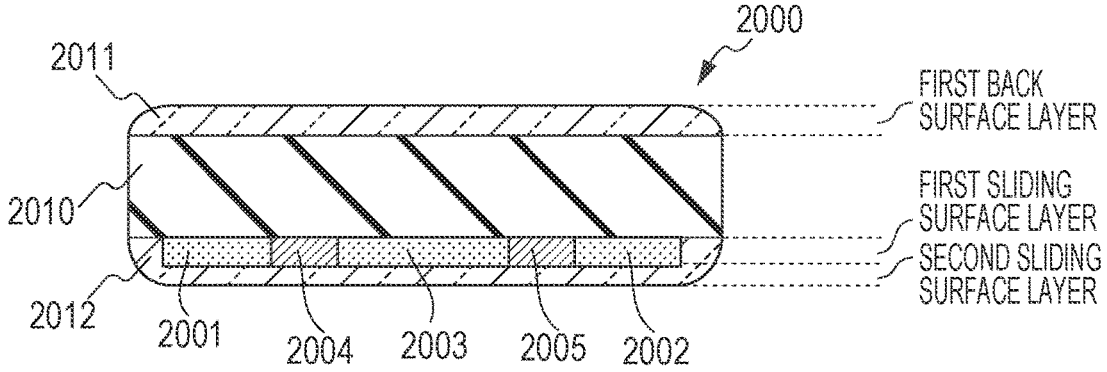
FIG. 20A is a configuration diagram of a heater according to an eleventh exemplary embodiment.
Figure 20B:
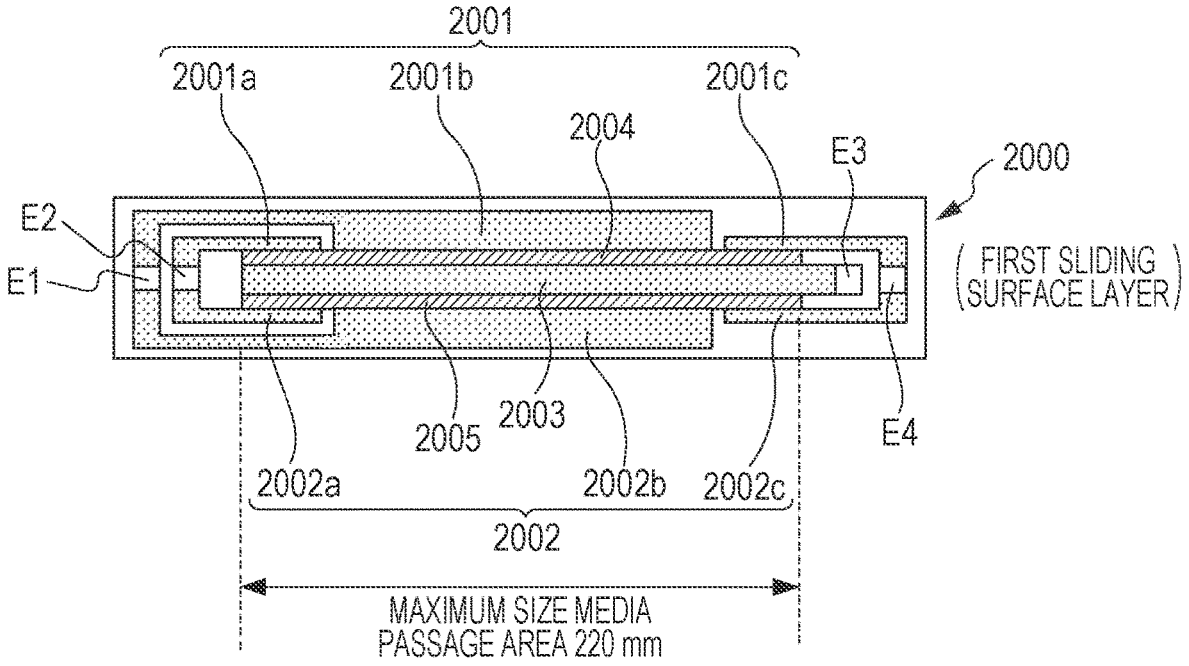
FIG. 20B is a configuration diagram of the heater according to the eleventh exemplary embodiment.

FIGS. 20A and 20B are diagrams depicting the configuration of a heater 2000 applicable to an eleventh exemplary embodiment. The heater 2000 illustrated in FIGS. 20A and 20B is the same as the heater 1900A or 1900B according to the tenth exemplary embodiment in that a heating element is not separated but a conductor is separated to form individual blocks. The difference is that electrodes are disposed outside an area (maximum size media passage area) where a heating element is disposed in the longitudinal direction of the heater 2000.

FIG. 20A is a cross-sectional view of the heater 2000. As illustrated in FIG. 20A, the heater 2000 includes first conductors 2001 and 2002, a second conductor 2003, a heating element 2004, and a heating element 2005 that are disposed on a first layer of a sliding surface of a substrate 2010.

FIG. 20B is a plan view of the first layer of the sliding surface. As illustrated in FIG. 20B, the heating elements 2004 and 2005 are not separated in the longitudinal direction of the heater 2000. The conductor 2001 is separated into three conductors 2001*a*, 2001*b*, and 2001*c* in the longitudinal direction of the heater 2000, and the conductor 2002 is separated into three conductors 2002*a*, 2002*b*, and 2002*c* in the longitudinal direction of the heater 2000. Electrodes E1, E2, E3, and E4 connected to the conductors 2001, 2002, and 2003 are disposed outside a recording material passage area. Also in the heater 2000, the direction in which current flows through the heating elements 2004 and 2005 is parallel to the recording material conveyance direction. A second layer of the sliding surface (surface protective layer 2012) is an insulating glass layer for protecting the conductors 2001 and 2002 and the heating elements 2004 and 2005 and improving the capability of being slidably engaged with the film 202. The boundary position between the conductors 2001*a* and 2001*b* and the boundary position between the conductors 2002*a* and 2002*b* may be different in the longitudinal direction of the heater 2000. The boundary position between the conductors 2001*b* and 2001*c* and the boundary position between the conductors 2002*b* and 2002*c* may also be different in the longitudinal direction of the heater 2000.

Twelfth Exemplary Embodiment

Next, a heater and an image heating apparatus configured to suppress or reduce the overheating in the no-media passage portion and also to suppress or reduce harmonics will be described.

Figure 21A:
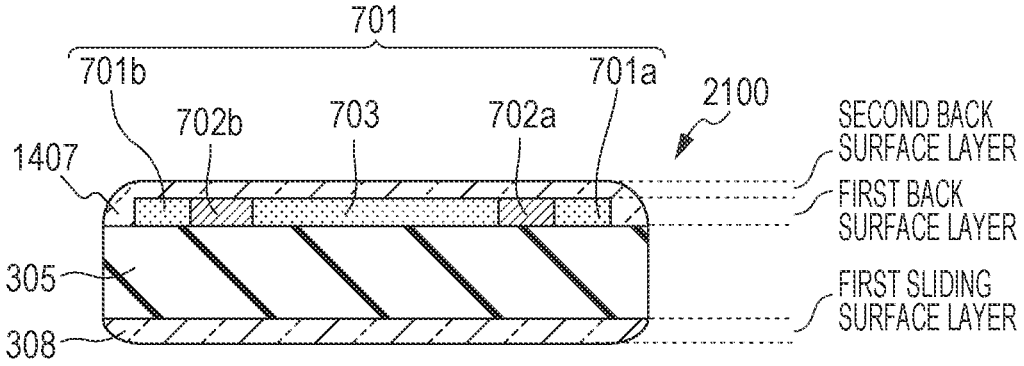
FIG. 21A is a configuration diagram of a heater according to a twelfth exemplary embodiment.
Figure 21B:
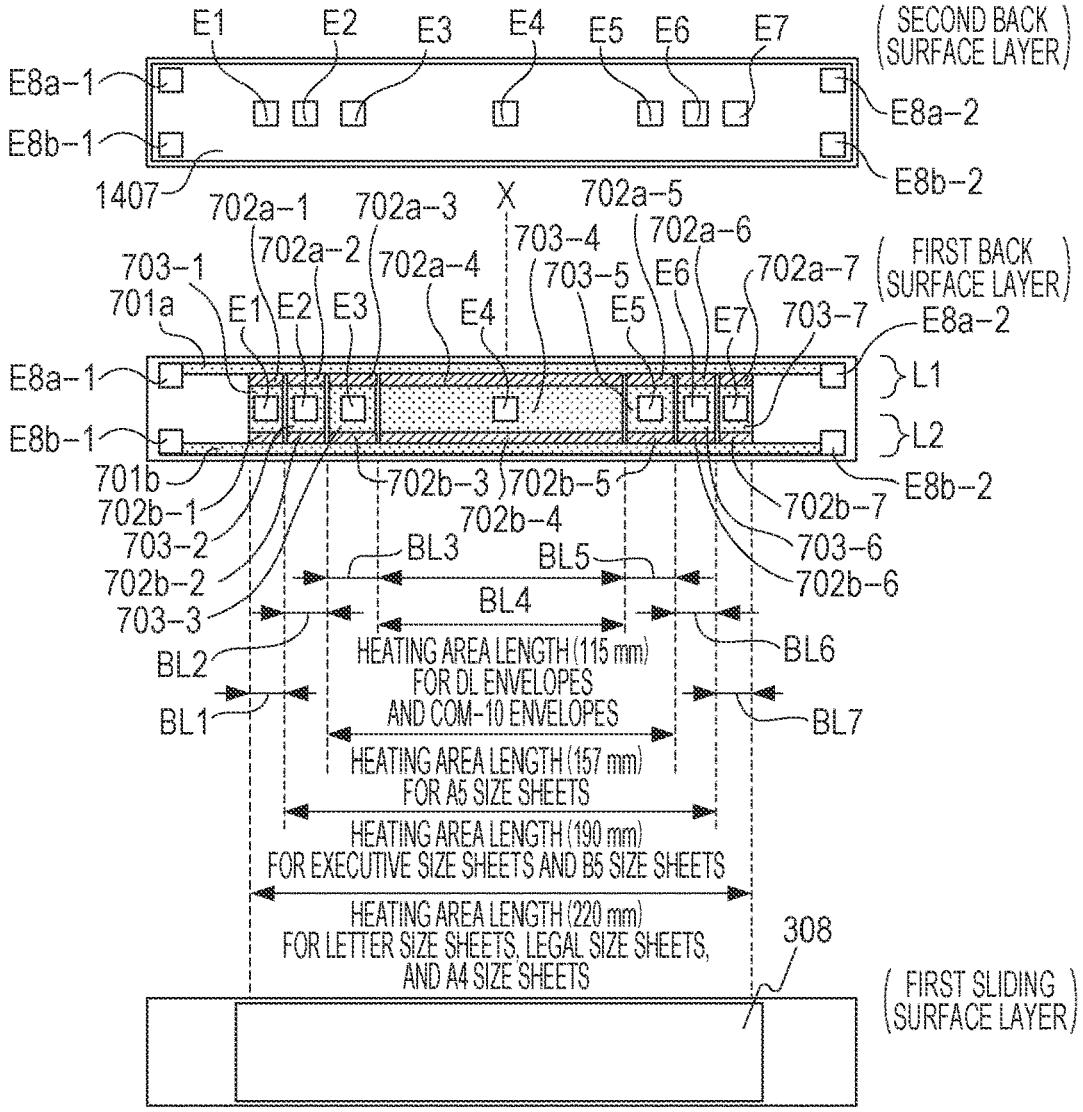
FIG. 21B is a configuration diagram of the heater according to the twelfth exemplary embodiment.
Figure 21C:
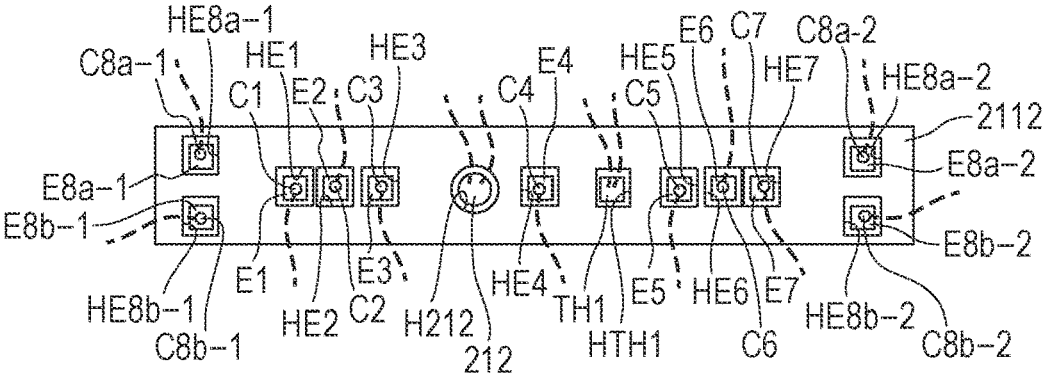
FIG. 21C is a configuration diagram of the heater according to the twelfth exemplary embodiment.

FIGS. 21A to 21C are configuration diagrams of a heater 2100. As illustrated in FIG. 21A, the heater 2100 has a heating element on a ceramic substrate 305 thereof. A thermistor TH1 serving as a temperature sensing element is disposed on the back surface of the substrate 305 in contact with a passage area of the laser printer 100. A safety element 212 activated in response to an abnormal temperature rise in the heater 2100 to shut off the power supply to the heater 2100, such as a thermo-switch and a thermal fuse, is also disposed on the back surface of the substrate 305. A metal stay 204 is disposed to apply the pressure exerted by a spring (not illustrated) to a holding member 2112. Power to the heater 2100 is controlled in accordance with the output of the thermistor TH1 disposed near the center of a media passage portion (i.e., near the conveyance reference position X). The printer 100 according to this exemplary embodiment is configured to convey a recording material in such a manner that the center of the recording material in its widthwise direction is aligned with the reference position X.

The heater 2100 is configured such that the heat generation distribution in the longitudinal direction is switchable in four ways, and an upstream heating element 702*a* and a downstream heating element 702*b* are independently controllable.

FIG. 21A is a cross-sectional view of the heater 2100. FIG. 21B is a plan view of individual layers of the heater 2100. The heater 2100 has the ceramic substrate 305, a first sliding surface layer that comes into contact with the endless belt 202, a first back surface layer having a heating element and a conductor described below disposed thereon, and a second back surface layer that covers the first back surface layer. The first sliding surface layer has a glass-coated or polyimide-coated surface protective layer 308. The second back surface layer has an insulating (in this exemplary embodiment, glass) surface protective layer 1407.

The first back surface layer on the substrate 305 has a first conductor 701 (701*a* and 701*b*) extending in the longitudinal direction of the heater 2100. The first back surface layer also has a second conductor 703 (703-1 to 703-7) at a different position from the position of the first conductor 701 in the transverse direction of the heater 2100 so as to extend in the longitudinal direction of the heater 2100. The first conductor 701 is separated into a conductor 701*a* located upstream and a conductor 701*b* located downstream in the conveyance direction of the recording material P.

The first back surface layer also has a heating element 702 disposed thereon between the first conductor 701 and the second conductor 703 for generating heat by power supplied via the first conductor 701 and the second conductor 703. The heating element 702 is separated into a heating element 702*a* (702*a*-1 to 702*a*-7) located upstream and a heating element 702*b* (702*b*-1 to 702*b*-7) and located downstream in the conveyance direction of the recording material P. The heating element 702 has a positive temperature coefficient of resistance. Due to the positive temperature coefficient of resistance, even if an end of a recording material in its widthwise direction travels through part of one heating block (described below), the overheating in a no-media passage portion may be suppressed or reduced.

The first layer back surface has a plurality of heating blocks disposed thereon in the longitudinal direction of the heater 2100. Each of the plurality of heating blocks includes the first conductor 701*a*, the second conductor 703 (703-1 to 703-7), and the heating element 702*a* (702*a*-1 to 702*a*-7). The sequence of heating block is referred to as a first heating block line L1. The first layer back surface also has a plurality of heating blocks disposed thereon in the longitudinal direction of the heater 2100. Each of the plurality of heating blocks includes the first conductor 701*b*, the second conductor 703 (703-1 to 703-7), and the heating element 702*b* (702*b*-1 to 702*b*-7). The sequence of heating blocks is referred to as a second heating block line L2. In the heater 2100 according to this exemplary embodiment, each of the first heating block line L1 and the second heating block line L2 includes seven heating blocks (BL1 to BL7).

Electrodes E8*a*-1, E8*a*-2, E8*b*-1, and E8*b*-2 are disposed at ends of the heater 2100 in its longitudinal direction. The electrodes E8*a*-1 and E8*a*-2 are electrodes for feeding electric power to the heating elements 702*a*-1 to 702*a*-7 of the first heating block line L1 via the first conductor 701*a*. The electrodes E8*b*-1 and E8*b*-2 are electrodes for feeding electric power to the heating elements 702*b*-1 to 702*b*-7 of the second heating block line L2 via the first conductor 701*b*. Electrodes E1 to E7 are electrodes common to the first heating block line L1 and the second heating block line L2. As illustrated in FIG. 21B, the electrodes E1 to E7 are disposed in an area where the heating elements 702*a*-1 to 702*a*-7 and 702*b*-1 to 702*b*-7 are disposed in the longitudinal direction of the heater 2100.

The surface protective layer 1407 is formed to have openings at positions corresponding to the electrodes E1 to E7, E8*a*-1, E8*a*-2, E8*b*-1 and E8*b*-2. Thus, each of the electrodes E1 to E7, E8*a*-1, E8*a*-2, E8*b*-1 and E8*b*-2 can be connected to an electrical contact for power supply from the back surface side of the heater 2100.

As illustrated in FIG. 21C, the holding member 2112 has holes HTH1, H212, HE1 to HE7, HE8*a*-1, HE8*a*-2, HE8*b*-1, and HE8*b*-2 for the thermistor (temperature sensing element) TH1, the safety element 212, such as a thermo-switch or a thermal fuse, and the electrodes E1 to E7, E8*a*-1, E8*a*-2, E8*b*-1, and E8*b*-2, respectively. The temperature sensing element TH1, the safety element 212, and the electrical contacts that come into contact with the electrodes E1 to E7, E8*a*-1, E8*a*-2, E8*b*-1, and E8*b*-2 are disposed between the stay 204 and the holding member 2112. The electrical contacts are represented by C1 to C7, C8*a*-1, C8*a*-2, C8*b*-1, and C8*b*-2. In FIG. 21C, broken lines connected to the electrical contacts C1 to C7, C8*a*-1, C8*a*-2, C8*b*-1, and C8*b*-2 and broken lines connected to the safety element 212 indicate power feed cables (AC lines). Further, broken lines connected to the temperature sensing element TH1 indicates a signal line (DC line). Since the electrodes E1 to E7 are disposed in an area where the heating elements 702*a*-1 to 702*a*-7 and 702*b*-1 to 702*b*-7 are disposed in the longitudinal direction of the heater 2100, an increase in the size of the image heating apparatus 200 may be avoided although the number of electrodes is large.

Figure 22:
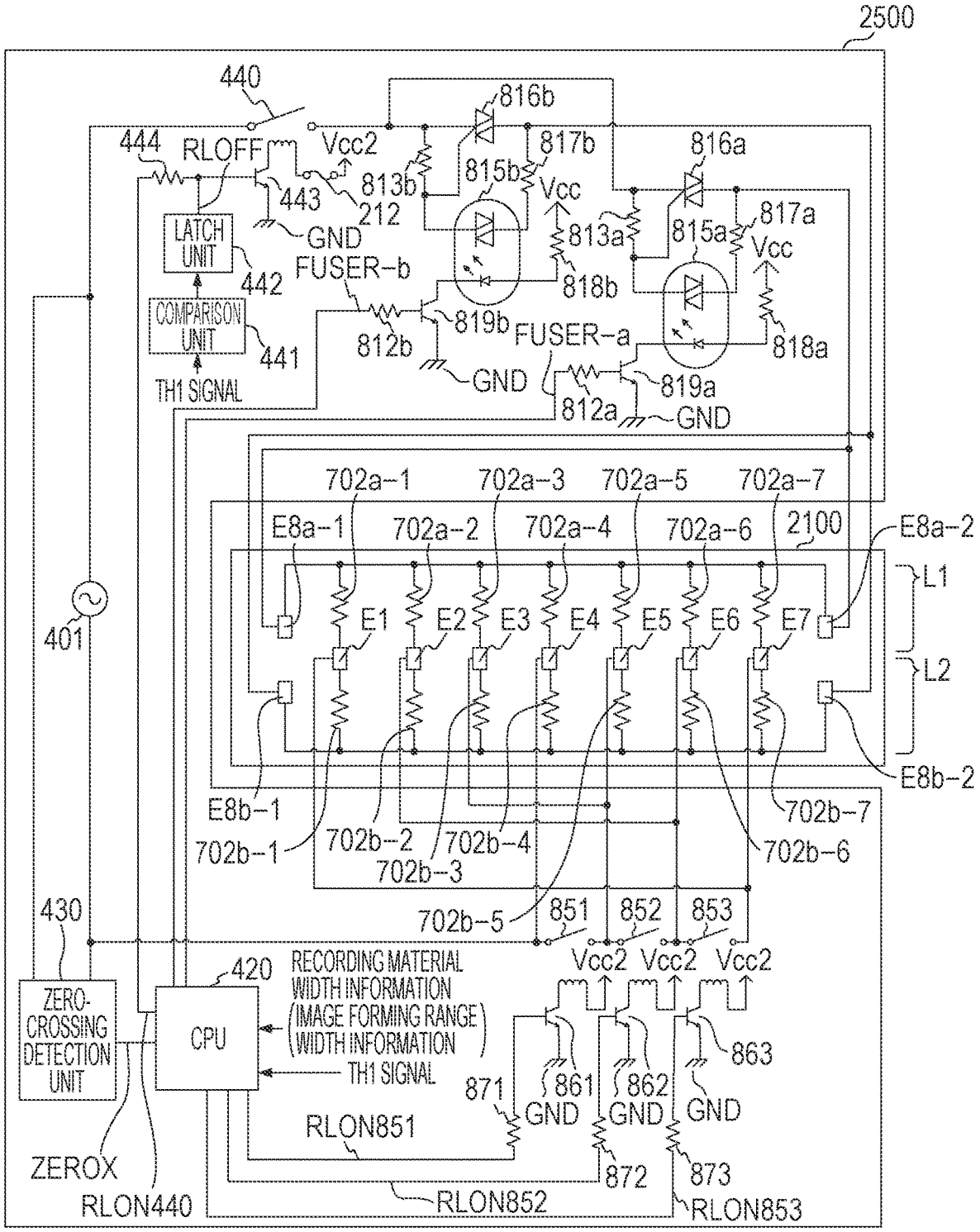
FIG. 22 is a circuit diagram of a control circuit for the heater according to the twelfth exemplary embodiment.

FIG. 22 illustrates a control circuit 2500 for the heater 2100. The control circuit 2500 is capable of switching the heat generation distribution in the longitudinal direction of the heater 2100 by using three relays 851 to 853. In addition, two triacs 816*a* and 816*b* are independently driven to reduce the harmonic currents or reduce flicker. The operation of the control circuit 2500 will be described hereinafter.

A commercial AC power supply 401 is provided. A zero-crossing detection unit 430 is a circuit for detecting the zero-crossing of the AC power supply 401, and outputs a ZEROX signal to the CPU 420. The ZEROX signal is used to control the heater 2100. A relay 440 is used as a power shutoff unit for interrupting the supply of power to the heater 2100. The relay 440 is activated in accordance with the output from the thermistor TH1 (to shut off power supply to the heater 2100) in response to an excessive rise in the temperature of the heater 2100 due to failure or the like.

When an RLON440 signal is high, a transistor 443 is turned on, causing the secondary coil of the relay 440 to conduct current from a power supply Vcc2 to turn on the primary contact of the relay 440. When the RLON440 signal is low, the transistor 443 is turned off, blocking the current flow to the secondary coil of the relay 440 from the power supply Vcc2 to turn off the primary contact of the relay 440. A resistor 444 is a current limiting resistor.

Next, the operation of a safety circuit that includes the relay 440 will be described. If the sensing temperature (TH1 signal) obtained by the thermistor TH1 exceeds a predetermined value, the comparison unit 441 activates the latch unit 442, and the latch unit 442 latches an RLOFF signal at a low level. When the RLOFF signal is low, the transistor 443 is maintained in an off condition even if the CPU 420 sets the RLON440 signal high. Thus, the relay 440 is maintained in an off condition (or safe condition). Further, power to the secondary coil of the relay 440 is fed via the safety element 212. Accordingly, in response to an excessive rise in the temperature of the heater 2100 due to failure or the like, the safety element 212 is activated to shut off power supply to the secondary coil of the relay 440, thereby turning off the primary contact of the relay 440.

If the sensing temperature obtained by the thermistor TH1 does not exceed the predetermined value, the RLOFF signal of the latch unit 442 becomes open. Thus, the CPU 420 sets the RLON440 signal high, thereby turning on the relay 440 to enable power supply to the heater 2100.

Next, the operation of a circuit for driving the triac 816*a* will be described. The triac 816*a* is disposed in a power supply path to the first heating block line L1. Resistors 813*a* and 817*a* are bias resistors for the triac 816*a*, and a phototriac coupler 815*a* is a device for ensuring a primary-secondary creepage distance. A light-emitting diode of the phototriac coupler 815*a* is caused to conduct current to turn on the triac 816*a*. A resistor 818*a* is a resistor for limiting the current flow through the light-emitting diode of the phototriac coupler 815*a* from the power supply Vcc, and the phototriac coupler 815*a* is turned on or off by a transistor 819*a*. The transistor 819*a* operates in accordance with a FUSER-a signal sent from the CPU 420 via a current limiting resistor 812*a*.

The operation of a circuit for driving the triac 816*b* is substantially the same as that of the circuit for driving the triac 816*a*, and is not described herein. The triac 816*b* is disposed in a power supply path to the second heating block line L2.

Next, switching of the heat generation distribution in the longitudinal direction of the heater 2100 will be described. In this exemplary embodiment, the relays 851 to 853 are controlled to select a heating block to which power is to be supplied from among a plurality of heating blocks. That is, all of the heating blocks may be supplied with power or only some of them may be supplied with power.

The relays 851 to 853 operate in accordance with an RLON851 signal, an RLON852 signal, and an RLON853 signal (hereinafter referred to as the "RLON851 to RLON853 signals") from the CPU 420. When the RLON851 to RLON853 signals are high, transistors 861 to 863 are turned on, causing the secondary coil of the relays 851 to 853 to conduct current from the power supply Vcc2 to turn on the primary contact of the relays 851 to 853. When the RLON851 to RLON853 signals are low, the transistors 861 to 863 are turned off, blocking the current flow to the secondary coil of the relays 851 to 853 from the power supply Vcc2 to turn off the primary contact of the relays 851 to 853. Resistors 871 to 873 are current limiting resistors.

Next, the relationship between the relays 851 to 853 and the heat generation distribution in the longitudinal direction of the heater 2100 will be described. When all of the relays 851 to 853 are in an off state, the heating block BL4 is supplied with power. Then, a portion having a width of 115 mm illustrated in FIG. 21B generates heat, yielding a heat generation distribution for DL envelopes and COM-10 envelopes. When the relay 851 is in an on state and the relays 852 and 853 are in an off state, the heating blocks BL3 to BL5 can be supplied with power. Then, a portion having a width of 157 mm illustrated in FIG. 21B generates heat, yielding a heat generation distribution for A5 size sheets. When the relays 851 and 852 are in an on state and the relay 853 is in an off state, the heating blocks BL2 to BL6 can be supplied with power. Then, a portion having a width of 190 mm illustrated in FIG. 21B generates heat, yielding a heat generation distribution for executive size sheets and B5 size sheets. When all of the relays 851 to 853 are in an on state, the heating blocks BL1 to BL7 can be supplied with power. Then, a portion having a width of 220 mm illustrated in FIG. 21B generates heat, yielding a heat generation distribution for letter size sheets, legal size sheets, and A4 size sheets. In the manner described above, the control circuit 2500 according to this exemplary embodiment controls the three relays 851 to 853 in accordance with recording material width information (or information on the width of the area where an image is to be formed) input to the CPU 420, enabling the selection of heat generation distributions in four ways (heat generation widths). Accordingly, a block to generate heat is selected in accordance with the size of the recording material, suppressing heat from generated in an area in the heater 2100 through which the recording material does not pass. In this exemplary embodiment, furthermore, each heating element has a positive temperature coefficient of resistance. Thus, even if an end of the recording material in its widthwise direction passes through an area corresponding to one heating block, rather than a boundary between adjacent heating blocks, the portion of the heating block that falls outside the end of the recording material may be suppressed from generating heat. The individual heating elements may not necessarily have a positive temperature coefficient of resistance, and it may be sufficient that the individual heating elements have a temperature coefficient of resistance of resistor greater than or equal to zero.

As described above, the triac 816*a* is disposed in a power supply path to the first heating block line L1. Accordingly, by controlling turning on or off of the triac 816*a*, it is possible to control power supply to a heating element block corresponding to the selected heat generation width within the first heating block line L1. Also, by controlling turning on or off of the triac 816*b*, it is possible to control power supply to a heating element block corresponding to the selected heat generation width within the second heating block line L2.

Next, a method for controlling the temperature of the heater 2100 will be described. The temperature sensed by the thermistor TH1 is input to the CPU 420 as a TH1 signal. The CPU (control unit) 420 calculates the power to be supplied (control level) based on the sensing temperature of the thermistor TH1 and the control target temperature of the heater 2100 in accordance with, for example, PI control. Further, the CPU 420 transmits a FUSER-a signal and a FUSER-b signal so that the current to flow through the heater 2100 is equal to the phase angle or wave number corresponding to the calculated control level, thereby controlling the triacs 816*a* and 816*b*, respectively.

Figure 23A:
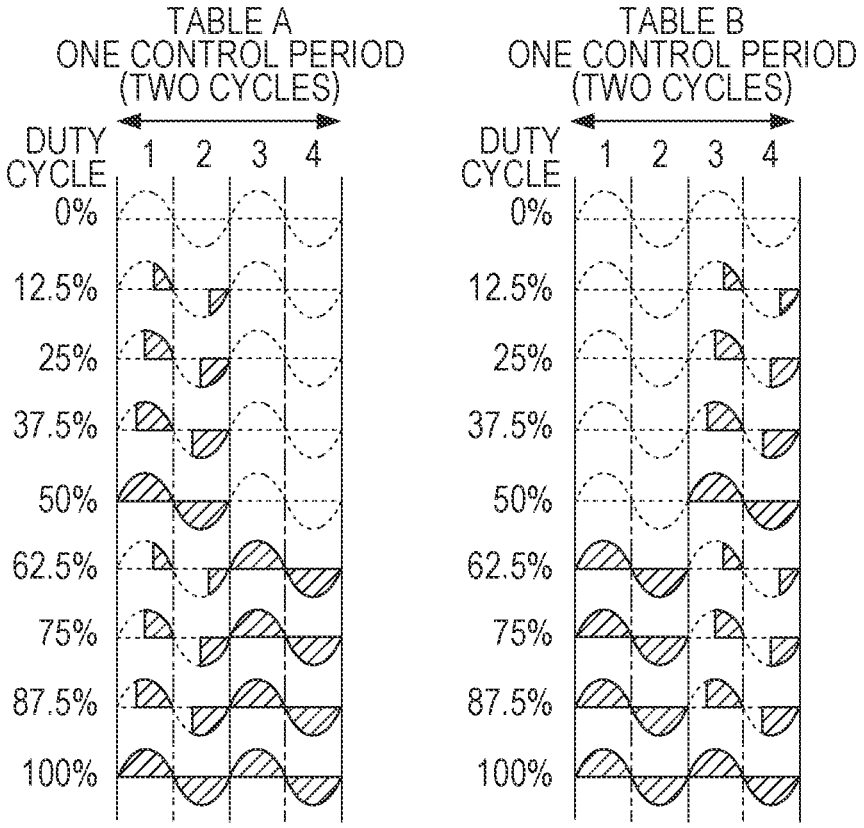
FIG. 23A illustrates heater control tables according to the twelfth exemplary embodiment.

FIG. 23A illustrates the waveform of the current (t) flowing through heating elements in the first heating block line L1 using the triac 816*a*, and the waveform of the current (table B) flowing heating elements in the second heating block line L2 using the triac 816*b*. The first half-wave of the t and the first half-wave of the table B are in-phase half-waves. The same applies to the half-waves of the other numbers. The tables A and B (the relationships between of the duty cycles and the waveforms) are set in the CPU 420. The duty cycle is the percentage of ON period in one control period. The CPU 420 drives the triacs 816*a* and 816*b* so that the sensing temperature TH1 is equal to a control target temperature. Further, the CPU 420 sets a duty cycle per control period in accordance with the sensing temperature TH1, where the control period is a period taken to update the control and is four consecutive half-waves (two cycles) of the AC waveform. As illustrated in FIG. 23A, each of the two tables shows a waveform including both a phase control waveform and a wave-number control waveform within one control period. The phase control waveform is a waveform in which part of a half-wave is turned on, and the wave-number control waveform is a waveform in which the whole of a half-wave is turned on. Since the waveforms include both a phase control waveform and a wave-number control waveform within one control period, harmonics and flicker may be suppressed or reduced. In control periods having the same phase, the FUSER-a signal and the FUSER-b signal are signals having the same duty cycle. For example, in a case where the control level (duty cycle) calculated in accordance with the sensing temperature is 50%, current having the waveform with a 50% duty cycle in the table A flows through heating elements in the first heating block line L1, and current having the waveform with a 50% duty cycle in the table B flows through heating elements in the second heating block line L2.

As described above, each of the heating blocks BL1 to BL7 includes a plurality of heating elements (in this exemplary embodiment, two heating elements) in the transverse direction of the heater 2100 (the substrate 305), and a plurality of heating elements in each heating block are also independently controllable.

Next, the effect of independently controlling the first heating block line L1 and the second heating block line L2 will be described. For simplicity of description, it is assumed that the combined resistance of the heating elements 702*a*-1 to 702*a*-7 of the first heating block line L1 is 20 ohms, the combined resistance of the heating elements 702*b*-1 to 702*b*-7 of the second heating block line L2 is 20 ohms, and the total resistance of the heater 2100 is 10 ohms. Furthermore, the effective voltage value of the AC power supply 401 is 100 Vrms.

First, a description will be given of the case of a duty cycle of 25%. In the t for the triac 816*a*, the first two half-waves are controlled with a phase angle of 90 degrees to supply 50% power, and the second two half-waves are switched off. Accordingly, heating elements in a heating block selected by a relay from within the first heating block line L1 are supplied with 25% power on average. Also, in the table B for the triac 816*b*, the first two half-waves are switched off and the second two half-waves are controlled with a phase angle of 90 degrees to supply 50% power. Accordingly, heating elements in a heating block selected by a relay from within the second heating block line L2 are supplied with 25% power on average. Therefore, 25% power is supplied to the heater 2100 as a whole. As can be understood with reference to FIG. 23A, the t and the table B are set so as to prevent current having a phase control waveform from flowing through the first heating block line L1 and the second heating block line L2 during in-phase half-waves. That is, the control unit 420 performs control so that current having a phase control waveform does not flow through a plurality of heating elements in one heating block at the same timing. The waveform in the table B illustrated in FIG. 23A is a waveform whose phase is shifted from the waveform in the t by one cycle, resulting in no phase control waveforms overlapping in the two tables. Setting the relationship between the tables A and B in the way described above prevents current having a phase control waveform from flowing through the first heating block line L1 and the second heating block line L2 during in-phase half-waves.

As described above, a waveform including both a phase control waveform and a wave-number control waveform within one control period allows a reduction in harmonics and flicker. In this exemplary embodiment, furthermore, current having a phase control waveform is not caused to flow through the first heating block line L1 and the second heating block line L2 at the same time during in-phase half-waves, which would further reduce harmonics. Degradation of harmonic current occurs because current having a phase control waveform having a large amplitude flows. Note that, when a wave-number control waveform and a phase control waveform overlaps, degradation of harmonic current is not greater than when phase control waveforms overlap. Since a wave-number control waveform is a waveform that does not cause degradation of harmonic current, degradation of harmonic current does not also occur when wave-number control waveforms overlap.

Figure 23B:
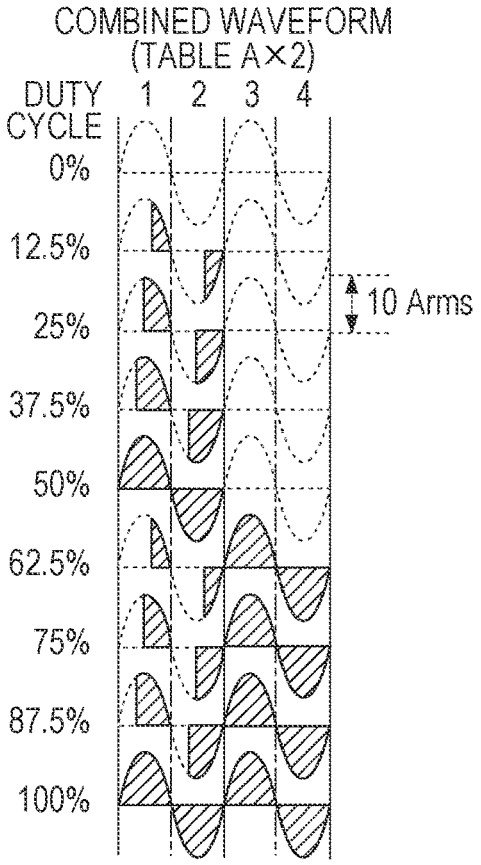
FIG. 23B illustrates a heater control table according to the twelfth exemplary embodiment.
Figure 23C:
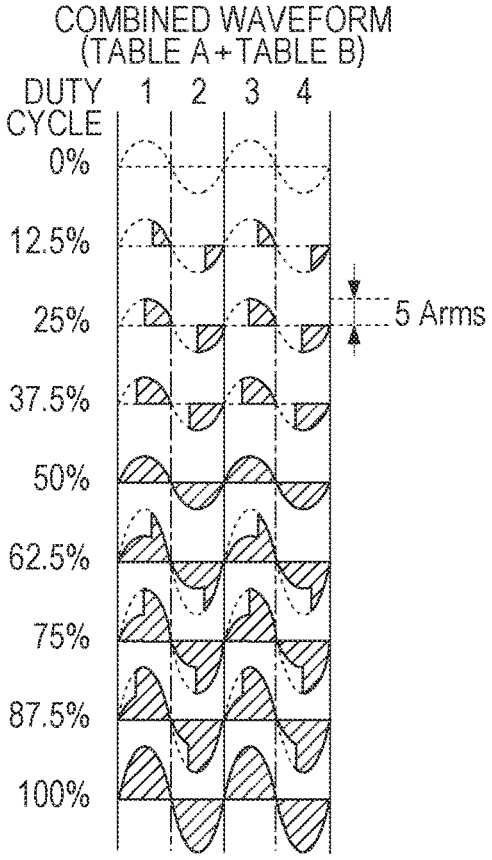
FIG. 23C illustrates a heater control table according to the twelfth exemplary embodiment.

As described above, the combined resistance of heating elements in each of the first and second heating block lines L1 and L2 is 20 ohms, and the effective voltage value of the AC power supply 401 is 100 Vrms. The current flowing through each heating element has a waveform obtained by controlling a sine wave having an effective current value of 5 Arms, and the phase control waveform of current flowing through each heating element is also a waveform obtained through the phase control of a sine wave having an effective current value of 5 Arms. As described above, furthermore, current having a phase control waveform is not caused to flow through the first heating block line L1 and the second heating block line L2 during in-phase half-waves. Thus, within the combined waveform of the current flowing through the first heating block line L1 and the current flowing through the second heating block line L2, a half-wave only for a phase control waveform has a waveform obtained through phase control of a sine wave having an effective current value of 5 Arms (see FIG. 23C).

In a heater configured such that the first heating block line L1 and the second heating block line L2 are not independently controllable, similarly to this exemplary embodiment, the phase control waveform of current flowing through each heating element is a waveform obtained through phase control of a sine wave having an effective current value of 5 Arms. During in-phase half-waves, however, current having a phase control waveform flows through the first heating block line L1 and the second heating block line L2. Thus, within the combined waveform of the current flowing through the first heating block line L1 and the current flowing through the second heating block line L2, a half-wave only for a phase control waveform has a waveform obtained through phase control of a sine wave having an effective current value of 10 Arms, which will reduce the harmonic reducing effect (see FIG. 23B).

In the manner described above, independently controlling the first heating block line L1 and the second heating block line L2 can reduce the peak current value or the variation in current value, and can suppress or reduce harmonic or flicker.

For the other duty cycles, independently controlling the first heating block line L1 and the second heating block line L2 can reduce the peak current value or the variation in current value. For example, for a duty cycle of 75%, a the variation in current value caused by controlling the triacs 816*a* and 816*b* with a phase angle of 90 degrees can be reduced. In this way, the harmonic current and flicker can be reduced.

A reduction in the harmonic current and flicker allows the harmonic current and flicker standards to be met even if the total resistance of the heater 2100 is set low. A reduction in the total resistance of the heater 2100 can increase the maximum power that can be supplied from the AC power supply 401 to the heater 2100.

As described above, the heater 2100 according to this exemplary embodiment includes a plurality of independently controllable heating blocks in the longitudinal direction thereof, each of the independently controllable heating blocks including a first conductor, a second conductor, and a heating element. Each heating block includes a plurality of heating elements in the transverse direction of the substrate 305, and a plurality of heating elements in each heating block are also independently controllable. This enables the heat generation distribution in the longitudinal direction of the heater 2100 to be controlled in a plurality of ways, and also enables a reduction in harmonic current and flicker. In addition, in addition to the effect of reducing the overheating in the no-media passage portion of the heater 2100, the warm-up time required by the image heating apparatus 200 (to increase the temperature of the image heating apparatus 200 to a temperature at which fixing occurs) may also be reduced.

Thirteenth Exemplary Embodiment

Figure 24:
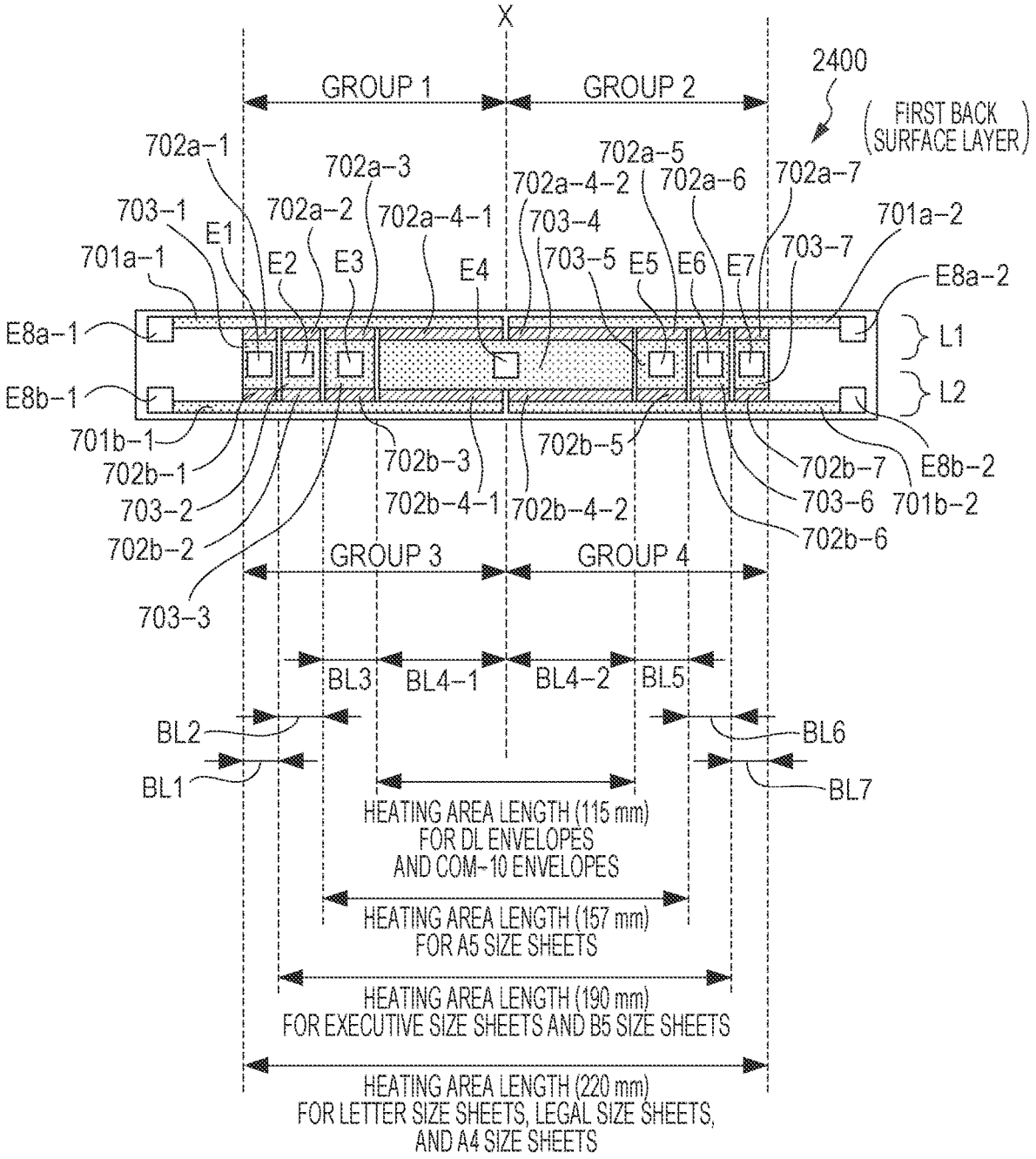
FIG. 24 is a configuration diagram of a heater according to a thirteenth exemplary embodiment.

FIG. 24 is a configuration diagram of a heater 2400. Components similar to those in the twelfth exemplary embodiment are assigned the same numerals and are not described herein.

Similarly to the twelfth exemplary embodiment, the heater 2400 is also configured to make the heat generation distribution in the longitudinal direction switchable in four ways. The difference from the twelfth exemplary embodiment is that the first and second heating block lines L1 and L2 are each divided into two groups in the longitudinal direction of the heater 2400, so that power supply to four groups in total is independently controllable. The cross section of the heater 2400 and the shape of a holding member that holds the heater 2400 are substantially the same as those in the twelfth exemplary embodiment, and are not illustrated.

The first heating block line L1 includes a left group 1 (702*a*-1 to 702*a*-3, and 702*a*-4-1) and a right group 2 (702*a*-5 to 702*a*-7, and 702*a*-4-2). The second heating block line L2 includes a left group 3 (702*b*-1 to 702*b*-3, and 702*b*-4-1) and a right group 4 (702*b*-5 to 702*b*-7, and 702*b*-4-2). Thus, the heating block BL4 is separated into two segments BL4-1 and BL4-2, and the number of heating blocks in the longitudinal direction of the heater 2400 is eight.

The electrode E8*a*-1 is an electrode for supplying power to the group 1 via the conductor 701*a*-1. The electrode E8*a*-2 is an electrode for supplying power to the group 2 via the conductor 701*a*-2. The electrode E8*b*-1 is an electrode for supplying power to the group 3 via the conductor 701*b*-1. The electrode E8*b*-2 is an electrode for supplying power to the group 4 via the conductor 701*b*-2.

Figure 25:
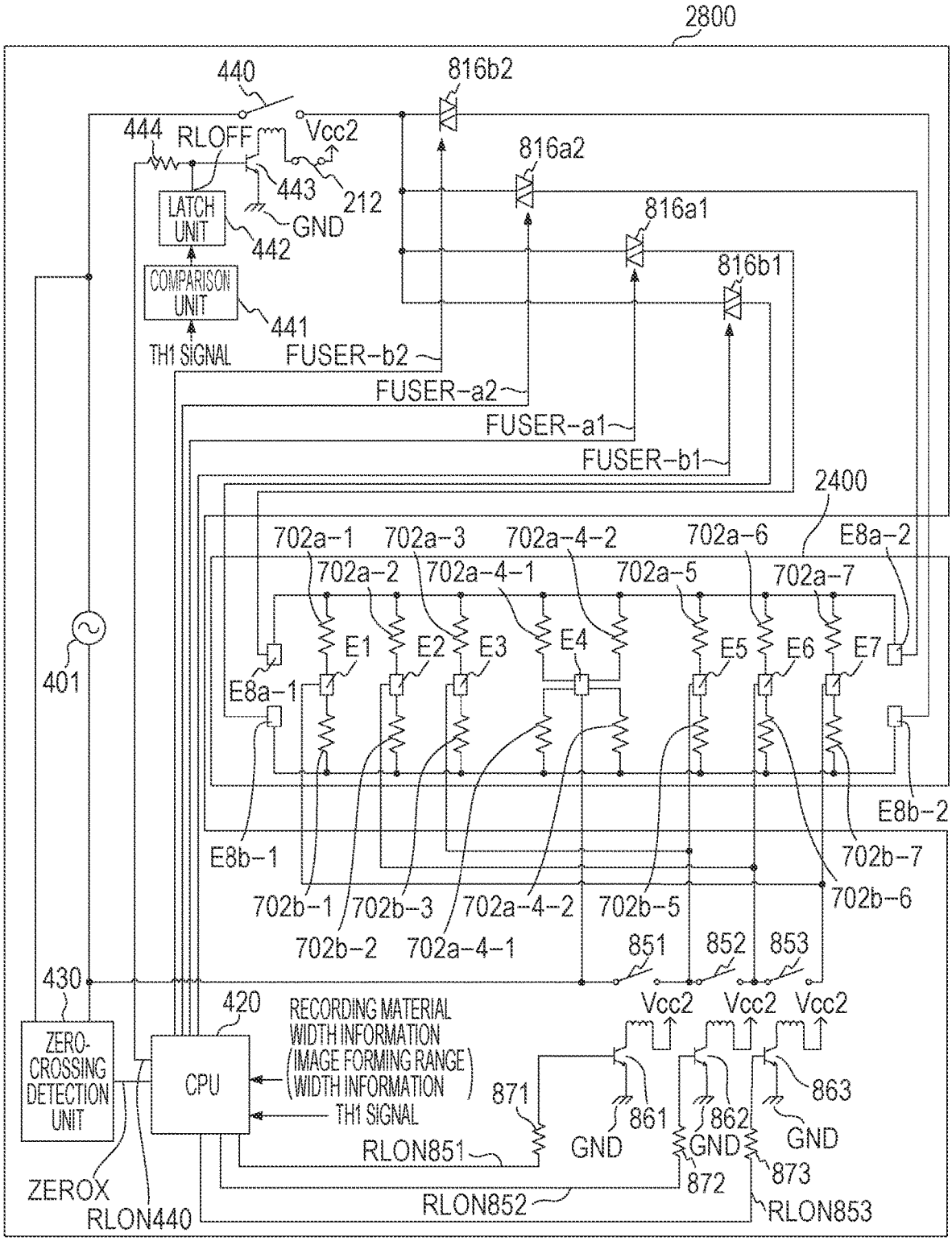
FIG. 25 is a circuit diagram of a control circuit for the heater according to the thirteenth exemplary embodiment.

FIG. 25 illustrates a control circuit 2800 for the heater 2400. In this exemplary embodiment, four triacs 816*a*1, 816*a*2, 816*b*1, and 816*b*2 are used for power control to reduce the harmonic current or reduce flicker. The method for selecting a heating block by using the relays 851 to 853 may be substantially the same as that in the twelfth exemplary embodiment, and is not described herein. The circuit operation of the triacs 816*a*1, 816*a*2, 816*b*1, and 816*b*2 is also substantially the same as that of the triacs 816*a* and 816*b* described in the first exemplary embodiment, and is not described herein. In FIG. 25, circuits for driving the triacs 816*a*1, 816*a*2, 816*b*1, and 816*b*2 are not illustrated.

The triac 816*a*1 is an element for controlling the power to be supplied to heating blocks in the group 1. The triac 816*a*2 is an element for controlling the power to be supplied to heating blocks in the group 2. The triac 816*b*1 is an element for controlling the power to be supplied to heating blocks in the group 3. The triac 816*b*2 is an element for controlling the power to be supplied to heating blocks in the group 4. Driving signals (FUSER-a1, FUSER-a2, FUSER-b1, and FUSER-b2) are transmitted from the CPU 420 to the triacs 816*a*1, 816*a*2, 816*b*1, and 816*b*2, respectively.

Figure 26:
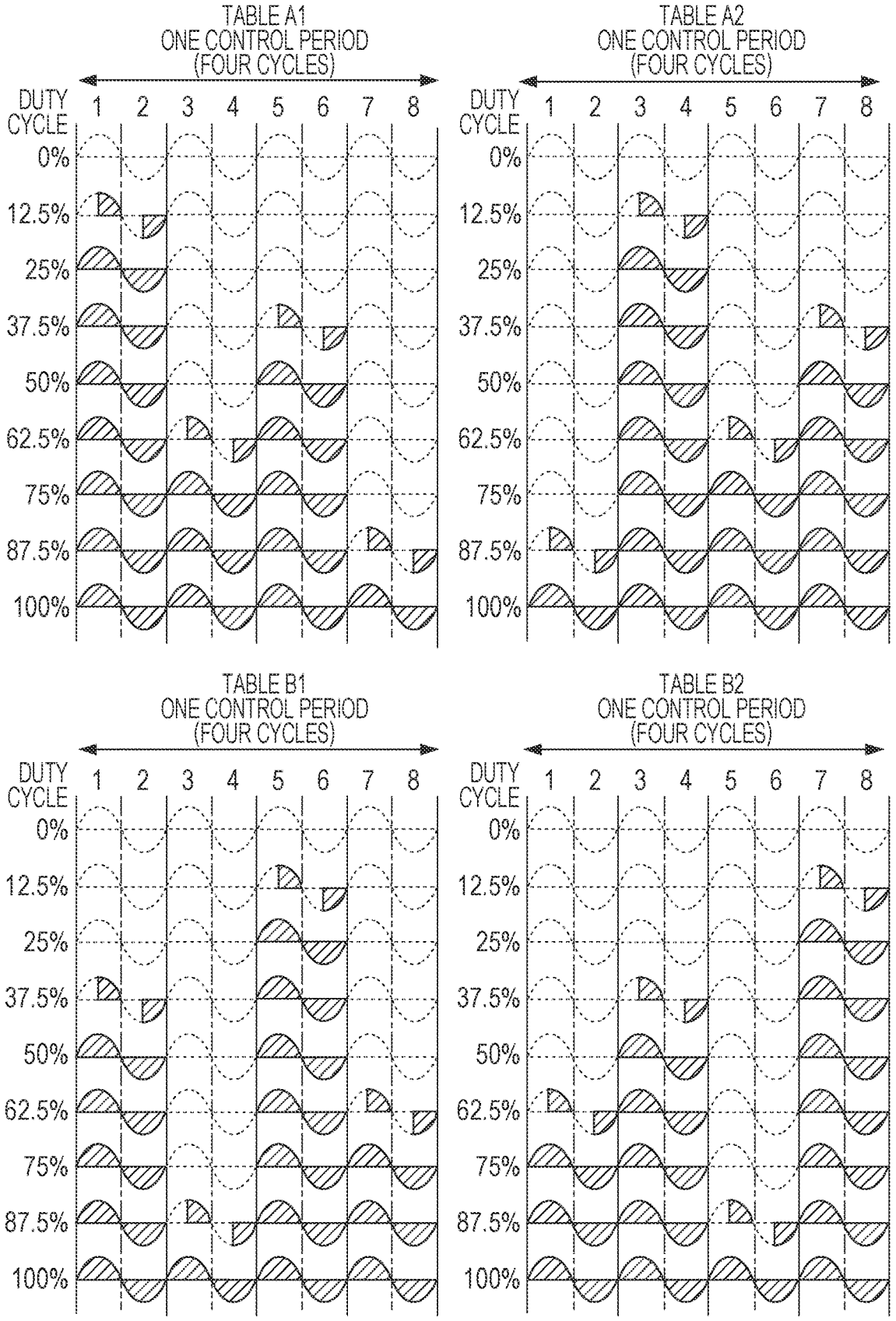
FIG. 26 illustrates heater control tables according to the thirteenth exemplary embodiment.

FIG. 26 illustrates the waveforms of the current (tables) to flow through the four groups. A t1 shows the waveform of the current flowing through heating elements in the group 1 within the first heating block line L1 by using the triac 816*a*1. A t2 shows the waveform of the current flowing through heating elements in the group 2 within the first heating block line L1 by using the triac 816*a*2. A table B1 shows the waveform of the current flowing through heating elements in the group 3 within the second heating block line L2 by using the triac 816*b*1. A table B2 shows the waveform of the current flowing through heating elements in the group 4 within the second heating block line L2 by using the triac 816b2. In the four tables, one control period is eight half-waves (four cycles). Furthermore, the four tables show a waveform including both a phase control waveform and a wave-number control waveform within one control period. Moreover, the four tables are set so as to prevent current having a phase control waveform from flowing through the four groups at the same time during in-phase half-waves. The four tables illustrated in FIG. 26 show waveforms whose phase is shifted by one cycle. Setting the waveforms in the tables prevents current having a phase control waveform from flowing through the four groups at the same time during in-phase half-waves. Similarly to the twelfth exemplary embodiment, in control periods having the same phase, the FUSER-a1 signal, the FUSER-a2 signal, the FUSER-b1 signal, and the FUSER-b2 signal are signals having the same duty cycle.

Next, the effect of independently controlling the four groups will be described. For simplicity of description, it is assumed that the effective voltage value of the AC power supply 401 is 100 Vrms, the combined resistance of each group is 40 ohms, and the total resistance value of the heater 2400 is 10 ohms.

First, a description will be given of the case of a duty cycle of 12.5%, by way of example. In the t1 for the triac 816a1, the first and second half-waves are controlled with a phase angle of 90 degrees to supply 50% power, and the third through eighth half-waves are switched off. Thus, the group 1 is supplied with power with 12.5% on average. In the t2 for the triac 816a2, the third and fourth half-waves are controlled with a phase angle of 90 degrees to supply 50% power, and the other half-waves are switched off. Thus, the group 2 is supplied with power with 12.5% on average. Therefore, the heating element 702a in the first heating block line L1 is supplied with power with 12.5% on average.

Also, in the table B1 for the triac 816b1, the fifth and sixth half-waves are controlled with a phase angle of 90 degrees to supply 50% power, and the other half-waves are switched off. Thus, the group 3 is supplied with power with 12.5% on average. In the table B2 for the triac 816b2, the seventh and eighth half-waves are controlled with a phase angle of 90 degrees to supply 50% power, and the other half-waves are switched off. Thus, the group 4 is supplied with power with 12.5% on average. Therefore, the heating element 702b in the second heating block line L2 is supplied with power with 12.5% on average.

Since the combined resistance of each of the groups 1 to 4 is 40 ohms, the current flowing through heating elements in each group has a waveform obtained through phase control of a sine wave having an effective current value of 2.5 Arms, and the phase control waveform of the current flowing through each heating element is also a waveform obtained through phase control of a sine wave having an effective current value of 2.5 Arms. As described above, current having a phase control waveform is not caused to flow through the four groups during in-phase half-waves. Accordingly, within the combined waveform of the current flowing through the overall heater, a half-wave only for a phase control waveform has a waveform obtained through phase control of a sine wave having an effective current value of 2.5 Arms. For the other duty cycles, independently controlling the four groups can reduce the peak current value or the variation in current value. Thus, harmonic current and flicker may further be reduced compared to the twelfth exemplary embodiment.

In the waveforms illustrated in FIG. 26, subsequently to the group 1 (after one cycle), current flows through the group 2 included in the first heating block line L1, which also includes the group 1. Subsequently to the group 3 (after one cycle), current flows through the group 4 included in the second heating block line L2, which also includes the group 3. This also reduces temperature variations in the longitudinal direction of the heater 2400.

Figure 27:
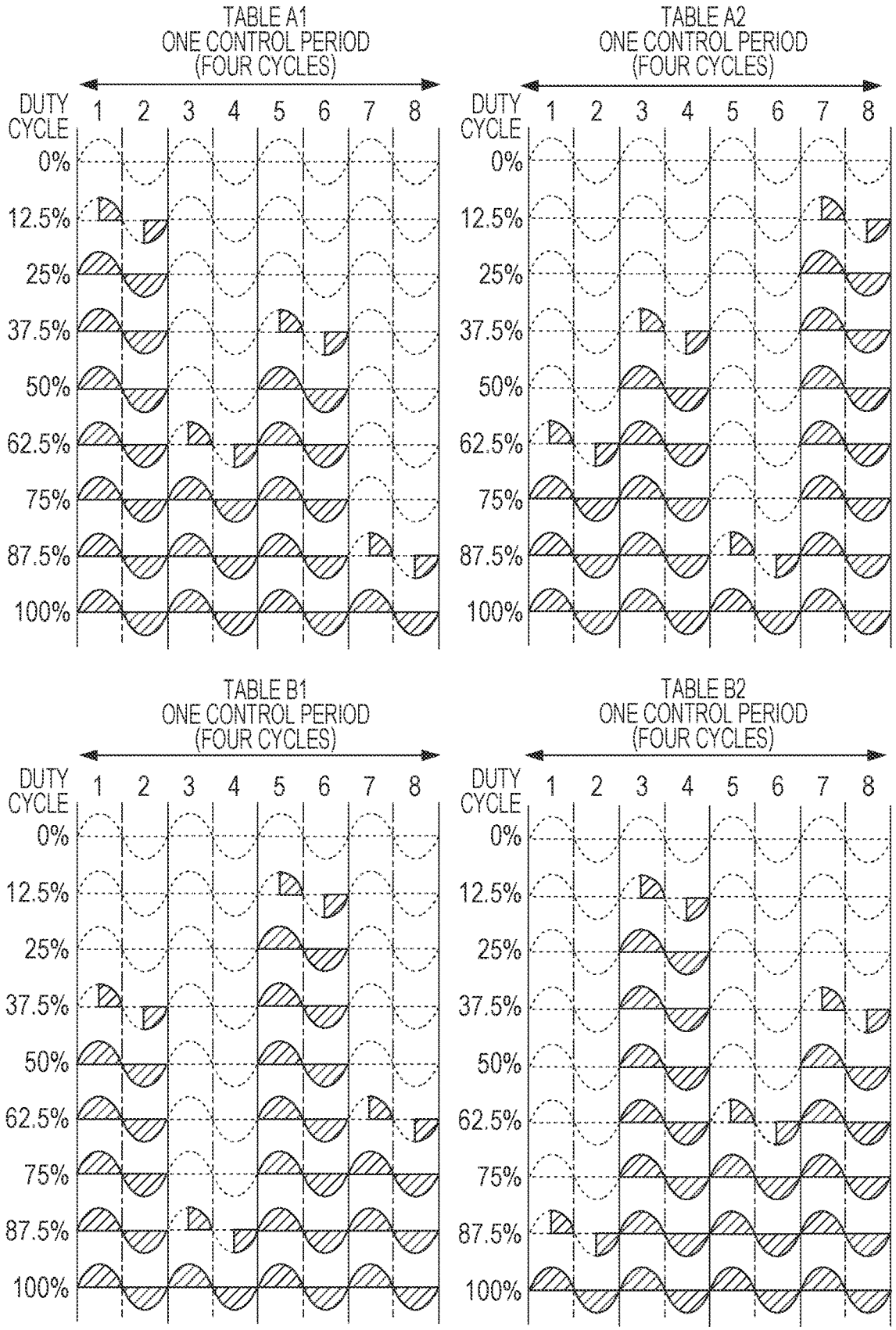
FIG. 27 illustrates heater control tables according to a modification.

Alternatively, as illustrated in FIG. 27, the relationship between the four tables may be such that current flows through the group 1, the group 4, the group 3, and the group 2 in this order.

Figure 28:
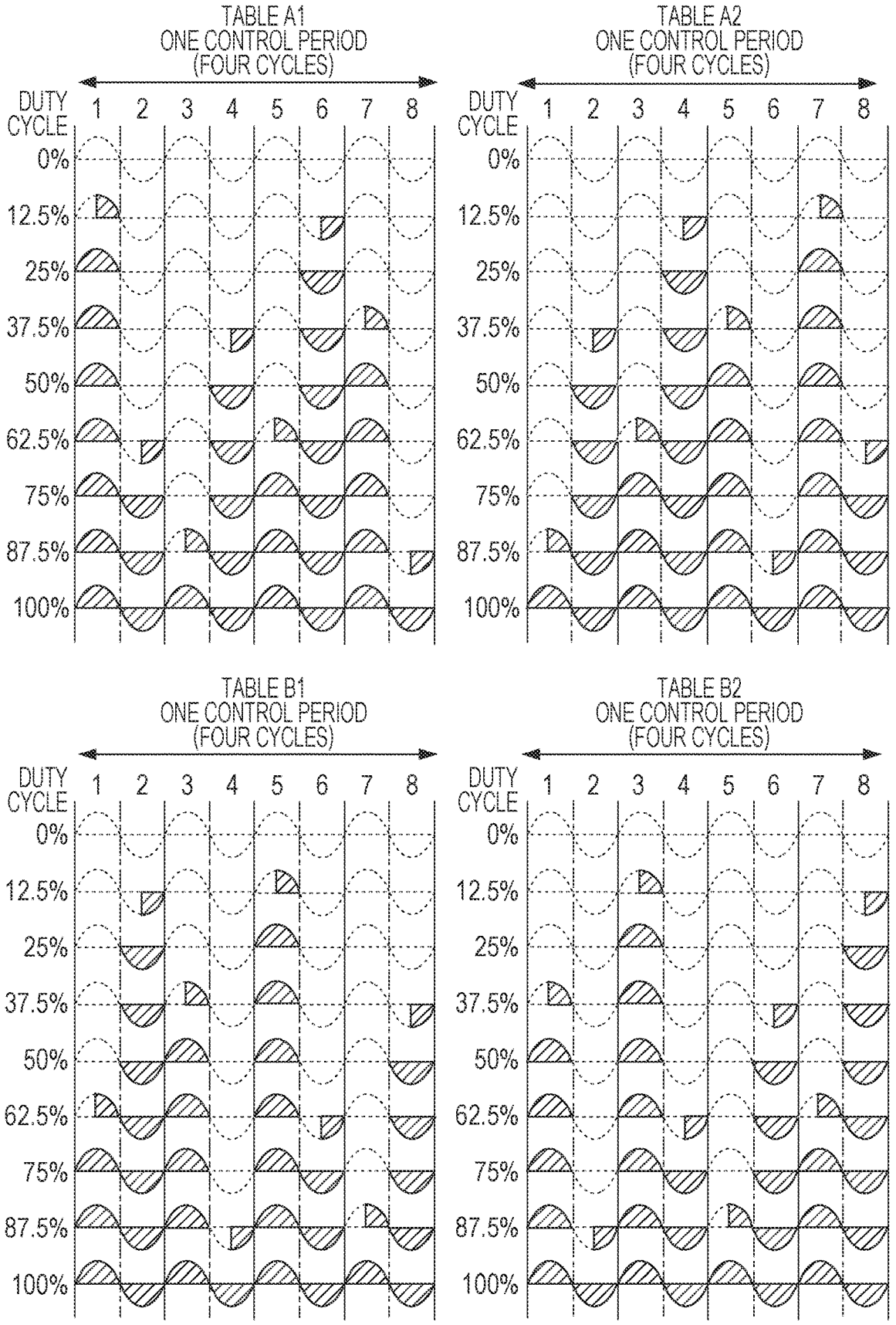
FIG. 28 illustrates heater control tables according to another modification.

Alternatively, as illustrated in FIG. 28, switching between the groups may be controlled every half-wave. Switching between the groups at intervals of a short time period in the manner as illustrated in FIG. 28 can reduce temperature variations in the longitudinal direction and transverse direction of the heater 2400.

The number of heating block lines and the number of groups may be larger than those in this exemplary embodiment.

Fourteenth Exemplary Embodiment

Next, a fourteenth exemplary embodiment will be described. A heater according to the fourteenth exemplary embodiment has substantially the same configuration as that of the heater 700 illustrated in FIGS. 7A to 7C, and is not illustrated herein. The fourteenth and fifteenth exemplary embodiments relate to power supply wires to be connected to a heater.

As illustrated in FIGS. 7A to 7C, the heating blocks BL1 and BL7 are arranged to be symmetrical to each other with respect to the conveyance reference position X of the recording material in the longitudinal direction of the heater 700 (the longitudinal direction of the substrate 305). In this exemplary embodiment, the two heating blocks symmetrical to each other with respect to the conveyance reference position X are referred to as a first heating block and a second heating block. That is, the heating block BL1 is a first heating block, and the heating block BL7 is a second heating block. Also, the heating block BL2 is a first heating block, and the heating block BL6 is a second heating block. Further, the heating block BL3 is a first heating block, and the heating block BL5 is a second heating block. In the manner described above, the heater 700 includes a plurality of sets of heating blocks, each having a first heating block and a second heating block. Note that no heating block is paired with the heating block BL4 located at the conveyance reference position X. In the following description, however, the heating block BL4 is also regarded as one set, for simplicity.

Figure 29:
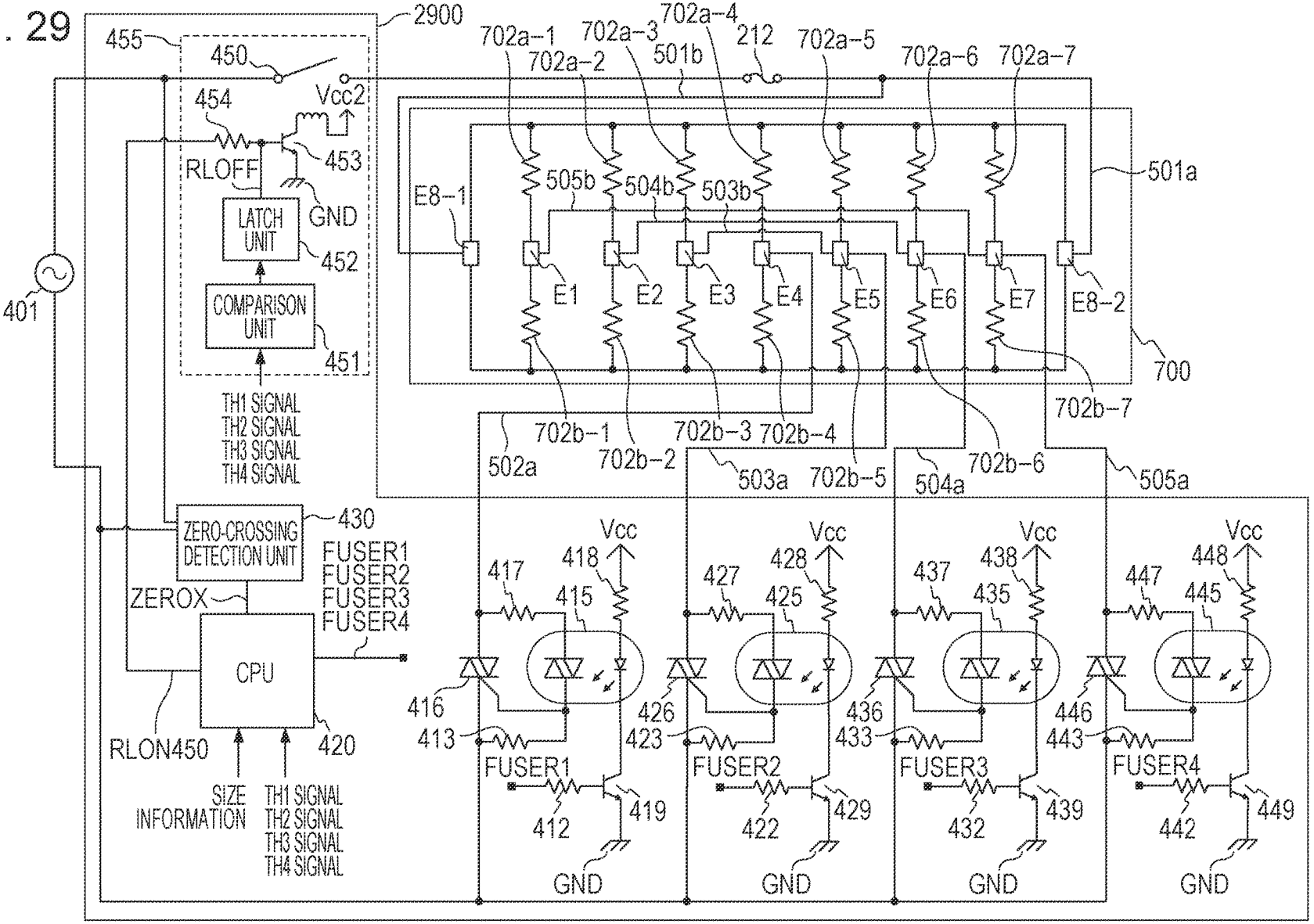
FIG. 29 is a circuit diagram of a control circuit according to a fourteenth exemplary embodiment.

FIG. 29 illustrates a control circuit 2900 for the heater 700. A commercial AC power supply 401 is connected to the laser printer 100. The control circuit 2900 includes four triacs (drive elements) 416, 426, 436, and 446. Each of the triacs 416, 426, 436, and 446 is an element for controlling the power to be supplied to one of the sets of heating blocks. Conducting or non-conducting of each triac allows independent control of the set of heating blocks connected to this triac on a set-by-set basis. The switching between heat generation distributions in the longitudinal direction of the heater 700 may be achieved with a configuration other than the configuration illustrated in FIG. 29 in which a dedicated triac is provided for each set of heating blocks. For example, one or more relays may be used to select sets of heating blocks to be used, and all the selected sets may be controlled by using a single drive element (triac).

The triac 416 is connected to the electrode E4, and is used to control the heating block BL4. The triac 426 is connected to the electrode E5, and is used to control the set of heating blocks BL3 and BL5. The triac 436 is connected to the electrode E6, and is used to control the set of heating blocks BL2 and BL6. The triac 446 is connected to the electrode E7, and is used to control the set of heating blocks BL1 and BL7.

A zero-crossing detection unit 430 is a circuit for detecting the zero-crossing of the AC power supply 401, and outputs a ZEROX signal to the CPU 420. The ZEROX signal is used to control the heater 700.

A relay 450 is used as a power shutoff unit for interrupting the supply of power to the heater 700. The relay 450 is activated in accordance with the output from the thermistors TH1 to TH4 (to shut off power supply to the heater 700) in response to an excessive rise in the temperature of the heater 700 due to failure or the like.

When an RLON450 signal is high, a transistor 453 is turned on, causing the secondary coil of the relay 450 to conduct current from the power supply voltage Vcc2 to turn on the primary contact of the relay 450. When the RLON450 signal is low, the transistor 453 is turned off, blocking the current flow to the secondary coil of the relay 450 from the power supply voltage Vcc to turn off the primary contact of the relay 450. A resistor 454 is a current limiting resistor.

Next, the operation of a safety circuit 455 that includes the relay 450 will be described. If one of the sensing temperatures obtained by the thermistors TH1 to TH4 exceeds a corresponding one of predetermined values that are individually set, a comparison unit 451 activates a latch unit 452, and the latch unit 452 latches an RLOFF signal at a low level. When the RLOFF signal is low, the transistor 453 is maintained in an off condition even if the CPU 420 sets the RLON450 signal high. Thus, the relay 450 is maintained in an off condition (or safe condition).

If none of the sensing temperatures obtained by the thermistors TH1 to TH4 exceeds the predetermined values that are individually set, the RLOFF signal of the latch unit 452 becomes open. Thus, the CPU 420 sets the RLON450 signal high, thereby turning on the relay 450 to enable power supply to the heater 700.

Next, the operation of the triac 416 will be described. Resistors 413 and 417 are bias resistor for the triac 416, and a phototriac coupler 415 is a device for ensuring a primary-secondary creepage distance. A light-emitting diode of the phototriac coupler 415 is caused to conduct current to turn on the triac 416. A resistor 418 is a resistor for limiting the current flow through the light-emitting diode of the phototriac coupler 415 from a power supply voltage Vcc, and the phototriac coupler 415 is turned on or off by a transistor 419. The transistor 419 operates in accordance with a FUSER1 signal from the CPU 420.

When the triac 416 is in its conducting state, power is supplied to the heating elements 702*a*-4 and 702*b*-4.

The circuit operation of the triacs 426, 436, and 446 is substantially the same as that of the triac 416, and is not described herein. The triac 426 operates in accordance with a FUSER2 signal from the CPU 420 to control the power to be supplied to the heating elements 702*a*-5, 702*b*-5, 702*a*-3, and 702*b*-3. The triac 436 operates in accordance with a FUSER3 signal from the CPU 420 to control the power to be supplied to the heating elements 702*a*-6, 702*b*-6, 702*a*-2, and 702*b*-2. The triac 446 operates in accordance with a FUSER4 signal from the CPU 420 to control the power to be supplied to the heating elements 702*a*-7, 702*b*-7, 702*a*-1, and 702*b*-1.

Next, a method for controlling the temperature of the heater 700 will be described. The temperature sensed by the thermistor TH1 located in the area responding to the heating block BL4, which includes the conveyance reference position X, is input to the CPU (control unit) 420 as a TH1 signal. The CPU 420 also receives recording material size information as input to select a set of heating blocks to be caused to generate heat. Further, the CPU 420 calculates the power to be supplied (control level) based on the sensing temperature of the thermistor TH1 and the control target temperature of the heater 700 in accordance with, for example, PI control. The CPU 420 transmits a FUSER signal (any of the FUSER1 to FUSER4 signals) to one of the triacs 416, 426, 436, and 446 associated with the selected set so that the current to flow through the heater 700 is equal to the phase angle or wave number corresponding to the calculated control level.

In this exemplary embodiment, the heater temperature sensed by the thermistor TH1 is used to control the temperature of the heater 700. Alternatively, the thermistor TH1 may be configured to sense the temperature of the film 202, and the temperature of the film 202 may be used to control the temperature of the heater 700.

Figure 30A:
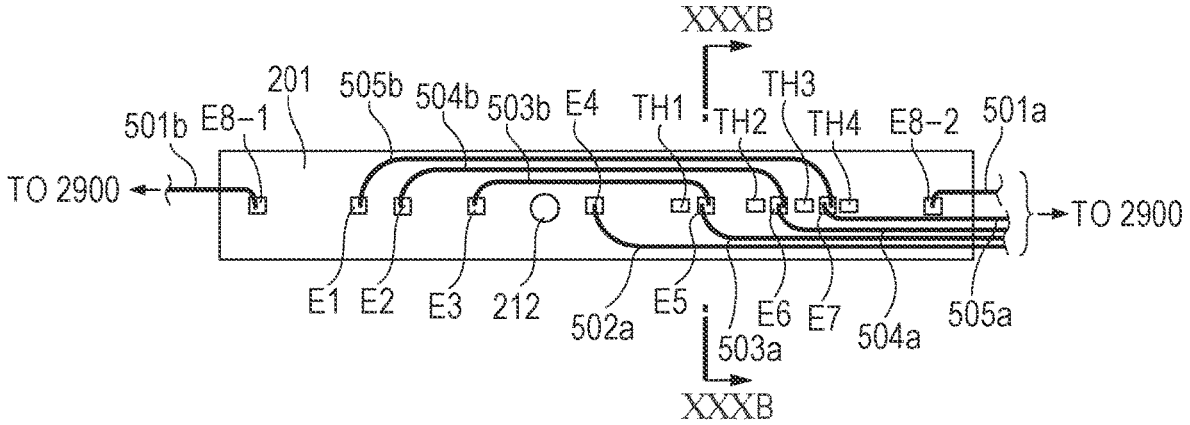
FIG. 30A is a diagram depicting contact portions and wires of a heater according to the fourteenth exemplary embodiment.

Next, the connection configuration of power supply wires will be described. FIG. 30A is a plan view of the holding member 201. As described with reference to FIG. 2, a second layer of the back surface of the heater 700 is beneath the holding member 201 in contact with the holding member 201. The holding member 201 has holes at positions that overlap the electrodes E1 to E7, E8-1, and E8-2 of the heater 700 and at positions which the thermistors TH1 to TH4 are in contact with.

Wires 501*a*, 501*b*, 502*a* to 505*a*, and 503*b* to 505*b* are connected to the control circuit 2900, and are connected to the respective electrodes of the heater 700 through the holes formed in the holding member 201. The electrodes are portions that connect the wires to the corresponding conductors, and may be regarded as part of the conductors.

The image heating apparatus 200 according to this exemplary embodiment includes a first wire for a second heating block, the first wire being connected to a conductor for supplying power to the second heating block. The image heating apparatus 200 further includes a second wire having a first end connected to the conductor, to which the first wire for the second heating block is connected, at a different position from the position at which the first wire is connected, and a second end connected to a second wire for a first heating block, the second wire being connected to a conductor for supplying power to the first heating block. The image heating apparatus 200 is configured such that power is supplied to the first heating block via the conductor to which the first wire for the second heating block is connected and also via the second wire. A specific description will be given hereinafter.

The wire 501*a* is connected to the electrode E8-2, and the wire 501*b* is connected to the electrode E8-1. The wire 502*a* connected to the triac 416 is connected to the electrode E4.

The wire 503*a* (first wire) connected to the triac 426 is connected to the electrode E5, which is an electrode for, within the set of heating blocks BL3 (first heating block) and BL5 (second heating block), the second heating block BL5. That is, the wire 503*a* (first wire) is equivalent to being connected to the conductor 703-5 of the second heating block BL5. The wire 503*b* (second wire) has a first end connected to the electrode E5 for the second heating block BL5, to which the first wire 503*a* is connected, and a second end connected to the electrode E3 for the first heating block BL3. That is, the second wire 503*b* is equivalent to having a first connected to the conductor 703-5 for the second heating block BL5, to which the first wire 503*a* is connected, and a second end connected to the conductor 703-3 for the first heating block BL3. The position at which the second wire 503*b* is connected to the electrode E5 is different from the position at which the first wire 503*a* is connected to the electrode E5. In the manner described above, the second wire 503*b* is connected to the electrode E3 with the electrode E5 acting as a relay node. The temperature sensing element TH2 is located at the position at which the temperature of the second heating block BL5 is sensed, and no temperature sensing element is located at the position corresponding to the first heating block BL3.

The set of heating blocks BL2 and BL6 controlled using the triac 436, and the set of heating blocks BL1 and BL7 controlled using the triac 446 also have a similar wiring configuration to the wiring configuration of the set of heating blocks BL3 and BL5 controlled using the triac 426. Specifically, the second wire 504*b* is connected to the electrode E2 with the electrode E6 acting as a relay node. The second wire 505*b* is connected to the electrode E1 with the electrode E7 acting as a relay node. The temperature sensing element TH3 is placed at the position at which the temperature of the second heating block BL6 is sensed, that is, at the position of the heating block where the relay node E6 is located. The temperature sensing element TH4 is placed at the position at which the temperature of the second heating block BL7 is sensed, that is, at the position of the heating block where the relay node E7 is located.

In the manner described above, in a set of two heating blocks, power is supply to a first heating block via a conductor connected to a first wire for a second heating block and via a second wire. Further, a temperature sensing element that monitors the temperature of a heating block is provided only for a second heating block in which an electrode acting as a relay node is located, among a first heating block and the second heating block.

Figure 30B:
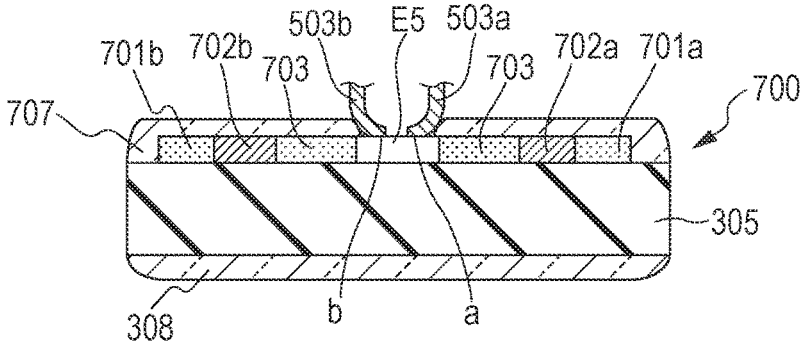
FIG. 30B is a diagram depicting the contact portions and wires of the heater according to the fourteenth exemplary embodiment.

FIG. 30B is a cross-sectional view of the holding member 201 illustrated in FIG. 30A taken along the line XXXB-XXXB. The wires 503*a* and 503*b* are connected to the surface of the electrode E5 at independent contacts "a" and "b", respectively. That is, power is supplied to the heating block BL3, which is a second heating block, via the electrode E5 (the conductor 703-5) of the heating block BL5, which is a first heating block. Also, the wires 504*a* and 504*b* are connected to the electrode E6 at independent contacts, and the wires 505*a* and 505*b* are connected to the electrode E7 at independent contacts.

Figure 31:
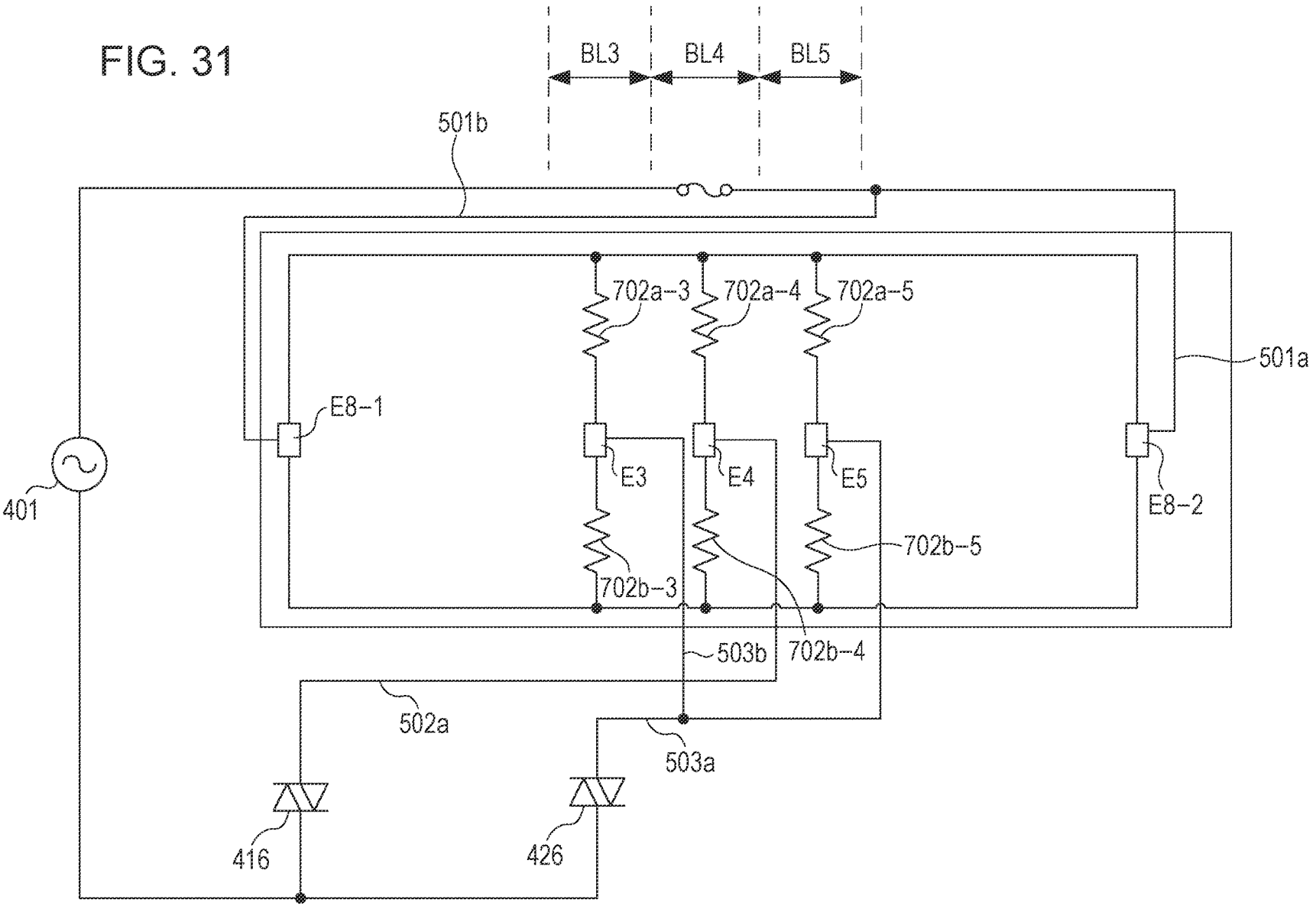
FIG. 31 is a diagram of wiring according to Comparative Example 1.

Next, the advantage of two wires being independently connected to one conductor of a second heating block will be described. For example, the following two configurations are considered: In the first configuration, the wire 503*b* branches off midway from the wire 503*a* and is connected to the heating block BL3 (Comparative Example 1). In the second configuration, the wire 503*a* and the wire 503*b* are connected to the electrode E5 at the same position (contact) on the electrode E5 (Comparative Example 2). FIG. 31 is a circuit diagram of Comparative Example 1. In FIG. 31, heating blocks other than the heating blocks BL3, BL4, and BL5 are not illustrated.

In Comparative Example 1, if the wire 503*a* is disconnected from the electrode E5, the wire 503*b* is still connected to the electrode E3. Thus, by taking into account abnormal heat generation that the heating block BL3 will undergo due to the failure of the CPU 420 or the like, a temperature sensing element at the position of the heating block BL3 is also required to sense an abnormal temperature rise of the heating block BL3. That is, a temperature sensing element at the position of the heating block BL3 is required in addition to a temperature sensing element at the position of the heating block BL5.

In Comparative Example 2, when the wire 503*a* is disconnected from the electrode E5, the wire 503*b* may also be disconnected from the electrode E5 while being electrically connected to the wire 503*a*. In this case, the heating block BL5 generates no heat, whereas the heating block BL3 generates heat. Accordingly, similarly to Comparative Example 1, taking into account an abnormal temperature rise of the heating block BL3 due to the failure of the CPU 420 or the like, a temperature sensing element at the position of the heating block BL3 is also required to sense an abnormal temperature rise. That is, a temperature sensing element at the position of the heating block BL3 is required in addition to a temperature sensing element at the position of the heating block BL5.

In connection configuration according to this exemplary embodiment, in contrast, even if the contact "a" (the wire 503*a*) is erroneously disconnected, the contact "b" is not disconnected while the wire 503*a* and the wire 503*b* are electrically connected. In this case, since the wire 503*a* is disconnected from the electrode E5, no abnormal temperature rise will occur in the heating block BL5. In addition, no an abnormal temperature rise will also occur in the heating block BL3. If the wire 503*b* (contact "b") is disconnected from the electrode E5, the heating block BL3 does not generate heat, and only the heating block BL5 might undergo abnormal heat generation. Such abnormal heat generation can be detected by the temperature sensing element TH2 disposed at the position of the heating block BL5. With the wiring configuration according to this exemplary embodiment, in a set of heating blocks including the heating block BL3 and the heating block BL5, only the heating block BL3 will not generate heat. This does not require a temperature sensing element at the position of the heating block BL3. Accordingly, in a set of two heating blocks, power is supplied to a first heating block (BL3) via a conductor (703-5) to which a first wire (503*a*) for a second heating block (BL5) is connected to and via a second wire (503*b*). The above-described configuration can reduce the cost of the image heating apparatus 200.

Fifteenth Exemplary Embodiment

FIGS. 32A to 32D are diagrams illustrating the configuration of a heater and the wiring configuration of power supply wires according to this exemplary embodiment. This exemplary embodiment is different from the fourteenth exemplary embodiment in that a conductor to which both a first wire and a second wire are connected is provided with electrodes for the respective wires. Other configuration is similar to that in the fourteenth exemplary embodiment.

Figure 32A:
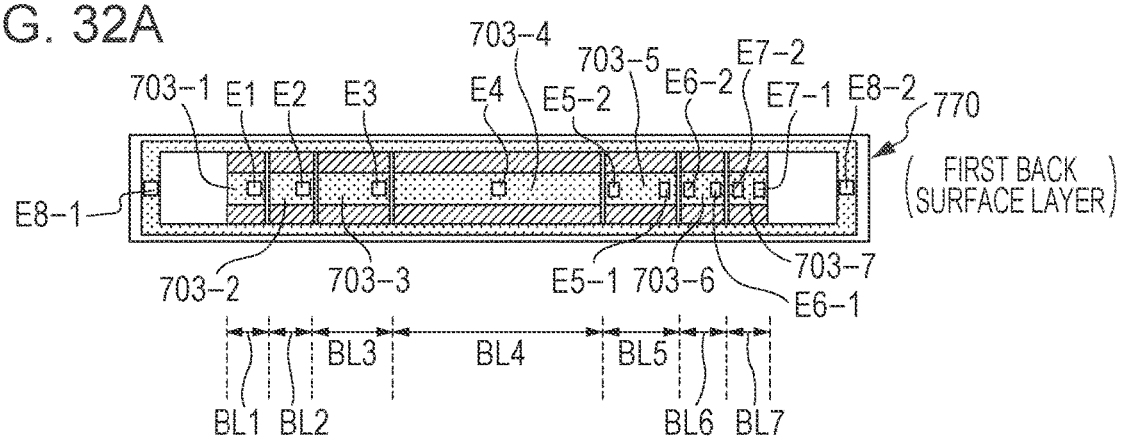
FIG. 32A is a configuration diagram of a heater according to a fifteenth exemplary embodiment.

As illustrated in FIG. 32A, a heater 770 according to this exemplary embodiment includes electrodes E5-1 and E5-2 for a conductor 703-5. The heater 770 further includes electrodes E6-1 and E6-2 for a conductor 703-6, and electrodes E7-1 and E7-2 for a conductor 703-7. Since the heater 770 has a larger number of electrodes than the heater 700 according to the fourteenth exemplary embodiment, as illustrated in FIG. 32B, a holding member 2201 that holds the heater 770 has a larger number of holes for the respective electrodes.

Figure 32B:
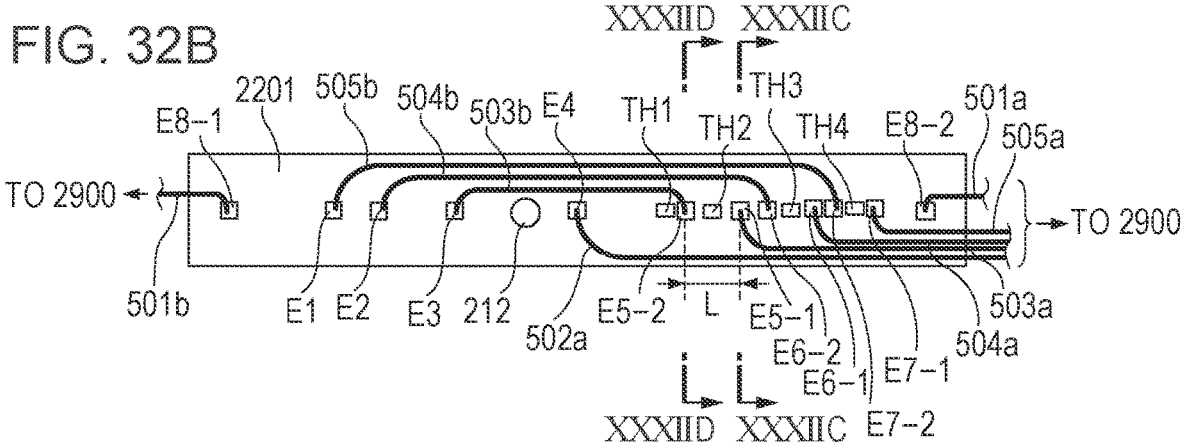
FIG. 32B is a diagram depicting contact portions and wires of the heater according to the fifteenth exemplary embodiment.

As illustrated in FIG. 32B, the wire 503*a* is connected to the electrode E5-1, and the wire 503*b* is connected to the electrode E5-2 and the electrode E3. The wire 504*a* is connected to the electrode E6-1, and the wire 504*b* is connected to the electrode E6-2 and the electrode E2. The wire 505*a* is connected to the electrode E7-1, and the wire 505*b* is connected to the electrode E7-2 and the electrode E1.

Figure 32C:
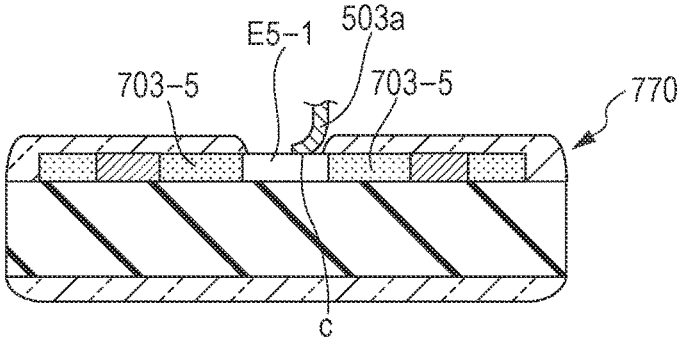
FIG. 32C is a diagram depicting the contact portions and wires of the heater according to the fifteenth exemplary embodiment.
Figure 32D:
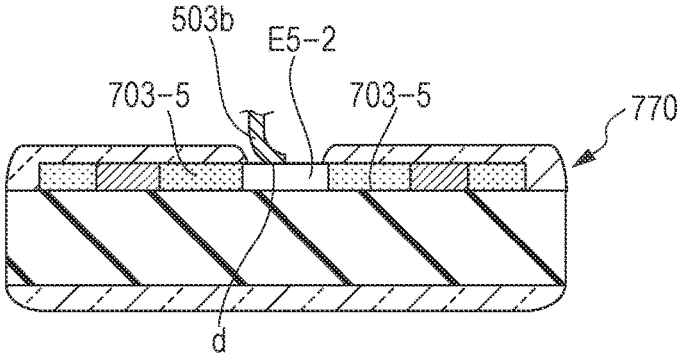
FIG. 32D is a diagram depicting the contact portions and wires of the heater according to the fifteenth exemplary embodiment.

FIG. 32C is a cross-sectional view of the holding member 2201 illustrated in FIG. 32B taken along the line XXXIIC-XXXIIC, and FIG. 32D is a cross-sectional view of the holding member 2201 illustrated in FIG. 32B taken along the line XXXIID-XXXIID. The wire 503*a* is in contact with the electrode E5-1 at a contact "c", and the wire 503*b* is in contact with the electrode E5-2 at a contact "d". As described above, the electrode E5-1 and the electrode E5-2 are electrodes for the conductor 703-5. The configuration of wires and contacts for the other sets of heating blocks are similar to those described above, and are not described herein.

Similarly to the fourteenth exemplary embodiment, also in the configuration according to this exemplary embodiment, power is supplied to a first heating block (BL3) via a conductor (703-5) to which a first wire (503*a*) for a second heating block (BL5) is connected and via a second wire (503*b*). Further, the electrode E5-1 for the conductor 703-5 to which the first wire 503*a* is connected, and the electrode E5-2 for the conductor 703-5 to which the second the wire 503*b* is connected are separately disposed. Thus, similarly to the fourteenth exemplary embodiment, no disconnection will occur while the wire 503*a* and the wire 503*b* are electrically connected, and only the heating block BL3 within the set of the heating blocks BL3 and BL5 does not generate heat. This does not require a temperature sensing element disposed at the position of the heating block BL3.

In addition, the wire length can be reduced by an amount corresponding to the distance L between the electrode E5-1 (at the position indicated by the line XXXIIC-XXXIIC) and the electrode E5-2 (at the position indicated by the line XXXIID-XXXIID), resulting in a reduction in cost.

In the fourteenth and fifteenth exemplary embodiments, each wire is implemented as a cable with an insulating coating, and is connected to an electrode by welding. Any other type of cable or any other connection method may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An image heating apparatus for heating an image formed on a recording material, comprising:

an endless belt;

a heater configured to be in contact with an inner surface of the endless belt, the heater including a substrate and a plurality of independently controllable heating blocks arranged in a longitudinal direction of the substrate, the heater having a plurality of first conductors corresponding to the plurality of the independently controllable heating blocks and a plurality of second conductors, each of the plurality of independently controllable heating blocks including a first conductor of the plurality of the first conductors disposed at a first position on the substrate so as to extend in a longitudinal direction of the substrate, a second conductor of the plurality of the second conductors disposed at a second position on the substrate so as to extend in the longitudinal direction, the second position being different from the first position in a transverse direction of the substrate that is transverse to the longitudinal direction, and a heating element disposed between the first conductor and the second conductor and configured to generate heat by power supplied thereto via the first conductor and the second conductor; and electrical contacts configured to be in contact with electrodes including first electrodes and second electrodes of the heater to supply power to the heating element, wherein the plurality of the first conductors is electrically connected each other as a common conductor, the heater has two of the first electrodes electrically connected to the common conductor, at least one of the second electrodes each connected to one of the second conductors is disposed in an area where the heating element is located in the longitudinal direction on a second surface opposite to a first surface of the heater that comes into contact with the endless belt, and the electrical contacts are arranged so as to face the second surface of the heater.

2. A heater for use in an image heating apparatus, comprising:

a substrate; and a plurality of independently controllable heating blocks arranged in a longitudinal direction of the substrate, each of the plurality of independently controllable heating blocks including a first conductor disposed at a first position in a short side direction perpendicular to the longitudinal direction of the substrate on the substrate so as to extend in the longitudinal direction, a second conductor disposed at a second position different from the first position in the short side direction on the substrate so as to extend in the longitudinal direction, a heating element disposed at a position between the first conductor and the second conductor and electrically connected to the first conductor and second conductor, wherein a plurality of the first conductor corresponding to the plurality of the independently controllable heating blocks are electrically connected as a common conductor, two of electrodes for the common conductor are provided on the substrate and electrically connected to the common conductor, in the longitudinal direction, one of the two electrodes for the common conductor is disposed outside one end of a region where all the heating elements are provided and the other of the two electrodes for the common conductor is disposed outside the other end of the region where all the heating elements are provided, each of the plurality of independently controllable heating blocks includes an electrode for the second conductor, and in the longitudinal direction, at least one of plurality of the electrodes for the second conductors is disposed in the region where all the heating elements are provided.

3. The heater according to claim 2, wherein the heating element have a positive temperature coefficient of resistance.

4. The heater according to claim 2, wherein each of the heating blocks includes a plurality of the heating elements electrically connected in parallel between the first conductor and the second conductor.

5. An image heating apparatus for heating an image formed on a recording material, comprising:

an endless belt configured to contact with the recording material;

a heater provided in an inner space of the belt;

a roller configured to form a nip portion in cooperation with the heater through the belt, wherein the image formed on the recording material is heated by heat of the heater at the nip portion, and wherein the heater is the claim 2.

6. The apparatus according to claim 5, further comprising a first switch configured to control power supplied to at least one of the plurality of heating blocks and a second switch configured to control power supplied to at least another one of the plurality of heating blocks.

* * * * *